US006924089B2

(12) United States Patent
Oya et al.

(10) Patent No.: US 6,924,089 B2
(45) Date of Patent: Aug. 2, 2005

(54) HEAT-DEVELOPABLE PHOTOSENSITIVE MATERIAL AND IMAGE FORMING METHOD

(75) Inventors: Toyohisa Oya, Kanagawa (JP); Hirokazu Kyota, Kanagawa (JP); Kouta Fukui, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/209,260

(22) Filed: Aug. 1, 2002

(65) Prior Publication Data

US 2003/0235791 A1 Dec. 25, 2003

(30) Foreign Application Priority Data

Aug. 24, 2001 (JP) ..... 2001-254129
Aug. 27, 2001 (JP) ..... 2001-256400

(51) Int. Cl.[7] ..... G03C 1/498

(52) U.S. Cl. ..... 430/350; 430/264; 430/566; 430/598; 430/607; 430/613; 430/614; 430/619; 430/620

(58) Field of Search ..... 430/350, 619, 430/566, 264, 598, 607, 613, 614, 620

(56) References Cited

U.S. PATENT DOCUMENTS 4,021,240 A * 5/1977 Cerquone et al.
4,782,004 A * 11/1988 Takeuchi et al. ..... 430/203
5,496,695 A 3/1996 Simpson et al.
5,976,756 A * 11/1999 Nakamura et al. ..... 430/203
6,013,421 A * 1/2000 Nakamura et al. ..... 430/351
6,090,538 A * 7/2000 Arai et al. ..... 430/619

FOREIGN PATENT DOCUMENTS

JP 9-304875 11/1997
JP 10-221806 8/1998

* cited by examiner

*Primary Examiner*—Thorl Chea
(74) *Attorney, Agent, or Firm*—Sughrue Mion, PLLC

(57) ABSTRACT

An object of the present invention is to provide a novel heat-developable photosensitive material which hardly exerts an influence on the image color tone and exhibits high sensitivity.

Disclosed is a heat-developable photosensitive material comprises, on the same surface of a substrate, at least (a) photosensitive silver halide, (b) a reducible silver salt, (c) a compound represented by the general formula (5), (d) a binder, (e) a compound represented by the general formula (6) or (7), and (f) a compound represented by the general formula (3).

14 Claims, 1 Drawing Sheet

HEAT-DEVELOPABLE PHOTOSENSITIVE MATERIAL AND IMAGE FORMING METHOD

BACKGROUND OF THE INVENTION

1. Field of the Invention

The present invention relates to a heat-developable photosensitive material and an image forming method suitably usable in medical diagnosis, industrial photography, printing and computer output microfilming (COM).

2. Description of the Related Art

Various photosensitive materials comprising a substrate having disposed thereon a photosensitive layer on which images can be formed by imagewise exposure are known. Examples thereof include photosensitive materials that are thermally developed to form images, and are known as systems that contribute to environmental protection and can simply means for forming images.

Methods for forming images by thermal development are disclosed in, for example, U.S. Pat. Nos. 3,152,904 and 3,457,075, and in D. Klosterboer, "Thermally Processed Silver Systems", page 279, chapter 9 in *Imaging Processes and Materials: Neblette's, 8th Edition*, edited by John Sturge, Vivian Walworth and Allan Shepp (London: John Wiley and Sons, Ltd., 1989). These heat-developable recording materials contain a reducible non-photosensitive silver source (e.g., organic silver salt), a catalytic amount of a photocatalyst (e.g., silver halide), and a silver reducing agent, all of which are dispersed in an organic binder matrix. While these heat-developable photosensitive materials are stable at room temperature, they produce silver when heated to a high temperature (e.g., 80° C. or higher) after exposure through a redox reaction between the reducible silver source (functions as an oxidizing agent) and the reducing agent. This redox reaction is promoted by catalytic action of a latent image generated by the exposure. The silver produced by the reaction of the reducible silver salt in the exposed region turns black and contrasts with the non-exposed region, whereby an image is formed.

As the heat-developable photosensitive material using an organic silver salt, a wide variety of reducing agents are disclosed, for example, in Japanese Patent Application Laid-Open (JP-A) Nos. 46-6074, 47-1238, 47-33621, 49-46427, 49-115540, 50-14334, 50-36110, 50-147711, 51-32632, 51-1023721, 51-32324, 51-51933, 52-84727, 55-108654, 56-146133, 57-82828, 57-82829, 6-3793, U.S. Pat. Nos. 3,667,9586, 3,679,426, 3,751,252, 3,751,255, 3,761,270, 3,782,949, 3,839,048, 3,928,686 and 5,464,738, German Patent No. 2,321,328, and European Patent No. 692,732.

Among these known reducing agents, a hindered phenol compound and a bisphenol compound have widely been used. However, heat-developable photosensitive materials using these reducing agents require time for development in order to obtain sufficient image density, and also there sometimes arises the problem of large variances in sensitivity with respect to development temperature. Techniques for solving this problem have been studied.

Development accelerators, and in particular reducing compounds, have been used to overcome this problem. For example, JP-A No. 10-221806 discloses a sulfonamide phenol compound. Additionally, U.S. Pat. No. 5,496,695 and JP-A No. 9-304875 disclose that ultrahigh-contrast performance can be obtained by using a hydrazine derivative as a known reducing compound in heat-developable photosensitive materials.

However, when the compounds disclosed in these publications are added to heat-developable photosensitive materials used for medical images and the like, where ultrahigh-contrast photographic characteristics are unnecessary, there arise problems such as severe fogging, excessive high contrast and poor image reproducibility, whereby it is impossible to obtain heat-developable photosensitive materials that are marketable as products.

When known development accelerators or known hydrazine derivatives such as the above are used, there are sometimes problems in that the effect of development acceleration is insufficient, contrast gradation is too high, image reproducibility is lowered, and storage stability of the photosensitive material is insufficient. These problems are caused by various factors such as combinations with other additives, manufacturing conditions of photosensitive materials, development temperature, and the passage of time, which constitute a large issue in designing heat-developable photosensitive materials. There has thus been a demand for a novel heat-developable photosensitive material that can solve these problems.

SUMMARY OF THE INVENTION

The present invention aims to solve the various problems described above and attain the following object. It is an object of the invention to provide a novel heat-developable photosensitive material that exhibits high sensitivity and little fogging, is developed quickly, and in which there are few changes in performance due to variance in heat development temperature.

Another object of the invention is to provide a novel heat-developable photosensitive material that hardly influences image color tones, exhibits high sensitivity and little fogging, is developed quickly, and in which there are few changes in performance due to variance in heat development temperature.

The present inventors conducted exhaustive studies in order to solve the problems described above, and found that an excellent heat-developable photosensitive material having desired effects can be provided by using a compound having a specific structure in a heat-developable photosensitive material comprising a substrate having disposed on a same surface thereof at least a photosensitive silver halide, a reducible silver salt, and a binder.

According to a first aspect of the invention, there is provided a heat-developable photosensitive material comprising, a substrate having disposed on a same surface thereof at least a photosensitive silver halide, a reducible silver salt, a compound represented by one of the following general formulae (1) and (2), a binder, and a compound represented by the following general formula (3):

General formula (1)

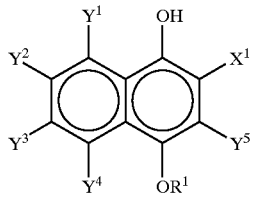

General formula (2)

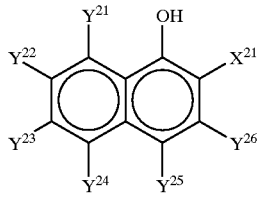

General formula (3)

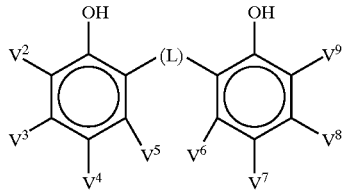

wherein, in the general formula (1), $R^1$ represents an alkyl group, an aryl group, an alkenyl group or an alkynyl group, $X^1$ represents an acyl group, an alkoxycarbonyl group, a carbamoyl group, a sulfonyl group or a sulfamoyl group, and $Y^1$ to $Y^5$ each independently represents a hydrogen atom or a substituent;

in the general formula (2), $X^{21}$ represents a group —$NX^{31}X^{32}$, and $X^{31}$ and $X^{32}$ each independently represents a hydrogen atom or a substituent, and $Y^{21}$ to $Y^{26}$ each independently represents a hydrogen atom or a substituent; and in the general formula (3), $V^2$ to $V^9$ each independently represents a hydrogen atom or a substituent, L represents a linking group —$CH(V^{10})$— or a linking group —S—, and $V^{10}$ represents a hydrogen atom or a substituent.

Preferably, the heat-developable photosensitive material of the invention further comprises an ultrahigh-contrast agent.

Furthermore, the present inventors have intensively studied to solve the problems described above and found that an excellent heat-developable photosensitive material having a desired effect can be provided by using a reducing compound having a specific structure (compound known generically as a hydazine developing agent) and a phenol or naphthol compound in a heat-developable photosensitive material containing, on a same surface of a substrate, at least a photosensitive silver halide, a reducible silver salt, and a binder, and thus the invention has been completed.

According to a second aspect of the invention, there is provided a heat-developable photosensitive material comprising a substrate having disposed on a same surface thereof at least (a) photosensitive silver halide, (b) a reducible silver salt, (c) a compound represented by the following general formula (5), (d) a binder, (e) a compound represented by one of the following general formulae (6) and (7), and (f) a compound represented by the following general formula (3), wherein the total of a maximum concentration at an absorption maximum wavelength of a dye image formed from the compound represented by the following general formula (5) and the compound represented by one of the following general formulae (6) and (7) is less than 0.01 after development.

General formula (3)

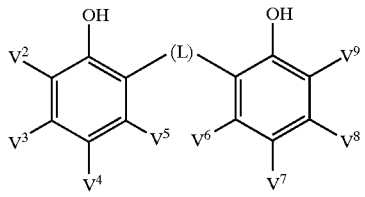

General formula (5)

$Q^1$—NHNH—$V^1$

General formula (6)

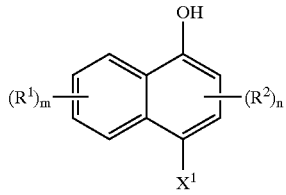

General formula (7)

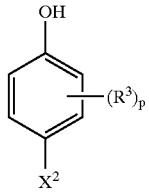

wherein, in the general formula (5), $Q^1$ represents a 5- to 7-membered unsaturated ring linked with NHNH—$V^1$ through a carbon atom, and $V^1$ represents a carbamoyl group, an acyl group, an alkoxycarbonyl group, an aryloxycarbonyl group, a sulfonyl group or a sulfamoyl group;

in the general formulae (6) and (7), $X^1$ and $X^2$ each independently represents a hydrogen atom or a substituent, $R^1$ to $R^3$ each independently represents a hydrogen atom or a substituent, m and p each independently represents an integer of 0 to 4, and n represents an integer of 0 to 2; and in the general formula (3), $V^2$ to $V^9$ each independently represents a hydrogen atom or a substituent, L represents a linking group —$CH(V^{10})$— or a linking group —S—, and $V^{10}$ represents a hydrogen atom or a substituent.

In the compound represented by the general formula (5), $V^1$ preferably represents a carbamoyl group. Q1 preferably represents a quinazolinyl group.

In the compound represented by the general formula (6) or (7), preferably, $X^1$ and $X^2$ each independently represents a substituent, and more preferably an alkoxy group or an aryloxy group. The compound represented by the general formula (6) preferably has a 2-carbamoyl group, and more preferably a 2-arylcarbamoyl group.

In the heat-developable photosensitive material of the invention, preferably, the substrate further comprises, on the same surface thereof disposed with the components (a) to (f), (g) an organic polyhalogen compound represented by the following general formula (4). Similarly, the substrate further more preferably comprises (h) an ultrahigh-contrast agent.

$Q^2$-(Y)n-$CZ^1Z^2X$ General formula (4)

In the general formula (4), $Q^2$ represents an alkyl group, an aryl group or a heterocycle group which may have a substituent, Y represents a divalent linking group, n represents 0 or 1, $Z^1$ and $Z^2$ each independently represents a halogen atom, and X represents a hydrogen atom or an electron attractive group.

The image forming method of the invention comprises exposing the heat-developable photosensitive material of the invention to light and heat-developing the exposed heat-developable photosensitive material to form an image.

DESCRIPTION OF THE PREFERRED EMBODIMENTS

Figure 1:
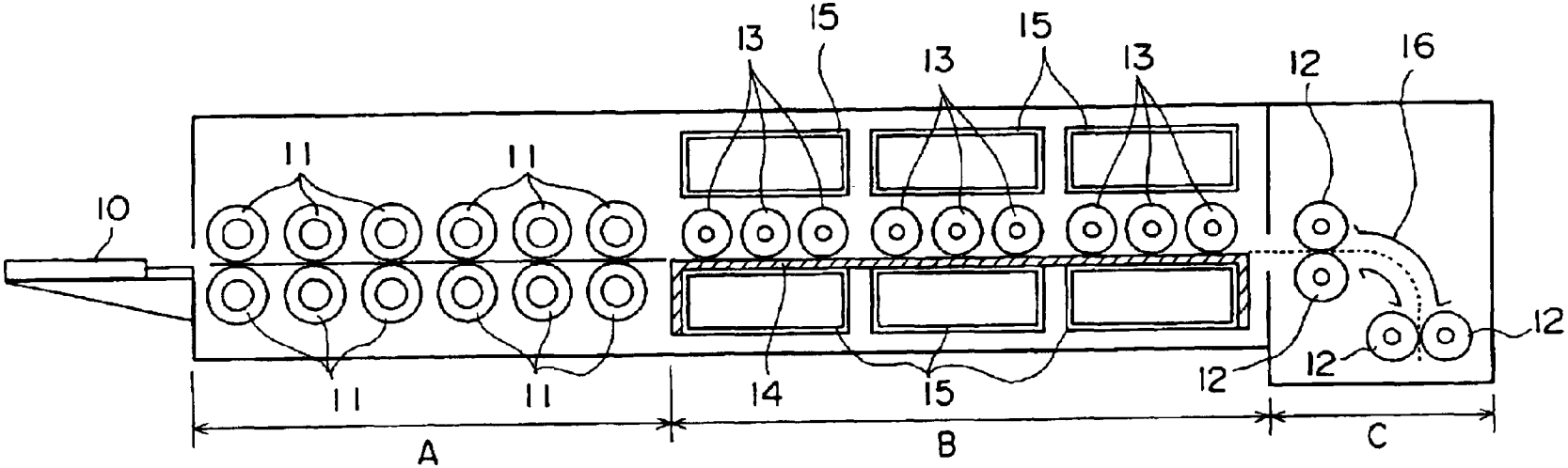
FIG. 1 is a schematic view showing one example of a heat developing apparatus applied to the image forming method of the present invention.

The heat-developable photosensitive material of the present invention will be explained in detail. In the present specification, "to" denotes a range including numerical values described before and after it as a minimum value and a maximum value.

The heat-developable photosensitive material comprises, on a same surface of a substrate, at least a photosensitive silver halide, a reducible silver salt, a compound represented by the following the general formula (1) or (2), a binder, and a compound represented by the following general formula (3). The heat-developable photosensitive material of the invention exhibits high sensitivity and less fogging, and is also developed quickly and causes less change in performances due to change in heat development temperature, because the compound represented by the following general formula (1) or (2) is used in combination with the compound represented by the following general formula (3) as a reducing agent for the reducible salt (organic silver salt). This reason is considered as follows. That is, when the heat-developable photosensitive material is heat-developed, the compound represented by the following general formula (1) or (2) acts as a highly active reducing agent, thereby contributing to formation of a silver image, together with compound represented by the general formula (3), and thus the compound itself is converted into an oxidant. However, since the compound is reduced again and regenerated by the redox reaction with the compound represented by the general formula (3) and can act as a highly active reducing agent again, it is made possible to obtain a heat-developable photosensitive material, which exhibits high sensitivity and less fogging, and is also developed quickly and causes less change in performances due to change in heat development temperature.

The heat-developable photosensitive material of the invention comprises, on a same surface of a substrate, at least a photosensitive silver halide, a reducible silver salt, a compound represented by the following general formula (5), a binder, a compound represented by the following general formula (6) or (7), and a compound represented by the following general formula (3), wherein the sum total of a maximum concentration at an absorption maximum wavelength of a dye image formed from the compound represented by the following general formula (5) and the compound represented by the following general formula (6) or (7) is less than 0.01 after the development.

In the heat-developable photosensitive material of the invention, since the compound represented by the following general formula (5), a binder, the compound represented by the following general formula (6) or (7) and the compound represented by the following general formula (3) are used in combination as a reducing agent for the reducible salt (organic silver salt) and the sum total of a maximum concentration at an absorption maximum wavelength of a dye image formed from the compound represented by the general formula (5) and the compound represented by the general formula (6) or (7) is less than 0.01 after the development, the resulting heat-developable photosensitive material hardly exerts an influence on the image color tone and exhibits high sensitivity and less fogging, and is also developed quickly and causes less change in performances due to change in heat development temperature. This reason is considered as follows.

When heat-developed, the compound represented by the general formula (5) acts as a highly active reducing agent, thereby contributing to formation of a silver image, together with the compound represented by the general formula (3), and thus the compound itself is converted into an oxidant. The compound represented by the general formula (5) has high activity, but tends to cause fogging when the additive amount is large. On the other hand, when the heat-developable photosensitive material of the invention is heat-developed, the compound represented by the following general formula (6) or (7) acts as a highly active reducing agent, thereby contributing to formation of a silver image, together with compound represented by the general formula (3), and thus the compound itself is converted into an oxidant. However, since the compound is sometimes reduced again by the redox reaction with the compound represented by the general formula (3) and can act as a reducing agent again. Although the compound represented by the general formula (6) or (7) is less likely to cause fogging when the additive amount is increased, the activity tends to be lower than that of the compound represented by the general formula (5). Therefore, the use of the compound represented by the general formula (5), the compound represented by the general formula (6) or (7) and the compound represented by the general formula (3) in combination makes it possible to reconcile high activity as the reducing agent and fogging. In the heat-developable photosensitive material of the invention, since the sum total of a maximum concentration at an absorption maximum wavelength of a dye image formed from the compound represented by the general formula (5) and the compound represented by the general formula (6) or (7) is less than 0.01 (preferably less than 0.005, and more preferably less than 0.001) after the development, the compound represented by the general formula (5) and the compound represented by the general formula (6) or (7) do not substantially form a dye and an influence is hardly exerted on the image color tone of the heat-developable photosensitive material.

Preferred embodiment of the heat-developable photosensitive material of the invention is an embodiment wherein an image-forming layer containing an organic silver salt as a reducible silver salt and a binder is formed on a substrate and a photosensitive silver halide emulsion layer (photosensitive layer) containing a photosensitive silver halide is formed on a same surface of the image-forming layer. Preferably, it is an embodiment wherein the image-forming layer is a photosensitive layer. Particularly preferred embodiment is an ultrahigh-contrast photosensitive material comprising a developing agent in the same side of the image-forming layer, and preferably an ultrahigh-contrast photosensitive material further comprising an ultrahigh-contrast agent. Particularly in such a heat-developable photosensitive material, a good image can be obtained more preferably by using the compound represented by the following general formula (1) or (3) in combination with the compound represented by the following general formula (2) without causing a decrease in maximum density (Dmax) and sensitivity and an increase in fogging (Dmin).

First, the compounds represented by the general formulae (1) to (3) will be explained. The compound represented by the general formula (1) will be explained below.

General formula (1)

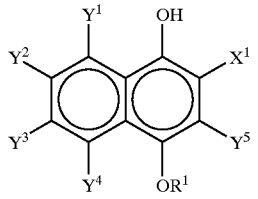

In the general formula (1), $R^1$ represents an alkyl group, an aryl group, an alkenyl group, or an alkynyl group.

The alkyl group represented by $R^1$ is preferably a straight-chain, branched, cyclic or combined alkyl group having 1 to 30 carbon atoms, more preferably 1 to 16 carbon atoms, and still more preferably 1 to 13 carbon atoms, and examples thereof include methyl, ethyl, n-propyl, isopropyl, n-butyl, sec-butyl, t-butyl, n-hexyl, cyclohexyl, n-octyl, t-octyl, n-amyl, t-amyl, n-decyl, n-dodecyl, n-tridecyl, benzyl, and phenethyl.

The aryl group represented by $R^1$ preferably has 6 to 30 carbon atoms, more preferably 6 to 20 carbon atoms, and still more preferably 6 to 12 carbon atoms, and examples thereof include phenyl, 4-methylphenyl, 2-chlorophenyl, 4-chlorophenyl, 2,4-dichlorophenyl, 3,4-dichlorophenyl, 2-methoxyphenyl, 4-methoxyphenyl, 4-hexyloxyphenyl, 2-dodecyloxyphenyl, and naphthyl.

The alkenyl group represented by $R^1$ preferably has 2 to 30 carbon atoms, more preferably 2 to 20 carbon atoms, and still more preferably 2 to 12 carbon atoms, and examples thereof include vinyl group, aryl group, isopropenyl group, butenyl group, and cyclohexenyl group.

The alkynyl group represented by $R^1$ preferably has 2 to 30 carbon atoms, more preferably 2 to 20 carbon atoms, and still more preferably 2 to 12 carbon atoms, and examples thereof include ethynyl group, and propinyl group.

$R^1$ may further have a substituent and examples of preferred substituent include groups represented by $Y^1$ to $Y^5$ of the compound of the formula (I) described hereinafter.

More preferably, $R^1$ represents an alkyl group or aryl group, and particularly preferably an alkyl group.

In the compound of the general formula (1), $X^1$ represents an acyl group, an alkoxycarbonyl group, a carbamoyl group, a sulfonyl group or a sulfamoyl group.

The acyl group represented by $X^1$ preferably has 2 to 20 carbon atoms, more preferably 2 to 16 carbon atoms, and still more preferably 2 to 12 carbon atoms, and examples thereof include acetyl, propionyl, butyryl, valeryl, hexanoyl, myristylyl, palmitoyl, stearyl, oleyl, acryloyl, cyclohexanecarbonyl, benzoyl, formyl, and pivaroyl.

The alkoxycarbonyl group represented by $X^1$ preferably has 2 to 20 carbon atoms, more preferably 2 to 16 carbon atoms, and still more preferably 2 to 12 carbon atoms, and examples thereof include methoxycarbonyl, ethoxycarbonyl, butoxycarbonyl, and phenoxycarbonyl.

The carbamoyl group represented by $X^1$ preferably has 1 to 20 carbon atoms, more preferably 1 to 16 carbon atoms, and still more preferably 1 to 12 carbon atoms, and examples thereof include carbamoyl, N,N-diethylcarbamoyl, N-dodecylcarbamoyl, N-decylcarbamoyl, N-hexadecylcarbamoyl, N-phenylcarbamoyl, N-(2-chlorophenyl)carbamoyl, N-(4-chlorophenyl)carbamoyl, N-(2,4-dichlorophenyl)carbamoyl, N-(3,4-dichlorophenyl) carbamoyl, N-pentachlorophenylcarbamoyl, N-(2-methoxyphenyl)carbamoyl, N-(4-methoxyphenyl) carbamoyl, N-(2, 4-dimethoxyphenyl)carbamoyl, N-(2-dodecyloxyphenyl)carbamoyl, and N-(4-dodecyloxyphenyl) carbamoyl.

The sulfonyl group represented by $X^1$ preferably has 1 to 20 carbon atoms, more preferably 1 to 16 carbon atoms, and still more preferably 1 to 12 carbon atoms, and examples thereof include mesyl, ethanesulfonyl, cyclohexanesulfonyl, benzenesulfonyl, tosyl, and 4-chlorobenzenesulfonyl.

The sulfamoyl group represented by $X^1$ preferably has 0 to 20 carbon atoms, more preferably 0 to 16 carbon atoms, and still more preferably 0 to 12 carbon atoms, and examples thereof include sulfamoyl, methylsulfamoyl, dimethylsulfamoyl, and phenylsulfamoyl.

$X^1$ may further have a substituent and examples of preferred substituent include groups represented by $Y^1$ to $Y^5$ of the compound of the formula (I) described hereinafter.

$X^1$ preferably represents a carbamoyl group, more preferably an alkyl carbamoyl group or an allylcarbamoyl group, and particularly preferably an arylcarbamoyl group.

In the general formula (1), $Y^1$ to $Y^5$ each independently represents a hydrogen atom or a substituent.

As the substituent represented by $Y^1$ to $Y^5$, any substituent may be used as far as it does not exert an adverse influence on the photographic performance. Examples thereof include halogen atom (e.g. fluorine atom, chlorine atom, bromine atom, iodine atom), straight-chain, branched, cyclic or combined alkyl group (preferably having 1 to 20 carbon atoms, more preferably 1 to 16 carbon atoms, and still more preferably 1 to 13, and examples thereof include methyl, ethyl, n-propyl, isopropyl, sec-butyl, t-butyl, t-octyl, n-amyl, t-amyl, n-dodecyl, and n-tridecyl, cyclohexyl), alkenyl group (preferably having 2 to 20 carbon atoms, more preferably 2 to 16 carbon atoms, and still more preferably 2 to 12 carbon atoms, and examples thereof include vinyl, allyl, 2-butenyl, and 3-pentenyl), aryl group (preferably having 6 to 30 carbon atoms, more preferably 6 to 20, and still more preferably 6 to 12, and examples thereof include phenyl, p-methylphenyl, and naphthyl), alkoxy group (preferably having 1 to 20 carbon atoms, more preferably 1 to 16 carbon atoms, and still more preferably 1 to 12 carbon atoms, and examples thereof include methoxy, ethoxy, propoxy, and butoxy), aryloxy group (preferably having 6 to 30 carbon atoms, more preferably 6 to 20, and still more preferably 6 to 12, and examples thereof include phenyloxy and 2-naphthyloxy), acyloxy group (preferably having 2 to 20 carbon atoms, more preferably 2 to 16 carbon atoms, and still more preferably 2 to 12 carbon atoms, and examples thereof include acetoxy and benzoyloxy), amino group (preferably having 0 to 20 carbon atoms, more preferably 1 to 16 carbon atoms, and still more preferably 1 to 12 carbon atoms, and examples thereof include dimethylamino group, diethylamino group, dibutylamino group, and anilino group), acylamino group (preferably having 2 to 20 carbon atoms, more preferably 2 to 16 carbon atoms, and still more preferably 2 to 13, and examples thereof include acetylamino, tridecanoylamino, and benzoylamino), sulfonylamino group (preferably having 1 to 20 carbon atoms, more preferably 1 to 16 carbon atoms, and still more preferably 1 to 12 carbon atoms, and examples thereof include methanesulfonylamino, butanesulfonylamino, and benzenesulfonylamino), ureido group (preferably having 1 to 20 carbon atoms, more preferably 1 to 16 carbon atoms, and still more preferably 1 to 12 carbon atoms, and examples thereof include ureido, methylureido, and phenylureido), carbamate group (preferably having 2 to 20 carbon atoms, more preferably 2 to 16 carbon atoms, and still more preferably 2 to 12 carbon atoms, and examples thereof include methoxycarbonylamino and phenyloxycarbonylamino), carboxyl group, carbamoyl group (preferably having 1 to 20 carbon atoms, more preferably 1 to 16 carbon atoms, and still more preferably 1 to 12 carbon atoms, and examples thereof include carbamoyl, N,N-diethylcarbamoyl, N-dodecylcarbamoyl, and N-phenylcarbamoyl), alkoxycarbonyl group (preferably having 2 to 20 carbon atoms, more preferably 2 to 16 carbon atoms, and still more preferably 2 to 12 carbon atoms, and examples thereof include methoxycarbonyl, ethoxycarbonyl, and butoxycarbonyl), acyl group (preferably having 2 to 20 carbon atoms, more preferably 2 to 16 carbon atoms, and still more preferably 2 to 12 carbon atoms, and examples thereof include acetyl, benzoyl, formyl, and pivaroyl), sulfo group, sulfonyl group (preferably having 1 to 20 carbon atoms, more preferably 1 to 16 carbon atoms, and still more preferably 1 to 12 carbon atoms, and examples thereof include mesyl and tosyl), sulfamoyl group (preferably having 0 to 20 carbon atoms, more preferably 0 to 16, and still more preferably 0 to 12, and examples thereof include sulfamoyl, methylsulfamoyl, dimethylsulfamoyl, and phenylsulfamoyl), cyano group, nitro group, hydroxyl group, mercapto group, alkylthio group (preferably having 1 to 20 carbon atoms, more preferably 1 to 16 carbon atoms, and still more preferably 1 to 12 carbon atoms, and examples thereof include methylthio and butylthio), heterocycle group (preferably having 2 to 20 carbon atoms, more preferably 2 to 16 carbon atoms, and still more preferably 2 to 12 carbon atoms, and examples thereof include pyridyl, imidazoyl, and pyrrolidyl). These substituents may be further substituted with these substituents.

Among these, preferred substituents represented by $Y^1$ to $Y^5$ are a halogen atom, an alkyl group, an aryl group, an alkoxy group, an aryloxy group, an acyloxy group, an anilino group, an acylamino group, a sulfonylamino group, a carboxyl group, a carbamoyl group, an acyl group, a sulfo group, a sulfonyl group, a sulfamoyl group, a cyano group, a hydroxyl group, a mercapto group, an alkylthio group, and a heterocycle group.

In the general formula (1), preferred combination is that $R^1$ is an alkyl group, $X^1$ is a carbamoyl group, and $Y^1$ to $Y^5$ are hydrogen atoms.

Next, specific examples of the compound represented by the general formula (1) are described, but the compounds used in the invention are not limited to these specific examples.

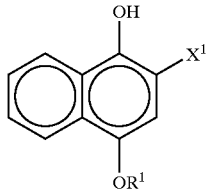

| Comp'd | $X^1$ | $R^1$ |
|---|---|---|
| A-1 | —$CONHC_6H_5$ | —$CH_3$ |
| A-2 | —$CONHC_6H_5$ | —$C_2H_5$ |
| A-3 | —$CONHC_6H_5$ | —$C_3H_7$ |
| A-4 | —$CONHC_6H_5$ | —i-$C_3H_7$ |
| A-5 | —$CONHC_6H_5$ | —$C_4H_9$ |
| A-6 | —$CONHC_6H_5$ | —$C_5H_{11}$ |
| A-7 | —$CONHC_6H_5$ | —$C_6H_{13}$ |
| A-8 | —$CONHC_6H_5$ | —C—$C_6H_{11}$ |
| A-9 | —$CONHC_6H_5$ | —$C_{10}H_{21}$ |
| A-10 | —$CONHC_6H_5$ | —$C_{12}H_{25}$ |
| A-11 | —$CONHC_6H_5$ | —$C_{16}H_{33}$ |
| A-12 | —$CONHC_6H_5$ | —$CH_2C_6H_5$ |
| A-13 | —$CONHC_6H_5$ | —$(CH_2)_2C_6H_5$ |
| A-14 | —$CONHC_6H_5$ | —$(CH_2)_2NHSO_2CH_3$ |

-continued

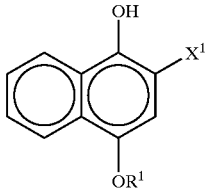

| Comp'd | $X^1$ | $R^1$ |
|---|---|---|
| A-15 | —$CONHC_6H_5$ | —$(CH_2)_2OCH_2CH_3$ |
| A-16 | —$CONHC_6H_5$ | —$(CH_2)_2O(CH_2)_2OH$ |
| A-17 | —$CONHC_6H_5$ | —$(CH_2)_2OCH_2CO_2H$ |
| A-18 | —$CONHC_6H_5$ | —$C_8H_{17}$ |
| A-19 | —$CONHC_6H_5$ | —$(CH_2)_2SO_2CH_3$ |
| A-20 | —$CONHC_6H_5$ | —$(CH_2)_2SO_2CH_2CH_3$ |
| A-21 | —$CONHC_6H_5$ | —$(CH_2)_2O(CH_2)_2OCH_2CH_3$ |
| A-22 | —$CONHC_6H_5$ | 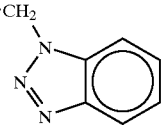 |
| A-23 | —$CONHC_6H_5$ | 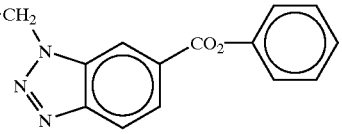 |
| A-24 | —$CONHC_6H_5$ | —$C_6H_5$ |
| A-25 | —$CONHC_6H_5$ | —p-$CH_2$—$C_6H_4$ |
| A-26 | —$CONHC_6H_5$ | —p-Cl—$C_6H_4$ |
| A-27 | —$CONHC_6H_5$ | 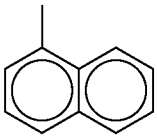 |
| A-28 | —$CONHC_6H_5$ | 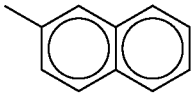 |
| A-29 | —CONH—2-Cl—$C_6H_4$ | —$CH_3$ |
| A-30 | —CONH—2-Cl—$C_6H_4$ | —$C_4H_9$ |
| A-31 | —CONH—2-Cl—$C_6H_4$ | —$C_6H_{13}$ |
| A-32 | —CONH—2-Cl—$C_6H_4$ | —$(CH_2)_2C_6H_5$ |
| A-33 | —CONH—2-Cl—$C_6H_4$ | —$C_{12}H_{25}$ |
| A-34 | —CONH—4-Cl—$C_6H_4$ | —$C_4H_9$ |
| A-35 | —CONH—4-Cl—$C_6H_4$ | —$C_6H_{13}$ |
| A-36 | —CONH—4-Cl—$C_6H_4$ | —$C_8H_{17}$ |
| A-37 | —CONH—4-Cl—$C_6H_4$ | —$(CH_2)_2C_6H_5$ |
| A-38 | —CONH—4-Cl—$C_6H_4$ | —$C_{10}H_{25}$ |
| A-39 | 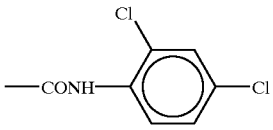 | —$CH_3$ |
| A-40 | 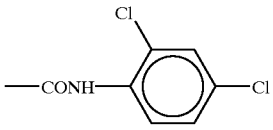 | —$C_4H_9$ |

-continued
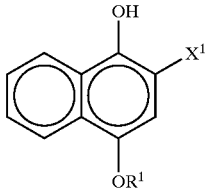
| Comp'd | $X^1$ | $R^1$ |
|---|---|---|
| A-41 | 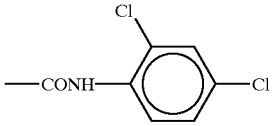 | $—C_6H_{13}$ |
| A-42 | 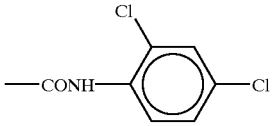 | $—C_8H_{17}$ |
| A-43 | 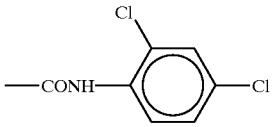 | $—(CH_2)_2C_6H_5$ |
| A-44 | 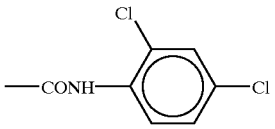 | $—C_{10}H_{21}$ |
| A-45 | 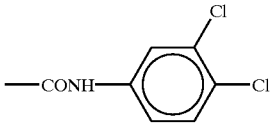 | $—CH{=}CHCH_3$ |
| A-46 | 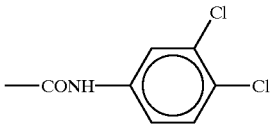 | $—C_4H_9$ |
| A-47 | 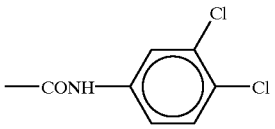 | $—C_5H_{13}$ |
| A-48 | 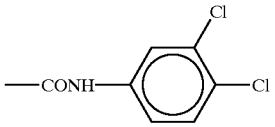 | $—C{\equiv}CH$ |
| A-49 | 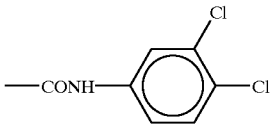 | $—C_8H_{17}$ |

-continued
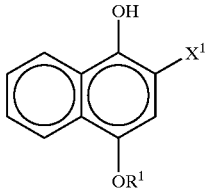
| Comp'd | $X^1$ | $R^1$ |
|---|---|---|
| A-50 | 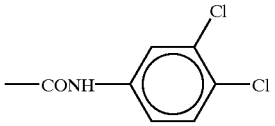 | $—(CH_2)_2C_6H_5$ |
| A-51 | 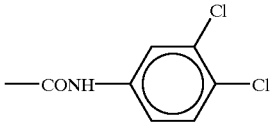 | $—CH_2C_6H_5$ |
| A-52 | 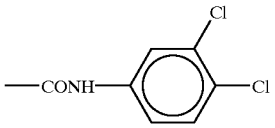 | $—C_6H_5$ |
| A-53 | 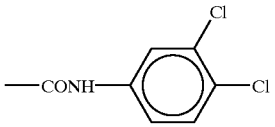 | $—(CH_2)_2SO_2CH_3$ |
| A-54 | 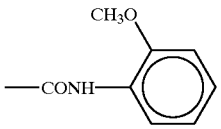 | $—C_6H_{13}$ |
| A-55 | 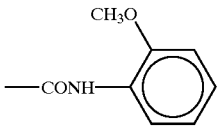 | $—(CH_2)_2C_6H_5$ |
| A-56 | 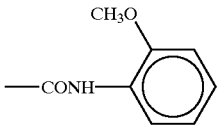 | $—C_4H_9$ |
| A-57 | $—CONHCH_3$ | $—C_6H_{13}$ |
| A-58 | $—CONHC_4H_9$ | $—C_6H_{13}$ |
| A-59 | $—CONHC_6H_{13}$ | $—C_6H_{13}$ |
| A-60 | $—CONHC_{10}H_{21}$ | $—C_6H_{13}$ |
| A-61 | $—CONHC_{12}H_{25}$ | $—C_6H_{13}$ |
| A-62 | $—CONHC_{16}H_{33}$ | $—C_6H_{13}$ |
| A-63 | 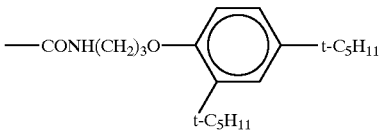 | $—C_6H_{13}$ |
| A-64 | $—CONH(CH_2)_3OC_{12}H_{25}$ | $—C_6H_{13}$ |

-continued
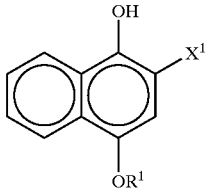
| Comp'd | $X^1$ | $R^1$ |
|---|---|---|
| A-65 | 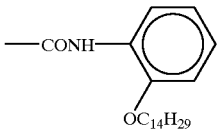 | $—C_6H_{13}$ |
| A-66 | $—CONHCH_2C_6H_5$ | $—C_6H_{13}$ |
| A-67 | 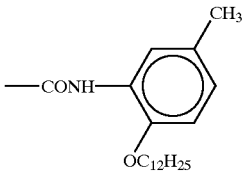 | $—C_6H_{13}$ |
| A-68 | 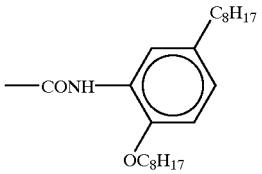 | $—C_6H_{13}$ |
| A-69 | $—CONH—t\text{-}C_4H_9$ | $—C_6H_{13}$ |
| A-70 | $—CONH—t\text{-}C_8H_{17}$ | $—C_6H_{13}$ |
| A-71 | $—CON(C_2H_5)_2$ | $—C_6H_{13}$ |
| A-72 | 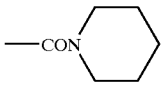 | $—C_6H_{13}$ |
| A-73 | 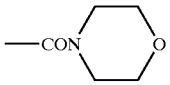 | $—C_6H_{13}$ |
| A-74 | 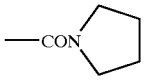 | $—C_6H_{13}$ |
| A-75 | $—CONHC_4H_9$ | $—(CH_2)_2C_6H_5$ |
| A-76 | $—CONHC_{10}H_{21}$ | $—(CH_2)_2C_6H_5$ |
| A-77 | $—CONHC_{12}H_{25}$ | $—(CH_2)_2C_6H_5$ |
| A-78 | $—CONH—t\text{-}C_4H_9$ | $—(CH_2)_2C_6H_5$ |
| A-79 | $—CONH—t\text{-}C_8H_{17}$ | $—(CH_2)_2C_6H_5$ |
| A-80 | $—CONHCH_3$ | $—(CH_2)_2C_6H_5$ |
| A-81 | 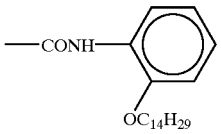 | $—(CH_2)_2C_6H_5$ |
| A-82 | $—CON(C_2H_5)_2$ | $—(CH_2)_2C_6H_5$ |
| A-83 | 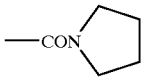 | $—(CH_2)_2C_6H_5$ |

-continued
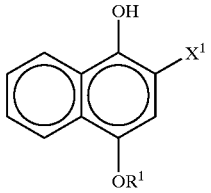
| Comp'd | $X^1$ | $R^1$ |
|---|---|---|
| A-84 | $—CONHCH_2C_6H_5$ | $—(CH_2)_2C_6H_5$ |
(A-85)
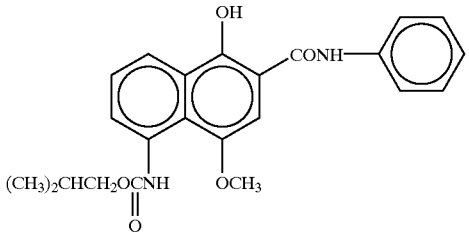
(A-86)
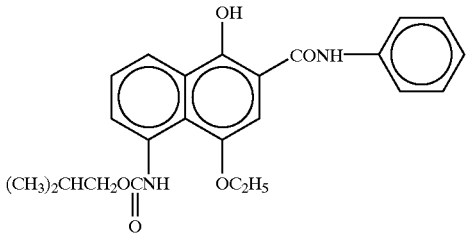
(A-87)
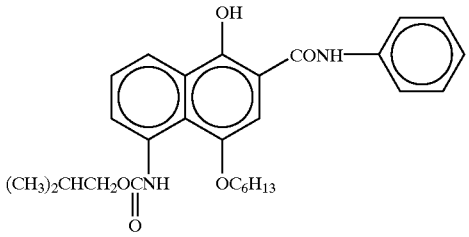
(A-88)
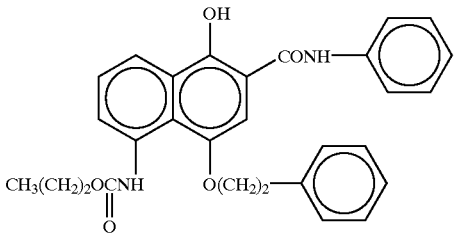
| | | |
|---|---|---|
| A-89 | $—COCH_3$ | $—C_6H_{13}$ |
| A-90 | $—COC_2H_5$ | $—C_6H_{13}$ |
| A-91 | $—COC_7H_{15}$ | $—C_6H_{13}$ |
| A-92 | $—COC_{11}H_{23}$ | $—C_6H_{13}$ |
| A-93 | $—COCH_3$ | $—(CH_2)_2C_6H_5$ |
| A-94 | $—COC_2H_5$ | $—(CH_2)_2C_6H_5$ |
| A-95 | $—COC_7H_{15}$ | $—(CH_2)_2C_6H_5$ |
| A-96 | $—COC_{11}H_{23}$ | $—(CH_2)_2C_6H_5$ |
| A-97 | $—COCH_3$ | $—CH_3$ |
| A-98 | $—COCH_3$ | $—C_4H_9$ |
| A-99 | $—COCH_3$ | $—C_6H_5$ |
| A-100 | $—COCH_3$ | $—CH_2C_6H_5$ |
| A-101 | $—COCH_3$ | $—C_{10}H_{21}$ |
| A-102 | $—COCH_3$ | $—C_{12}H_{25}$ |
| A-103 | $—COCH_3$ | $—C_{16}H_{33}$ |

-continued

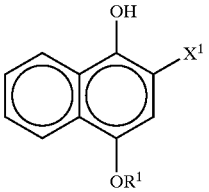

| Comp'd | $X^1$ | $R^1$ |
|---|---|---|
| A-104 | —$CO_2C_6H_5$ | —$C_6H_5$ |
| A-105 | —$CO_2C_6H_5$ | —$CH_3$ |
| A-106 | —$CO_2C_6H_5$ | —$C_2H_5$ |
| A-107 | —$CO_2C_6H_5$ | —$C_4H_9$ |
| A-108 | —$CO_2C_6H_5$ | —$C_6H_{13}$ |
| A-109 | —$CO_2C_6H_5$ | —$C_{10}H_{21}$ |
| A-110 | —$CO_2C_6H_5$ | —$CH_2C_6H_5$ |
| A-111 | —$CO_2C_6H_5$ | —$(CH_2)_2C_6H_5$ |
| A-112 | —$CO_2C_6H_5$ | —$C_{12}H_{25}$ |
| A-113 | —$CO_2C_6H_5$ | —$C_{16}H_{33}$ |
| A-114 | —$CO_2C_6H_5$ | —$(CH_2)_2SO_2CH_3$ |
| A-115 | —$CO_2C_6H_5$ | —$(CH_2)_2SO_2NHCH_3$ |
| A-116 | —$CO_2C_6H_5$ | —$(CH_2)_2NHSO_2C_2H_5$ |
| A-117 | —$CO_2CH_3$ | —$CH_3$ |
| A-118 | —$CO_2CH_3$ | —$C_4H_9$ |
| A-119 | —$CO_2C_2H_5$ | —$C_6H_{13}$ |
| A-120 | —$CO_2C_2H_5$ | —$(CH_2)_2C_6H_5$ |
| A-121 | —$CO_2C_2H_5$ | —$C_{12}H_{25}$ |
| A-122 | —$CO_2C_{12}H_{25}$ | —$CH_3$ |
| A-123 | —$CO_2C_{12}H_{25}$ | —$C_4H_9$ |
| A-124 | —$CO_2C_{12}H_{25}$ | —$C_6H_{13}$ |
| A-125 | —$CO_2C_{12}H_{25}$ | —$(CH_2)_2C_6H_5$ |
| A-126 | —$CO_2C_{12}H_{25}$ | —$(CH_2)_2SO_2CH_3$ |
| A-127 | —$CO_2C_{12}H_{25}$ | —CH═$CHCH_3$ |
| A-128 | —$CO_2C_{12}H_{25}$ | —$CH_2CH$═$CH_2$ |
| A-129 | —$CO_2C_{12}H_{25}$ | —C≡$CCH_3$ |
| A-130 | —$CO_2C_{12}H_{25}$ | —C—$C_6H_{11}$ |
| A-131 | —$CO_2C_{12}H_{25}$ | —$C_6H_5$ |
| A-132 | —$SO_2CH_3$ | —$C_4H_9$ |
| A-133 | —$SO_2CH_3$ | —$C_6H_{13}$ |
| A-134 | —$SO_2CH_3$ | —$C_6H_5$ |
| A-135 | —$SO_2CH_3$ | —$CH_3$ |
| A-136 | —$SO_2CH_3$ | —$(CH_2)_2C_6H_5$ |
| A-137 | —$SO_2CH_3$ | —$CH_2C_6H_5$ |
| A-138 | —$SO_2C_6H_5$ | —$C_4H_9$ |
| A-139 | —$SO_2C_6H_5$ | —$C_6H_{13}$ |
| A-140 | —$SO_2C_6H_5$ | —$CH_3$ |
| A-141 | —$SO_2C_6H_5$ | —$(CH_2)_2C_6H_5$ |
| A-142 | —$SO_2C_6H_5$ | —$C_{12}H_{25}$ |
| A-143 | —$SO_2NHC_6H_5$ | —$C_6H_5$ |
| A-144 | —$SO_2NHCH_3$ | —$C_6H_5$ |
| A-145 | —$SO_2NHC_2H_5$ | —$C_6H_5$ |
| A-146 | —$SO_2NHC_6H_{13}$ | —$C_6H_5$ |
| A-147 | —$SO_2NHC_4H_9$ | —$C_6H_5$ |
| A-148 | —$SO_2NH$—t-$C_4H_9$ | —$C_6H_5$ |
| A-149 | —$SO_2NH$—t-$C_8H_{17}$ | —$C_6H_5$ |
| A-150 | —$SO_2NHC_6H_5$ | —$C_6H_{13}$ |
| A-151 | —$SO_2NHCH_3$ | —$C_6H_{13}$ |
| A-152 | —$SO_2NHC_2H_5$ | —$C_6H_{13}$ |
| A-153 | —$SO_2NHC_4H_9$ | —$C_6H_{13}$ |
| A-154 | —$SO_2NH$—t-$C_4H_9$ | —$C_6H_{13}$ |
| A-155 | —$SO_2NH$—t-$C_8H_{17}$ | —$C_6H_{13}$ |
| A-156 | —$SO_2NHC_6H_{13}$ | —$(CH_2)_2C_6H_5$ |
| A-157 | —$SO_2NHC_6H_5$ | —$(CH_2)_2C_6H_5$ |
| A-158 | —$SO_2NHCH_3$ | —$(CH_2)_2C_6H_5$ |
| A-159 | —$SO_2NH$—t-$C_8H_{17}$ | —$(CH_2)_2C_6H_5$ |

Next, the compounds represented by the following general formula (2) will be explained.

General formula (2)

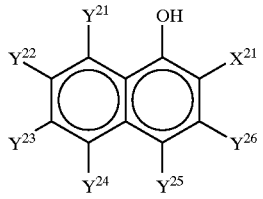

In the general formula (2), $X^{21}$ represents a group of —$NX^{31}X^{32}$. $X^{31}$ and $X^{32}$ each independently represents a hydrogen atom or a substituent.

In the general formula (2), the substituents represented by $X^{31}$ and $X^{32}$ may be any substituents which can be substituted with nitrogen atoms. Examples thereof include straight-chain, branched, cyclic or combined alkyl group (preferably having 1 to 20 carbon atoms, more preferably 1 to 16 carbon atoms, and still more preferably 1 to 13, and examples thereof include methyl, ethyl, n-propyl, isopropyl, sec-butyl, t-butyl, t-octyl, n-amyl, t-amyl, n-dodecyl, and n-tridecyl, cyclohexyl), alkenyl group (preferably having 2 to 20 carbon atoms, more preferably 2 to 16 carbon atoms, and still more preferably 2 to 12 carbon atoms, and examles thereof include vinyl, allyl, 2-butynyl, and 3-pentenyl), aryl group (preferably having 6 to 30 carbon atoms, more preferably 6 to 20, and still more preferably 6 to 12, and examples thereof include phenyl, P-methylphenyl, and naphthyl), alkoxy group (preferably having 1 to 20 carbon atoms, more preferably 1 to 16 carbon atoms, and still more preferably 1 to 12 carbon atoms, and examles thereof include methoxy, ethoxy, propoxy, and butoxy), aryloxy group (preferably having 6 to 30 carbon atoms, more preferably 6 to 20, and still more preferably 6 to 12, and examples thereof include phenyloxy and 2-naphthyloxy), carboxyl group, carbamoyl group (preferably having 1 to 20 carbon atoms, more preferably 1 to 16 carbon atoms, and still more preferably 1 to 12 carbon atoms, and examples thereof include carbamoyl, N,N-diethylcarbamoyl, N-dodecylcarbamoyl, and N-phenylcarbamoyl), alkoxycarbonyl group (preferably having 2 to 20 carbon atoms, more preferably 2 to 16 carbon atoms, and still more preferably 2 to 12 carbon atoms, and examples thereof include methoxycarbonyl, ethoxycarbonyl, and butoxycarbonyl), acyl group (preferably having 2 to 20 carbon atoms, more preferably 2 to 16 carbon atoms, and still more preferably 2 to 12 carbon atoms, and examples thereof include acetyl, benzoyl, formyl, and pivaroyl), sulfo group, sulfonyl group (preferably having 1 to 20 carbon atoms, more preferably 1 to 16 carbon atoms, and still more preferably 1 to 12 carbon atoms, and examples thereof include mesyl and tosyl), hydroxyl group, heterocycle group (preferably having 2 to 20 carbon atoms, more preferably 2 to 16 carbon atoms, and still more preferably 2 to 12 carbon atoms, and examples thereof include pyridyl, imidazoyl, and pyrrolidyl). These substituents may be further substituted with other substituents.

In the general formula (2), $X^{21}$ preferably represents acylamide group (e .g. acetamide, propionylamide, butyrylamide, valerylamino, hexanoylamide, myristylylamino, palmitoylamino, stearylamino, oleylamino, acryloylamino, cyclohexanecarboxyamide, benzoylamide, 2-chlorobenzoylamide, 4-chlorobenzoylamide, 2, 4-dichlorobenzoylamide, 3,4-dichlorobenzoylamide, 2-methoxybenzoylamide, 2-dodecyloxychlorobenzoylamide, 4-dodecyloxychlorobenzoylamino, formamide, pivaroylamino), sulfoamide group (e.g. methanesulfonylamide, ethanesulfonylamide, cyclohexanesulfonylamide, benzenesulfonylamide, toluenesulfonylamide, 4-chlorobenzenesulfonylamide), diacylamide group (e.g. diacetamide, dibenzamide), imide group (e.g. phthalimide, succinimide), or ureido group (e.g. N-methylureido, N,N-dime thylureido).

In the general formula (2), $Y^{21}$ to $Y^{26}$ each independently represents a hydrogen atom or a substituent. Examples of the substituents represented by $Y^{21}$ to $Y^{26}$ include the same substituents as those represented by $Y^1$ to $Y^5$ of the compound of the general formula (1). Preferred substituents represented by $Y^{21}$ to $Y^{26}$ are a halogen atom, an alkyl group, an aryl group, an alkoxy group, an aryloxy group, an acyloxy group, an anilino group, an acylamino group, a sulfonylamino group, a carboxyl group, a carbamoyl group, an acyl group, a sulfo group, a sulfonyl group, a sulfamoyl group, a cyano group, a hydroxyl group, a mercapto group, an alkylthio group, and a heterocycle group.

Next, specific examples of the compound represented by the general formula (2) are described, but the compounds used in the invention are not limited to these specific examples.

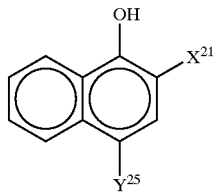

| Comp'd | $X^{21}$ | $Y^{25}$ |
|---|---|---|
| A-201 | —$NHCOCH_3$ | —H |
| A-202 | —$NHCOC_6H_5$ | —$OC_6H_5$ |
| A-203 | —$NHCOC_6H_5$ | —H |
| A-204 | —$NHCO(CH_2)_6CH_3$ | —$OC_6H_{13}$ |
| A-205 | —$NHCO(CH_2)_{12}CH_3$ | —H |
| A-206 | —$NHCOC_6H_5$ | —$CH_3$ |
| A-207 | —$NHCOC_6H_5$ | —Cl |
| A-208 | —$NHCOC_6H_5$ | —$O(CH_2)_2C_6H_5$ |
| A-209 | 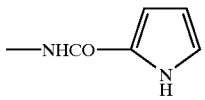 | —$O(CH_2)_5CH_3$ |
| A-210 | 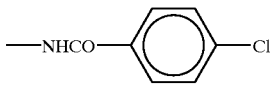 | —$O(CH_2)_5CH_3$ |

-continued

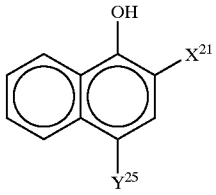

| Comp'd | $X^{21}$ | $Y^{25}$ |
|---|---|---|
| A-211 | 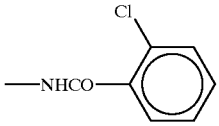 | —$O(CH_2)_5CH_3$ |
| A-212 | —$N(COCH_3)_2$ | —$O(CH_2)_2C_6H_5$ |
| A-213 | —$N(COC_6H_{13})_2$ | —$O(CH_2)_2C_6H_5$ |
| A-214 | —$N(COC_6H_5)_2$ | —$O(CH_2)_2C_6H_5$ |
| A-215 | 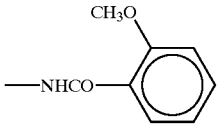 | —H |
| A-216 | —$NHCOC_6H_5$ | —H |
| A-217 | —$NHCONH_2$ | —$OC_6H_{13}$ |
| A-218 | —$NHCONHCH_3$ | —$OC_{10}H_{21}$ |
| A-219 | —$NHCON(C_2H_5)_2$ | —$OC_6H_{13}$ |
| A-220 | 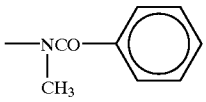 | —$OC_6H_{13}$ |
| A-221 | 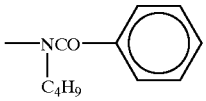 | —$OC_6H_{13}$ |
| A-222 | 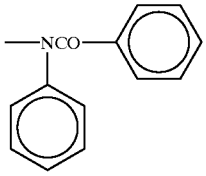 | —$OC_6H_{13}$ |
| A-223 | 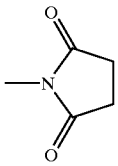 | —$OC_6H_{13}$ |
| A-224 | 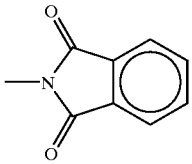 | —$OC_6H_{13}$ |
| A-225 | —$NHCOC_9H_{19}$ | —$OC_6H_{13}$ |
| A-226 | —$NHCOC_{11}H_{23}$ | —$OC_6H_{13}$ |
| A-227 | —$NHCOC_{15}H_{31}$ | —$OC_6H_{13}$ |
| A-228 | —$NHCOCH_2C_6H_5$ | —$OC_6H_{13}$ |
| A-229 | —NHCO-t-$C_4H_9$ | —$OC_6H_{13}$ |

-continued

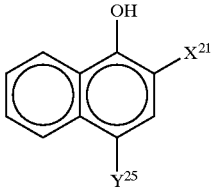

| Comp'd | $X^{21}$ | $Y^{25}$ |
|---|---|---|
| A-230 | —$NHSO_2CH_3$ | —H |
| A-231 | —$NHSO_2C_2H_5$ | —H |
| A-232 | —$NHSO_2C_2H_5$ | —$OC_6H_{13}$ |
| A-233 | —$NHSO_2CH_3$ | —$OC_6H_{13}$ |
| A-234 | —$NHSO_2C_6H_5$ | —$OC_6H_{13}$ |
| A-235 | —$NHSO_2C_6H_5$ | —H |
| A-236 | —$NHSO_2C_6H_5$ | —$OCH_2C_6H_5$ |
| A-237 | —$NHSO_2C_6H_5$ | —$O(CH_2)_2C_6H_5$ |
| A-238 | 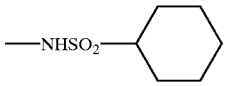 | —$O(CH_2)_2C_6H_5$ |
| A-239 | 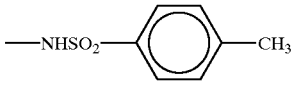 | —$O(CH_2)_2C_6H_5$ |
| A-240 | 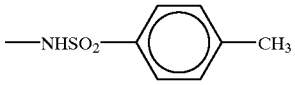 | —$OC_6H_{13}$ |
| A-241 | 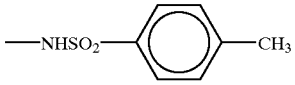 | —$OC_6H_5$ |
| A-242 | 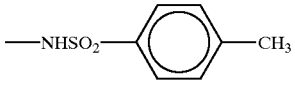 | —H |
| A-243 | 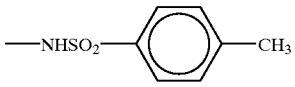 | —Cl |
| A-244 | 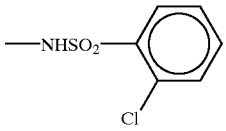 | —$OC_6H_{13}$ |
| A-245 | 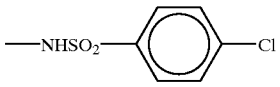 | —$OC_6H_{13}$ |
| A-246 | 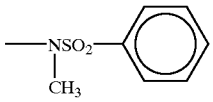 | —$OC_6H_{13}$ |
| A-247 | 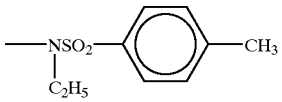 | —$OC_6H_{13}$ |

-continued

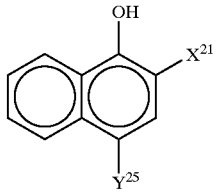

| Comp'd | $X^{21}$ | $Y^{25}$ |
|---|---|---|
| A-248 | 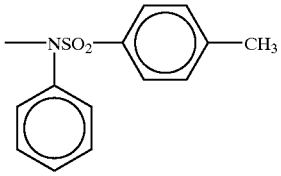 | $—OC_6H_{13}$ |
| A-249 | 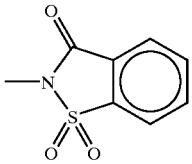 | $—OC_6H_{13}$ |
| A-250 | 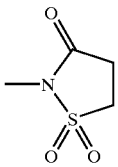 | $—OC_6H_{13}$ |
| A-251 | $—N(C_2H_5)_2$ | $—OC_6H_{13}$ |
| A-252 | $—N(C_6H_{13})_2$ | $—OC_6H_{13}$ |
| A-253 | $—NHSO_2NHC_6H_5$ | $—OC_6H_{13}$ |
| A-254 | $—NHSO_2NHC_2H_5$ | $—OC_6H_{13}$ |
| A-255 | $—NHCOC_6H_5$ | 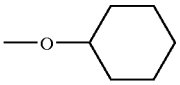 |
| A-256 | $—NHCOC_6H_5$ | $—OCH_2C_6H_5$ |
| A-257 | $—NHCOC_6H_5$ | $—OC_4H_9$ |
| A-258 | $—NHCONHC_6H_5$ | $—OC_6H_{13}$ |

The compound represented by the general formula (1) or (2) can easily be synthesized by the method publicly known in the photographic field.

The compound represented by the general formula (1) or (2) can be used as a solution prepared by dissolving in water or a proper organic solvent, for example, alcohols (e.g. methanol, ethanol, propanol, fluorinated alcohol), ketones (e.g. acetone, methyl ethyl ketone), dimethylformamide, dimethyl sulfoxide, or methyl cellosolve.

Alternatively, the compound may also be used as an emulsified dispersion mechanically prepared according to an already well known emulsification dispersion method by using an oil such as dibutyl phthalate, tricresyl phosphate, glyceryl triacetate or diethyl phthalate, ethyl acetate or cyclohexanone as an auxiliary solvent for dissolution. Alternatively, the compound may be used after dispersion of a powder of the compound in a proper solvent such as water by using a ball mill, a colloid mill, a sand grinder mil, MANTON GAULIN, a microfluidizer, or by means of ultrasonic wave according to a known method for solid dispersion.

The compound represented by the formula (1) or (2) may be added to any layers on a substrate provided on the same surface as layers containing the aforementioned photosensitive silver halide and the reducible silver salt are present. However, it is preferably added to a layer containing the silver halide or a layer adjacent thereto.

The additive amount of the compound represented by the general formula (1) or (2) is preferably within a range from 0.2 to 20 mmol, more preferably from 0.3 to 100 mmol, and still more preferably from 0.5 to 30 mmol, per mol of silver. These compounds represented by the general formula (1) or (2) may be used individually or as a blend of two or more thereof.

Next, the compound represented by the general formula (3) will be explained.

General formula (3)

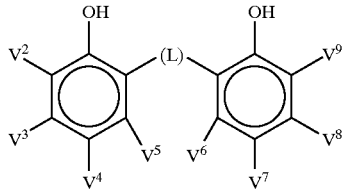

In the general formula (3), $V^2$ to $V^9$ each independently represents a hydrogen atom or a substituent. The substituents represented by $V^2$ to $V^9$ may be the same or different and preferred examples thereof include halogen atom (e.g. fluorine atom, chlorine atom, bromine atom, iodine atom), straight-chain, branched, cyclic or combined alkyl group (preferably having 1 to 20 carbon atoms, more preferably 1 to 16 carbon atoms, and still more preferably 1 to 13 carbon atoms, and examples thereof include methyl, ethyl, n-propyl, isopropyl, sec-butyl, t-butyl, t-octyl, n-amyl, t-amyl, n-dodecyl, n-tridecyl, and cyclohexyl), alkenyl group (preferably having 2 to 20 carbon atoms, more preferably 2 to 16 carbon atoms, and still more preferably 2 to 12 carbon atoms, and examples thereof include vinyl, allyl, 2-butenyl, and 3-pentenyl), aryl group (preferably having 6 to 30 carbon atoms, more preferably 6 to 20, and still more preferably 6 to 12, and examples thereof include phenyl, p-methylphenyl, and naphthyl), alkoxy group (preferably having 1 to 20 carbon atoms, more preferably 1 to 16 carbon atoms, and still more preferably 1 to 12 carbon atoms, and examples thereof include methoxy, ethoxy, propoxy, and butoxy), aryloxy group (preferably having 6 to 30 carbon atoms, more preferably 6 to 20, and still more preferably 6 to 12, and examples thereof include phenyloxy and 2-naphthyloxy), acyloxy group (preferably having 2 to 20 carbon atoms, more preferably 2 to 16 carbon atoms, and still more preferably 2 to 12 carbon atoms, and examples thereof include acetoxy and benzoyloxy), amino group (preferably having 0 to 20 carbon atoms, more preferably 1 to 16 carbon atoms, and still more preferably 1 to 12 carbon atoms, and examples thereof include dimethylamino group, diethylamino group, dibutylamino group, and anilino group), acylamino group (preferably having 2 to 20 carbon atoms, more preferably 2 to 16 carbon atoms, and still more preferably 2 to 13, and examples thereof include acetylamino, tridecanoylamino, and benzoylamino), sulfonylamino group (preferably having 1 to 20 carbon atoms, more preferably 1 to 16 carbon atoms, and still more preferably 1 to 12 carbon atoms, and examples thereof include methanesulfonylamino, butanesulfonylamino, and benzenesulfonylamino), ureido group (preferably 1 to 20 carbon atoms, more preferably 1 to 16 carbon atoms, and still more preferably 1 to 12 carbon atoms, and examples thereof include ureido, methylureido, and phenylureido), carbamate group (preferably having 2 to 20 carbon atoms, more preferably 2 to 16 carbon atoms, and still more preferably 2 to 12 carbon atoms, and examples thereof include methoxycarbonylamino and phenyloxycarbonylamino), carboxyl group, carbamoyl group (preferably having 1 to 20 carbon atoms, more preferably 1 to 16 carbon atoms, and still more preferably 1 to 12 carbon atoms, and examples thereof include carbamoyl, N,N-diethylcarbamoyl, N-dodecylcarbamoyl, and N-phenylcarbamoyl), alkoxycarbonyl group (preferably having 2 to 20 carbon atoms, more preferably 2 to 16 carbon atoms, and still more preferably 2 to 12 carbon atoms, and examples thereof include methoxycarbonyl, ethoxycarbonyl, and butoxycarbonyl), acyl group (preferably having 2 to 20 carbon atoms, more preferably 2 to 16 carbon atoms, and still more preferably 2 to 12 carbon atoms, and examples thereof include acetyl, benzoyl, formyl, and pivaroyl), sulfo group, sulfonyl group (preferably having 1 to 20 carbon atoms, more preferably 1 to 16 carbon atoms, and still more preferably 1 to 12 carbon atoms, and examples thereof include mesyl, and tosyl), sulfamoyl group (preferably having 0 to 20 carbon atoms, more preferably 0 to 16, and still more preferably 0 to 12, and examples thereof include sulfamoyl, methylsulfamoyl, dimethylsulfamoyl, and phenylsulfamoyl), cyano group, nitro group, hydroxyl group, mercapto group, alkylthio group (preferably having 1 to 20 carbon atoms, more preferably 1 to 16 carbon atoms, and still more preferably 1 to 12 carbon atoms, and examples thereof include methylthio and butylthio), and heterocycle group (preferably having 2 to 20 carbon atoms, more preferably 2 to 16 carbon atoms, and still more preferably 2 to 12 carbon atoms, and examples thereof include pyridyl, imidazoyl, and pyrrolidyl). These substituents may be further substituted with other substituents.

Particularly preferred substituents represented by $V^2$ to $V^9$ are alkyl groups (e.g. methyl, ethyl, n-propyl, isopropyl, sec-butyl, t-butyl, t-octyl, n-amyl, t-amyl, n-dodecyl, n-tridecyl, and cyclohexyl).

In the general formula (3), L represents a linking group of —CH($V^{10}$)— or —S—, and $V^{10}$ represents a hydrogen atom or a substituent. Preferred examples of the substituent represented by $V^{10}$ include halogen atom (e.g. fluorine atom, chlorine atom, bromine atom, or iodine atom), straight-chain, branched, cyclic or combined alkyl group (preferably having 1 to 20 carbon atoms, more preferably 1 to 16 carbon atoms, and still more preferably 1 to 13, and examples thereof include methyl, ethyl, n-propyl, isopropyl, sec-butyl, t-butyl, t-octyl, n-amyl, t-amyl, n-dodecyl, n-tridecyl, cyclohexyl, and 2,4,4-methylpentyl), alkenyl group (preferably having 2 to 20 carbon atoms, more preferably 2 to 16 carbon atoms, and still more preferably 2 to 12 carbon atoms, and examples thereof include vinyl, allyl, 2-butenyl, and 3-pentenyl), aryl group (preferably having 6 to 30 carbon atoms, more preferably 6 to 20, and still more preferably 6 to 12, and examples thereof include phenyl, p-methylphenyl, and naphthyl), alkoxy group (preferably having 1 to 20 carbon atoms, more preferably 1 to 16 carbon atoms, and still more preferably 1 to 12 carbon atoms, and examples thereof include methoxy, ethoxy, propoxy, and butoxy), aryloxy group (preferably having 6 to 30 carbon atoms, more preferably 6 to 20, and still more preferably 6 to 12, and examples thereof include phenyloxy and 2-naphthyloxy), acyloxy group (preferably having 2 to 20 carbon atoms, more preferably 2 to 16 carbon atoms, and still more preferably 2 to 12 carbon atoms, and examples thereof include acetoxy and benzoyloxy), amino group (preferably having 0 to 20 carbon atoms, more preferably 1 to 16 carbon atoms, and still more preferably 1 to 12 carbon atoms, and examples thereof include dimethylamino group, diethylamino group, dibutylamino group, and anilino group), acylamino group (preferably having 2 to 20 carbon atoms, more preferably 2 to 16 carbon atoms, and still more preferably 2 to 13, and examples thereof include acetylamino, tridecanoylamino, and benzoylamino), sulfonylamino group (preferably having 1 to 20 carbon atoms, more preferably 1 to 16 carbon atoms, and still more preferably 1 to 12 carbon atoms, and examples thereof include methanesulfonylamino, butanesulfonylamino, and benzenesulfonylamino), ureido group (preferably having 1 to 20 carbon atoms, more preferably 1 to 16 carbon atoms, and still more preferably 1 to 12 carbon atoms, and examples thereof include ureido, methylureido, and phenylureido), carbamate group (preferably having 2 to 20 carbon atoms, more preferably 2 to 16 carbon atoms, and still more preferably 2 to 12 carbon atoms, and examples thereof include methoxycarbonylamino, and phenyloxycarbonylamino), carboxyl group, carbamoyl group (preferably having 1 to 20 carbon atoms, more preferably 1 to 16 carbon atoms, and still more preferably 1 to 12 carbon atoms, and examples thereof include carbamoyl, N,N-diethylcarbamoyl, N-dodecylcarbamoyl, and N-phenylcarbamoyl), alkoxycarbonyl group (preferably having 2 to 20 carbon atoms, more preferably 2 to 16 carbon atoms, and still more preferably 2 to 12 carbon atoms, and examples theref include methoxycarbonyl, ethoxycarbonyl, and butoxycarbonyl), acyl group (preferably having 2 to 20 carbon atoms, more preferably 2 to 16 carbon atoms, and still more preferably 2 to 12 carbon atoms, and examples thereof include acetyl, benzoyl, formyl, and pivaroyl), sulfo group, sulfonyl group (preferably having 1 to 20 carbon atoms, more preferably 1 to 16 carbon atoms, and still more preferably 1 to 12 carbon atoms, and examples thereof include mesyl and tosyl), sulfamoyl group (preferably having 0 to 20 carbon atoms, more preferably 0 to 16, and still more preferably 0 to 12, and examples thereof include sulfamoyl, methylsulfamoyl, dimethylsulfamoyl, and phenylsulfamoyl), cyano group, nitro group, hydroxyl group, mercapto group, alkylthio group (preferably having 1 to 20 carbon atoms, more preferably 1 to 16 carbon atoms, and still more preferably 1 to 12 carbon atoms, and examples thereof include methylthio and butylthio), and heterocycle group (preferably having 2 to 20 carbon atoms, more preferably 2 to 16 carbon atoms, and still more preferably 2 to 12 carbon atoms, and examples thereof include pyridyl, imidazoyl, and pyrrolidyl). These substituents may be further substituted with other substituents.

Particularly preferred examples of the substituent represented by $V^{10}$ include alkyl group (e.g. methyl, ethyl, n-propyl, isopropyl, sec-butyl, t-butyl, t-octyl, n-amyl, n-octyl, t-amyl, n-dodecyl, n-tridecyl, cyclohexyl, or 2,4,4-trimethylpentyl), alkenyl group (e.g. vinyl, allyl, 2-butenyl, or 3-pentenyl), aryl group (e.g. phenyl, P-methylphenyl, or naphthyl), hydroxyl group, mercapto group, and alkylthio group (e.g. methylthio or butylthio).

Next, specific examples of the compound represented by the general formula (3) are described, but the compounds used in the invention are not limited to these specific examples.

(I-1)

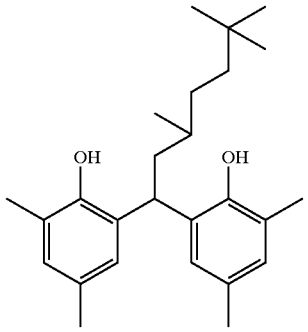

(I-2)

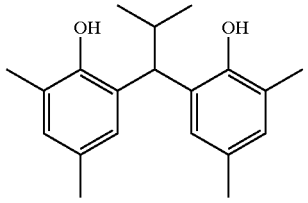

(I-3)

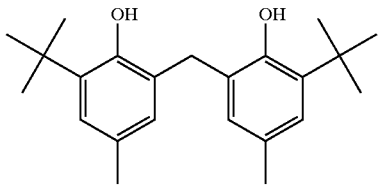

(I-4)

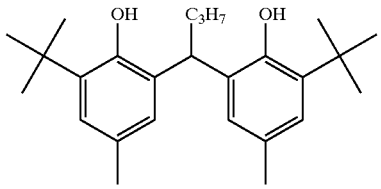

(I-5)

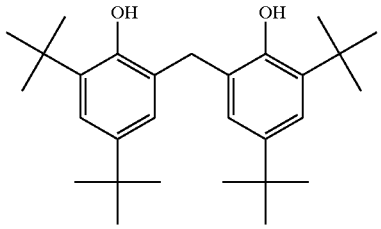

-continued (I-6)

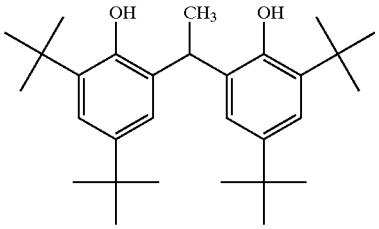

(I-7)

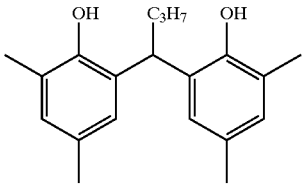

(I-8)

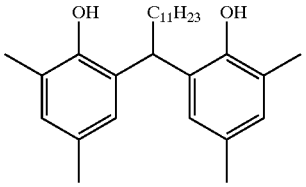

(I-9)

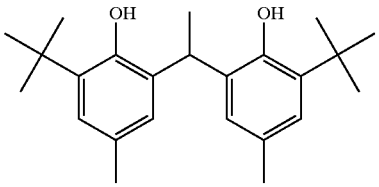

(I-10)

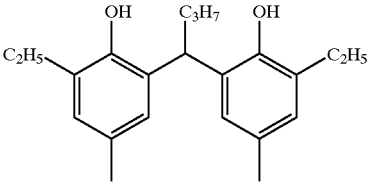

(I-11)

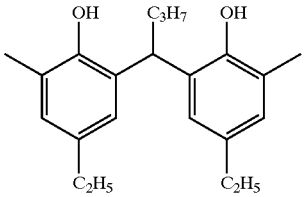

(I-12)

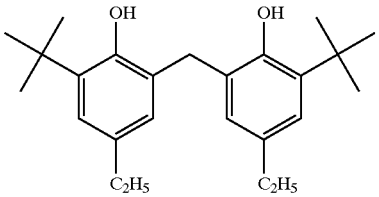

(I-13)

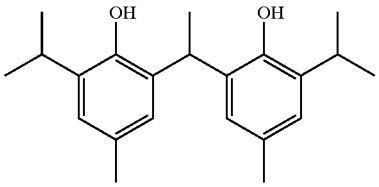

-continued
(I-14)
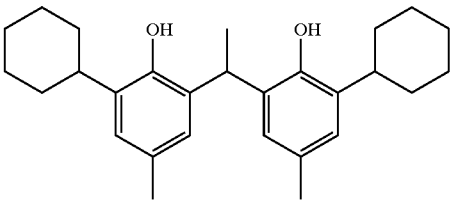
(I-15)
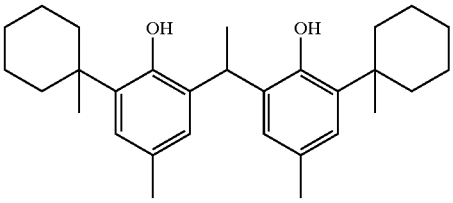
(I-16)
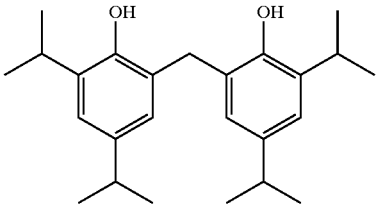
(I-17)
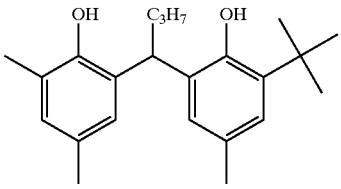
(I-18)
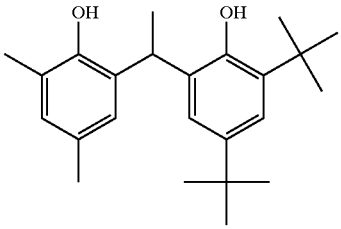
(I-19)
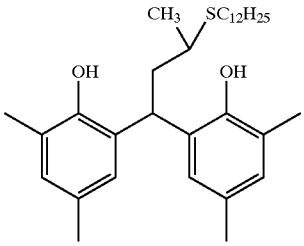
(I-20)
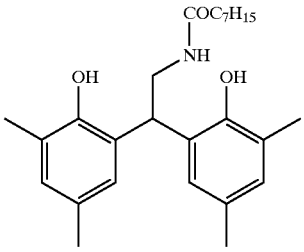
-continued
(I-21)
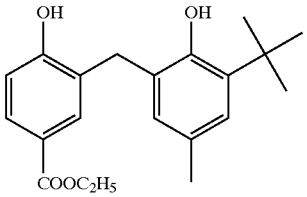
(I-22)
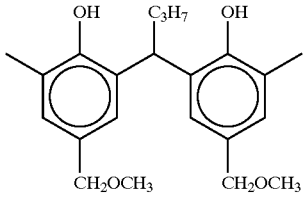
(I-23)
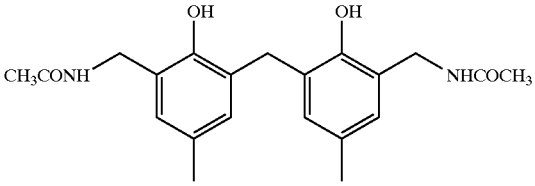
(I-24)
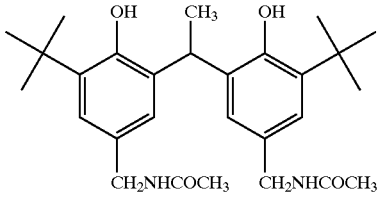
(I-25)
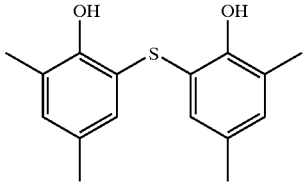
(I-26)
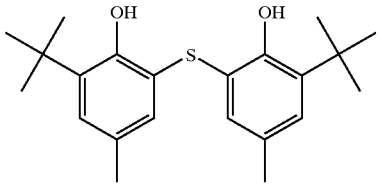
(I-27)
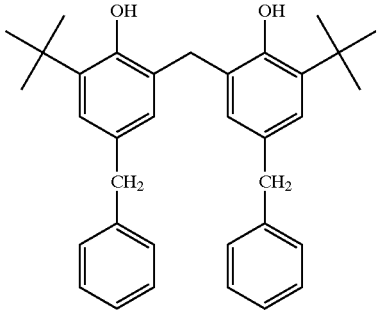

-continued (I-28)

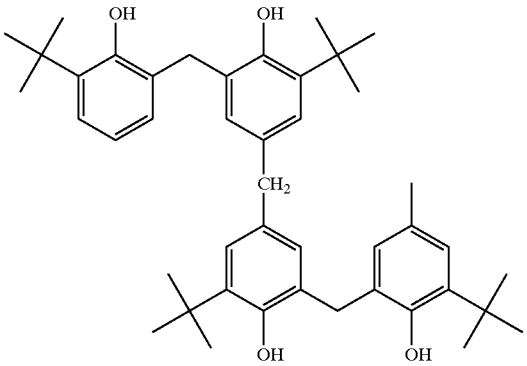

(I-29)

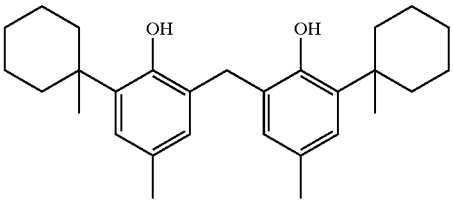

(I-30)

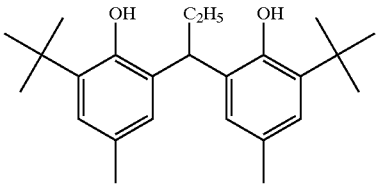

(I-31)

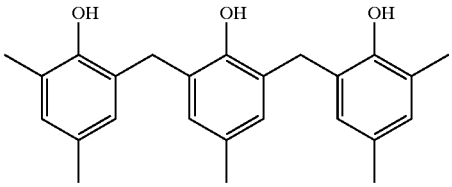

(I-32)

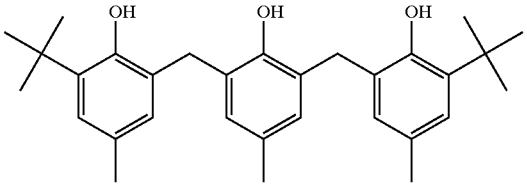

(I-33)

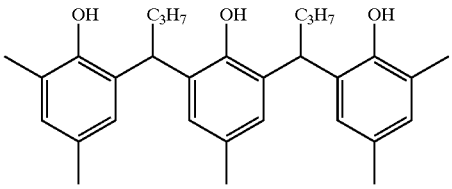

(I-34)

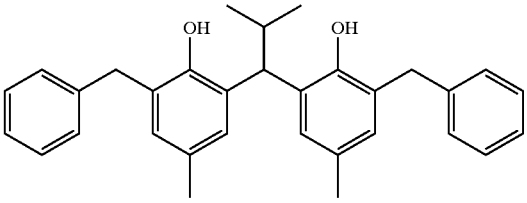

-continued (I-35)

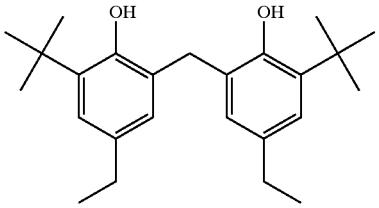

(I-36)

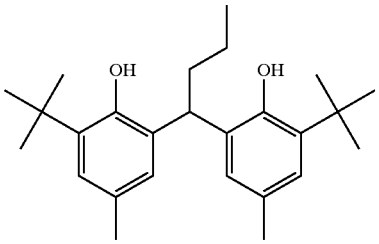

The compound represented by the general formula (3) may be added in any form of solution, powder or slid fine grain dispersion. Dispersion of the solid microparticle is effected using a known pulverizing means (e.g. ball mill, vibrating ball mill, sand mill, colloid mill, jet mill and roller mill). A dispersion aid may be available for dispersing the solid microparticle.

The compound represented by the general formula (3) may be added to any layers on a substrate provided on the same surface as layers containing the aforementioned photosensitive silver halide and the reducible silver salt are present. However, it is preferably added to a layer containing the silver halide or a layer adjacent thereto.

The compounds represented by general formulae (5) to (7) will be explained.

Next, the compound represented by the general formula (5) will be explained.

$Q^1$-NHNH—$V^1$ General formula (5)

In the general formula (5), $Q^1$ represents a 5- to 7-membered unsaturated ring linked with NHNH—$V^1$ through a carbon atom, and $V^1$ represents a carbamoyl group, an acyl group, an alkoxycarbonyl group, an aryloxycarbonyl group, a sulfonyl group or a sulfamoyl group.

In the general formula (5), preferred examples of the 5- to 7-membered unsaturated ring represented by $Q^1$ include benzene ring, pyridine ring, pyrazine ring, pyrimidine ring, pyridazine ring, 1,2,4-triazine ring, 1,3,5-triazine ring, pyrrole ring, imidazole ring, pyrazole ring, 1,2,3-triazole ring, 1,2,4-triazole ring, tetrazole ring, 1,3,4-thiadiazole ring, 1,2,4-thiadiazole ring, 1,2,5-thiadiazole ring, 1,3,4-oxadiazole ring, 1,2,4-oxadiazole ring, 1,2,5-oxadiazole ring, thiazole ring, oxazole ring, isothiazole ring, isoxazole ring, and thiophene ring, and condensed rings of these rings are also preferred.

These rings may have a substituent. When these rings having two or more substituents, these substituents may be the same or different. Examples of the substituent include halogen atom, alkyl group, aryl group, carbonamide group, alkylsulfoamide group, arylsulfoamide group, alkoxy group, aryloxy group, alkylthio group, arylthio group, carbamoyl group, sulfamoyl group, cyano group, alkylsulfonyl group, arylsulfonyl group, alkoxycarbonyl group, aryloxycarbonyl group, and acyl group. When these substituents are substitutable groups, they may further have a substituent. Preferred examples of the substituent include halogen atom, alkyl group, aryl group, carbonamide group, alkylsulfoamide group, arylsulfoamide group, alkoxy group, aryloxy group, alkylthio group, arylthio group, acyl group, alkoxycarbonyl group, aryloxycarbonyl group, carbamoyl group, cyano group, sulfamoyl group, alkylsulfonyl group, arylsulfonyl group, and acyloxy group.

In the general formula (5), the carbamoyl group represented by $V^1$ preferably has 1 to 50 carbon atoms, more preferably 2 to 40 carbon atoms, and particularly preferably 2 to 11 carbon atoms, and examples thereof include non-substituted carbamoyl, methylcarbamoyl, N-ethylcarbamoyl, N-propylcarbamoyl, N-sec-butylcarbamoyl, N-octylcarbamoyl, N-cyclohexylcarbamoyl, N-tert-butylcarbamoyl, N-dodecylcarbamoyl, N-(3-dodecyloxypropyl)carbamoyl, N-octadecylcarbamoyl, N-{3-(2,4-tert-pentylphenoxy) propyl}carbamoyl, N-(2-hexyldecyl)carbamoyl, N-phenylcarbamoyl, N-(4-dodecyloxyphenyl)carbamoyl, N-(2-chloro-5-dodecyloxycarbonylphenyl)carbamoyl, N-naphthylcarbamoyl, N-3-pyridylcarbamoyl, and N-benzylcarbamoyl.

The acyl group represented by $V^1$ preferably has 1 to 50 carbon atoms, and more preferably 6 to 40 carbon atoms, and examples thereof include formyl, acetyl, 2-methylpropanoyl, cyclohexylcarbonyl, octanoyl, 2-hexyldecanoyl, dodecanoyl, chloroacetyl, trifluoroacetyl, benzoyl, 4-dodecyloxybenzoyl, and 2-hydroxymethylbenzoyl.

The alkoxycarbonyl group represented by $V^1$ preferably has 2 to 50 carbon atoms, and more preferably 6 to 40, and examples thereof include methoxycarbonyl, ethoxycarbonyl, isobutyloxycarbonyl, cyclohexyloxycarbonyl, dodecyloxycarbonyl, and benzyloxycarbonyl.

The aryloxycarbonyl group represented by $V^1$ preferably has 7 to 50 carbon atoms, and more preferably 7 to 40 carbon atoms, and examples thereof incldue phenoxycarbonyl, 4-octyloxyphenoxycarbonyl, 2-hydroxymethylphenoxycarbonyl, and 4-dodecyloxyphenoxycarbonyl.

The sulfonyl group represented by $V^1$ preferably has 1 to 50 carbon atoms, and more preferably 6 to 40 carbon atoms, and examples thereof include methylsulfonyl, butylsulfonyl, octylsulfonyl, 2-hexadecylsulfonyl, 3-dodecyloxypropylsulfonyl, 2-octyloxy-5-tert-octylphenylsulfonyl, and 4-dodecyloxyphenylsulfonyl.

The sulfamoyl group represented by $V^1$ preferably has 0 to 50 carbon atoms, and more preferably 6 to 40 carbon atoms, and examples thereof include non-substituted sulfamoyl, N-ethylsulfamoyl group, N-(2-ethylhexyl) sulfamoyl, N-decylsulfamoyl, N-hexadecylsulfamoyl, N-{3-(2-ethylhexyloxy)propyl}sulfamoyl, N-(2-chloro-5-dodecyloxycarbonylphenyl)sulfamoyl, and N-(2-tetradecyloxyphenyl) sulfamoyl.

In the general formula (5), the group represented by $V^1$ may have a group described as the example of the substituent of the 5- to 7-membered unsaturated ring represented by $Q^1$ at the substitutable position. When the group having two or more substituents, the substituents may be the same or different.

In the general formula (5), $Q^1$ preferably a 5- to 7-membered heterocycle linked with NHNH—$V^1$ through a carbon atom, or a substituted phenyl group wherein the sum of Hammett substituent constant σp values of the substituents on the ring is 1.6 or more, more preferably a substituted phenyl group wherein the sum of Hammett substituent constant σp values of the substituents on the ring is 1.6 or more, a quinazoline ring (group), a pyrimidine ring (group), a 1,2,3-triazole ring (group), a 1,2,4-triazole ring (group), a tetrazole ring (group), a 1,3,4-thiadiazole ring (group), a 1,2,4-thiadiazole ring (group), a 1,3,4-oxadiazole ring (group), a 1,2,4-oxadiazole ring (group), a thiazole ring (group), an oxazole ring (group), an isothiazole ring (group), an isoxazole ring (group), or a ring condensed with an unsaturated heterocycle (group), and still more preferably a quinazoline ring, or a bezene ring wherein the sum of Hammett substituent constant σp values of the substituents on the ring is 1.6 or more. Among these, a quinazoline ring is particularly preferred.

More preferably, $Q^1$ has at least one electron attractive group and examples of preferred substituent include fluoroalkyl group (e.g. trifluoromethyl group, pentafluoroethyl group, 1,1-difluoroethyl group, difluoromethyl group, fluoromethyl group, heptafluoropropyl group, or pentafluorophenyl group), cyano group, halogen atom (e g. fluoro, chloro, bromo, or iodo), acyl group, alkoxycarbonyl group, carbamoyl group, alkylsulfonyl group (e.g. methanesulfonyl group, ethanesulfonyl group, or propanesulfonyl group), arylsulfonyl group (e.g. benzenesulfonyl group, P-toluenesulfonyl group, or 4-(methanesulfonylamino) phenylsulfonyl group), and nitro group. Particularly preferred substituent is a trifluoromethyl group.

When $Q^1$ is a substituted benzene ring, preferred examples of the benzene ring wherein the sum of Hammett substituent constant σp values of the substituents on the ring is 1.6 or more include 3,4-dicyano-6-(propanesulfonyl) phenyl group, 3,4-dicyano-6-(methanesulfonyl)phenyl group, 3,4,6-tri(methanesulfonyl)phenyl group, and 3,4-dicyano-6-(4-(methanesulfonylamino)phenyl)sulfonyl) group.

In the general formula (5), $V^1$ is preferably a carbamoyl group. Particularly preferably, $V^1$ is a substituted carbamoyl group represented by —C═O—NH—$V^{21}$ and $V^{21}$ represents an alkyl or aryl group having 1 to 10 carbon atoms.

The reason why $Q^1$ is preferably a 5- to 7-membered heterocycle linked with NHNH—$V^1$ through a carbon atom, or a substituted phenyl group wherein the sum of Hammett substituent constant σp values of the substituents on the ring is 1.6 or more in the general formula (5) is not clear. However, it is known that the reducing power of a reducible compound generally increases as the acid dissociation equilibrium constant becomes smaller. Preferably, $Q^1$ is a 5- to 7-membered unsaturated ring linked with NHNH—$V^1$ through a carbon atom, and more preferably a 5- to 7-membered heterocycle linked with NHNH—$V^1$ through a carbon atom, or a substituted phenyl group wherein the sum of Hammett substituent constant σp values of the substituents on the ring is 1.6 or more.

Next, specific examples of the compound represented by the general formula (5) are described, but the compounds used in the invention are not limited to these specific examples.
D-101
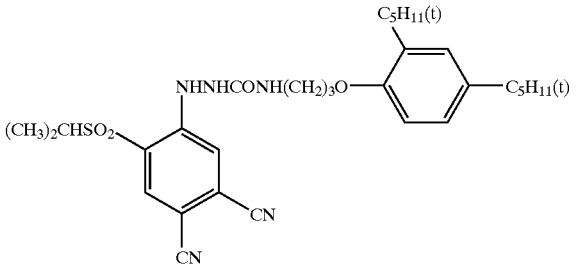
D-102
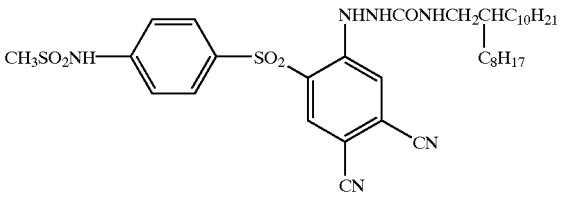
D-103
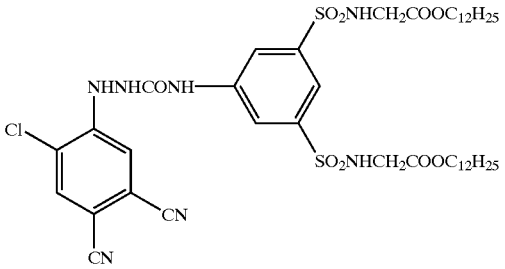
D-104
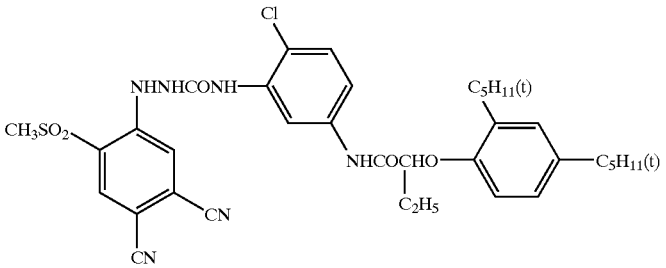
D-105
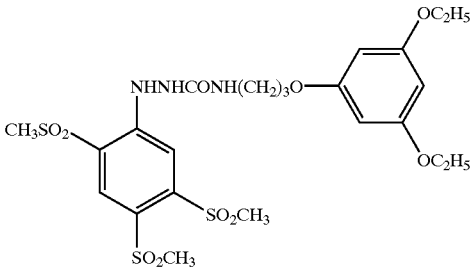

-continued
D-106
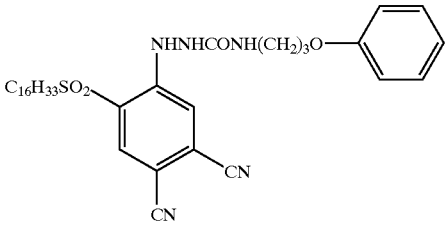
D-107
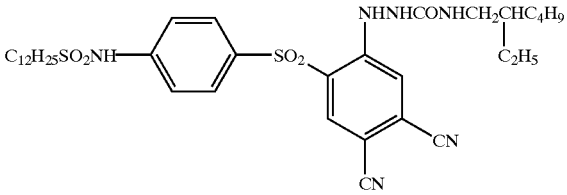
D-108
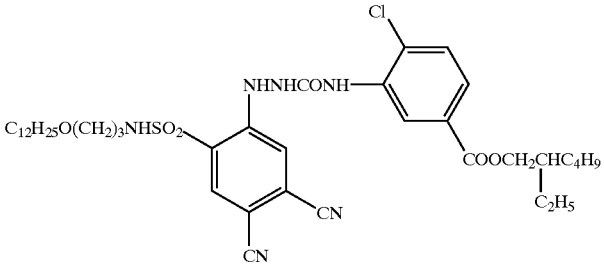
D-109
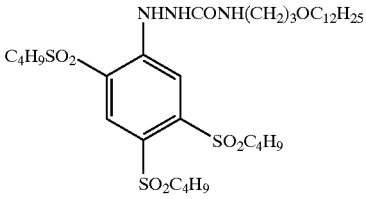
D-110
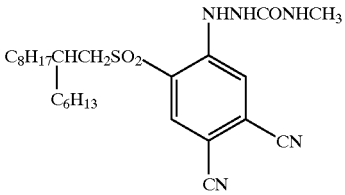
D-111
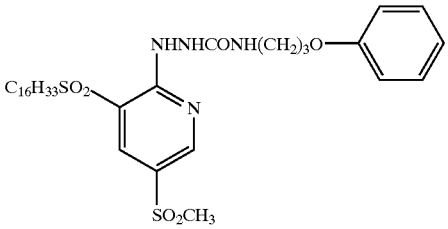
D-112
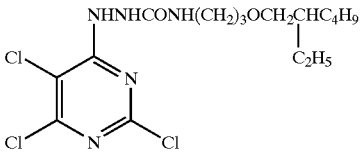

-continued
D-113
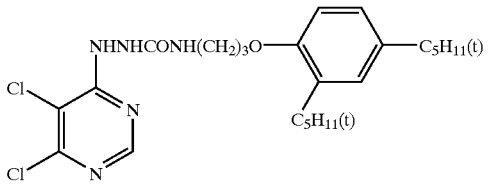
D-114
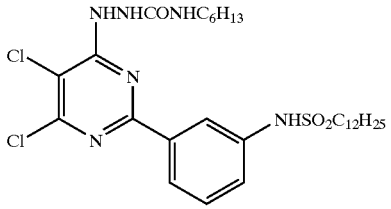
D-115
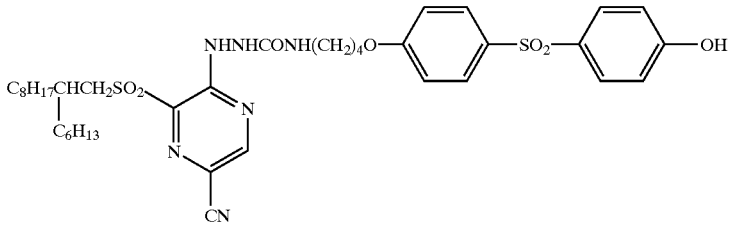
D-116
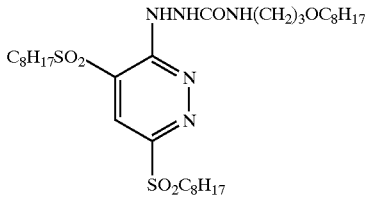
D-117
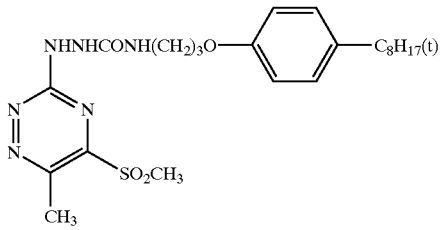
D-118
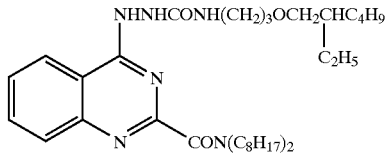
D-119
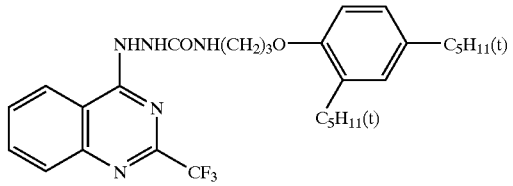

-continued
D-120
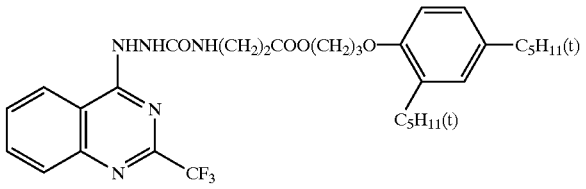
D-121
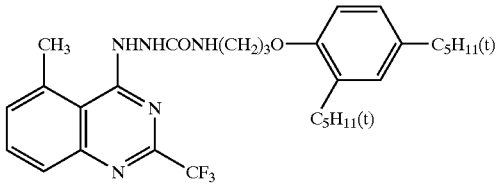
D-122
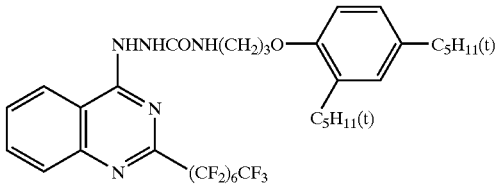
D-123
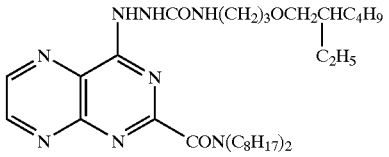
D-124
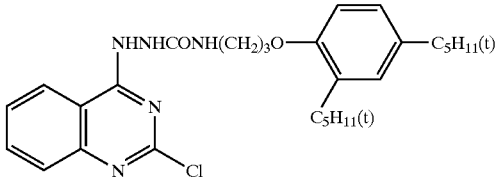
D-125
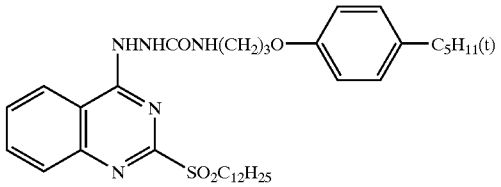
D-126
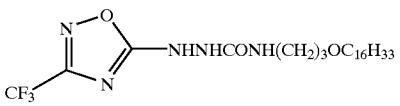
D-127
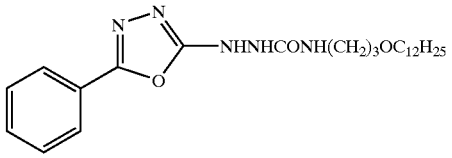
D-128
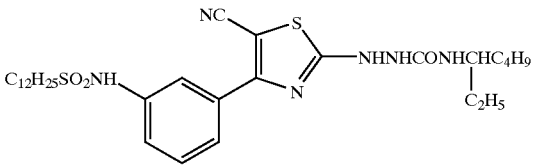

-continued
D-129
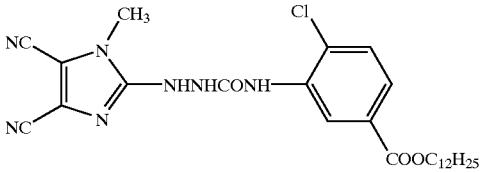
D-130
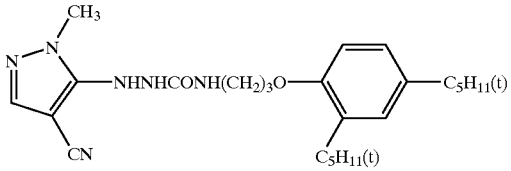
D-131
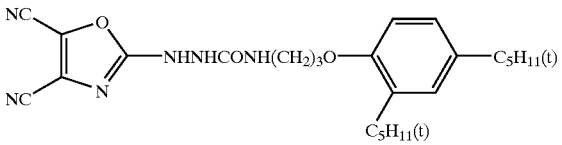
D-132
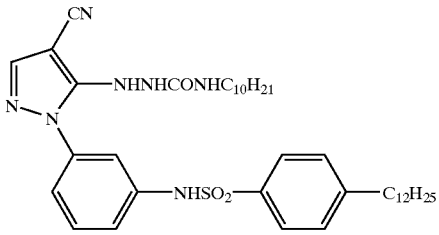
D-133
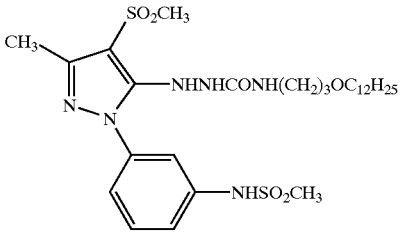
D-134
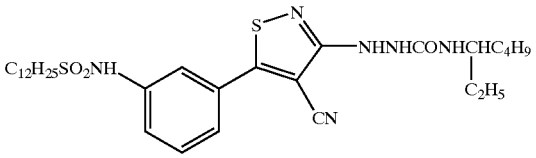
D-135
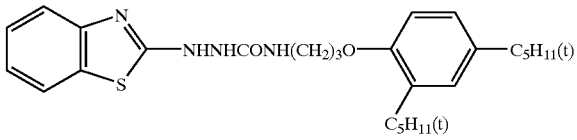
D-136
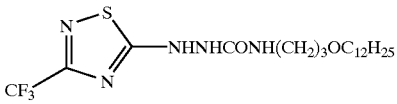

-continued
D-137
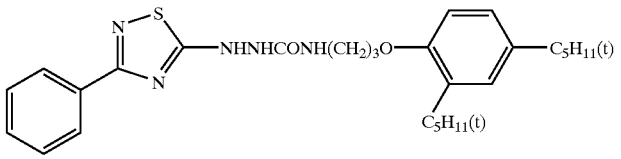
D-138
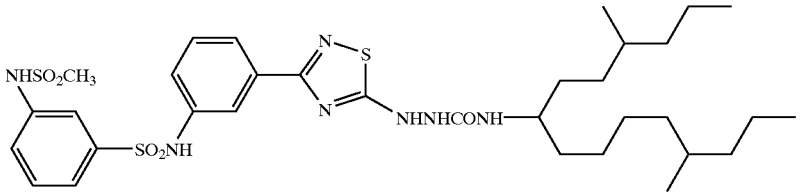
D-139
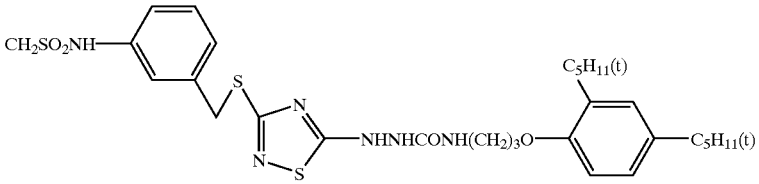
D-140
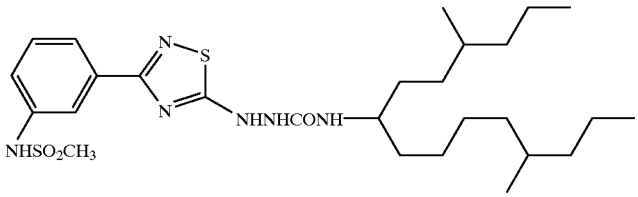
D-141
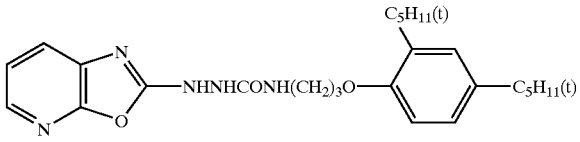
D-142
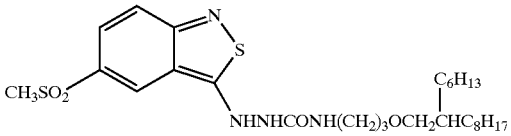
D-143
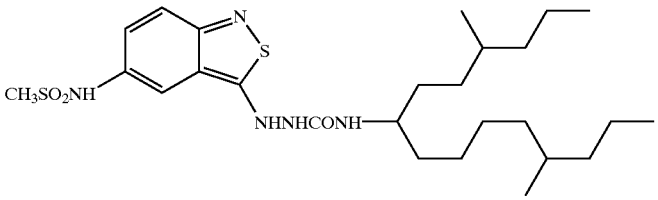
D-144
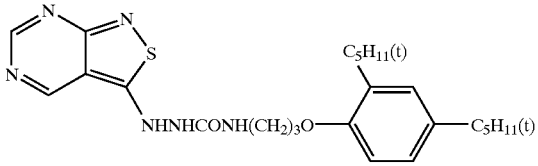

-continued
D-145
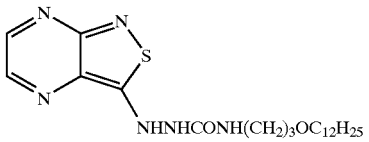
D-146
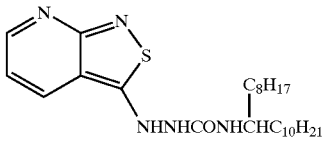
D-147
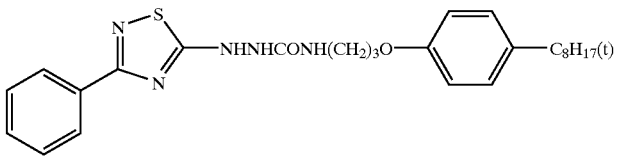
D-148
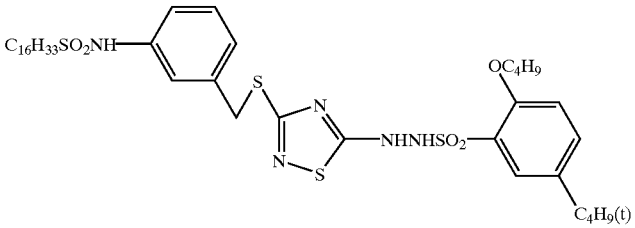
D-149
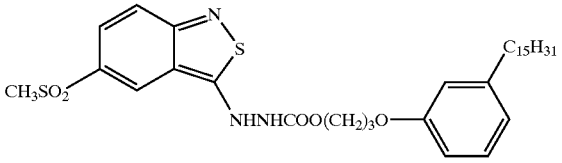
D-150
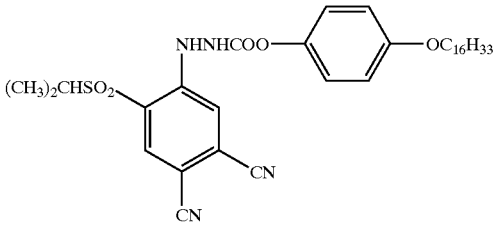
D-151
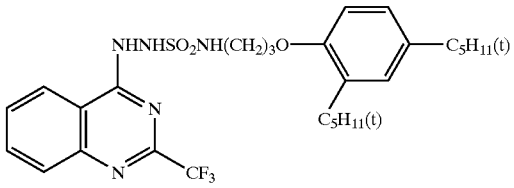
D-152
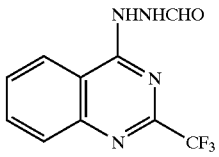

-continued
D-153
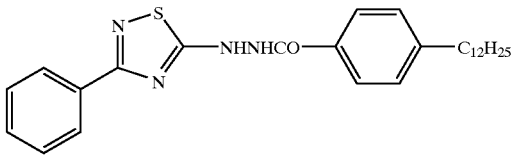
D-154
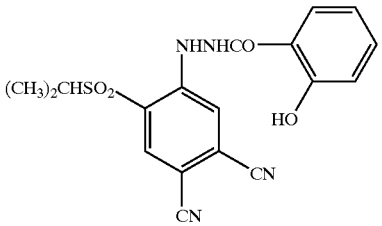
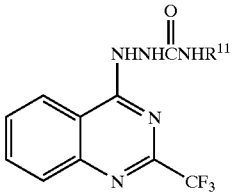
| Compound | $R^{11}$ |
|---|---|
| D-155 | $CH_3$ |
| D-156 | $C_2H_5$ |
| D-157 | (n)$C_3H_7$ |
| D-158 | (i)$C_3H_7$ |
| D-159 | (n)$C_4H_9$ |
| D-160 | (i)$C_4H_9$ |
| D-161 | sec-$C_4H_9$ |
| D-162 | (t)$C_4H_9$ |
| D-163 | (n)$C_5H_{11}$ |
| D-164 | (t)$C_5H_{11}$ |
| D-165 | (n)$C_6H_{13}$ |
| D-166 | 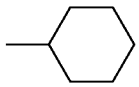 |
| D-167 | (n)$C_8H_{17}$ |
| D-168 | (t)$C_8H_{17}$ |
| D-169 | 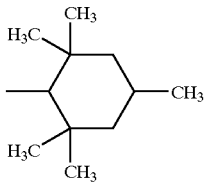  |
| D-170 | 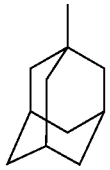 |
| D-171 | 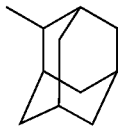 |

-continued
D-172
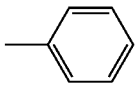
D-173
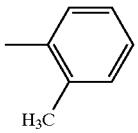
D-174
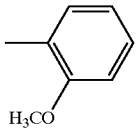
D-175
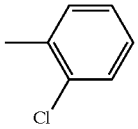
D-176
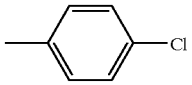
D-177
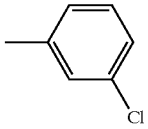
D-178
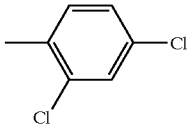
D-179
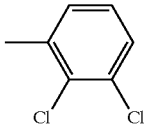
D-180
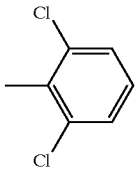
D-181
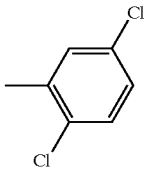
D-182
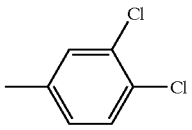

-continued
D-183
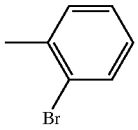
D-184
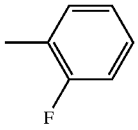
D-185
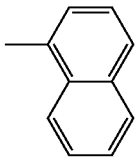
D-186
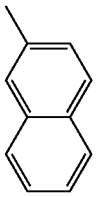
D-187
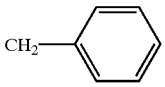
D-188
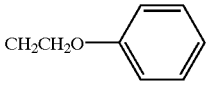
D-189 $CH_2CH_2OCH_2CH_3$
D-190 $CH_2CH_2OCH_3$
D-191
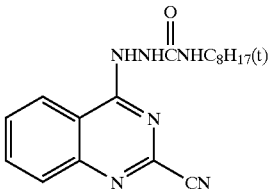
D-192
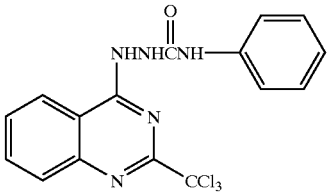
D-193
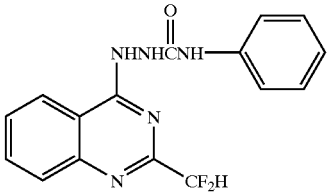

-continued
D-194
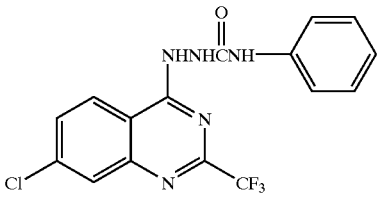
D-195
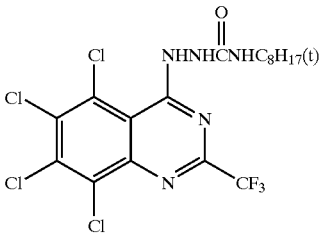
D-196
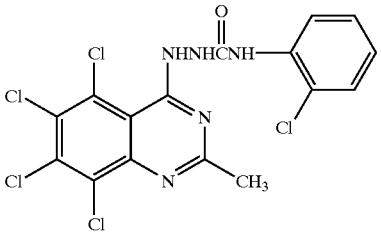
D-197
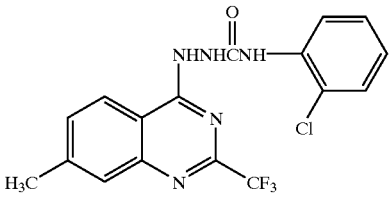
D-198
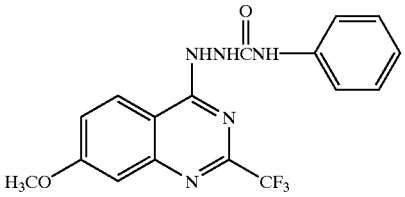
D-199
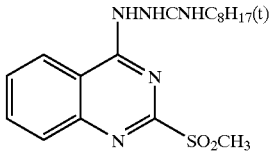
D-200
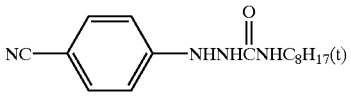
D-201
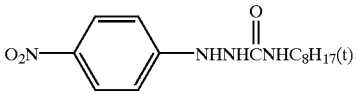

-continued

D-202

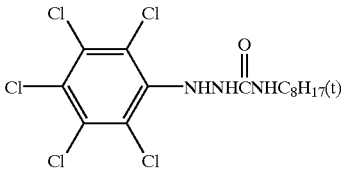

D-203

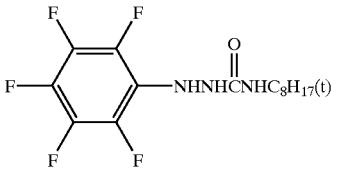

D-204

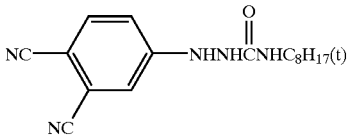

D-205

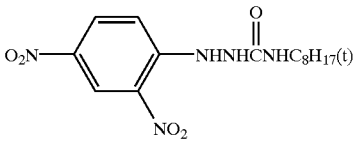

D-206

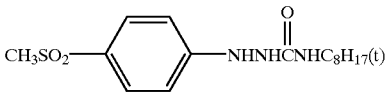

The synthesis of the compound represented by the general formula (5) can be effected according to the methods described in JP-A Nos. 9-152702, 8-286340, 9-152700, 9-152701, 9-152703, and 9-152704.

The additive amount of the compound represented by the general formula (5) has a wide range, but is preferably within a range from 0.01 to 100 mol, and more preferably 0.1 to 10 mol, per mol of silver ions.

The additive amount of the compound represented by the general formula (5) may be added in any form of solution, powder, slid fine grain dispersion, emulsion or oil-protected dispersion. Dispersion of the solid microparticle is effected using a known pulverizing means (e.g. ball mill, vibrating ball mill, sand mill, colloid mill, jet mill and roller mill). A dispersion aid may be available for dispersing the solid microparticle.

Next, the compounds represented by the general formula (6) and (7) will be explained.

General formula (6)

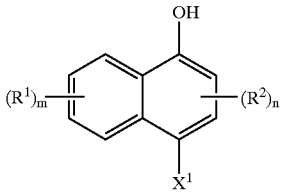

-continued

General formula (7)

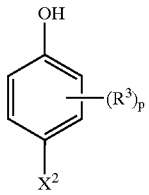

In the general formulae (6) and (7), $X^1$ and $X^2$ each independently represents a hydrogen atom or a substituent. Examples of the substituents represented by $X^1$ and $X^2$ include halogen atom (e.g. fluorine atom, chlorine atom, bromine atom, or iodine atom), aryl group (preferably having 6 to 30 carbon atoms, more preferably 6 to 20, and still more preferably 6 to 12, and examples thereof include phenyl, p-methylphenyl, and naphthyl), alkoxy group (preferably having 1 to 20 carbon atoms, more preferably 1 to 12 carbon atoms, and still more preferably 1 to 8, and examples thereof include methoxy, ethoxy, and butoxy), aryloxy group (preferably having 6 to 20 carbon atoms, more preferably 6 to 16, and still more preferably 6 to 12, and examples thereof include phenyloxy and 2-naphthyloxy), alkylthio group (preferably having 1 to 20 carbon atoms, more preferably 1 to 16 carbon atoms, and still more preferably 1 to 12 carbon atoms, and examples thereof include methylthio, ethylthio, and butylthio), arylthio group (preferably having 6 to 20 carbon atoms, more preferably 6 to 16, and still more preferably 6 to 12, and examples thereof include phenylthio and naphthylthio), acyloxy group (preferably having 1 to 20 carbon atoms, more preferably 2 to 16 carbon atoms, and still more preferably 2 to 10, and examples thereof include acetoxy and benzoyloxy), acylamino group (preferably having 2 to 20 carbon atoms, more preferably 2 to 16 carbon atoms, and still more preferably 2 to 10 carbon atoms, and examples thereof include N-methylacetylamino and benzoylamino), sulfonylamino group (preferably having 1 to 20 carbon atoms, more preferably 1 to 16 carbon atoms, and still more preferably 1 to 12 carbon atoms, and examples thereof include methanesulfonylamino and benzenesulfonylamino), carbamoyl group (preferably having 1 to 20 carbon atoms, more preferably 1 to 16 carbon atoms, and still more preferably 1 to 12 carbon atoms, and examples thereof include carbamoyl, N,N-diethylcarbamoyl, and N-phenylcarbamoyl), acyl group (preferably having 2 to 20 carbon atoms, more preferably 2 to 16 carbon atoms, and still more preferably 2 to 12 carbon atoms, and examples thereof include acetyl, benzoyl, formyl, and pivaroyl), alkoxycarbonyl group (preferably having 2 to 20 carbon atoms, more preferably 2 to 16 carbon atoms, and still more preferably 2 to 12 carbon atoms, and examples thereof include methoxycarbonyl), sulfo group, sulfonyl group (preferably having 1 to 20, more preferably 1 to 16 carbon atoms, and still more preferably 1 to 12 carbon atoms, and examples thereof include mesyl and tosyl), sulfonyloxy group (preferably having 1 to 20 carbon atoms, more preferably 1 to 16 carbon atoms, and still more preferably 1 to 12 carbon atoms, and examples thereof include methanesulfonyloxy and benzenesulfonyloxy), azo group, heterocycle group, heterocycle mercapto group, and cyano group. As used herein, the term "heterocycle group" refers to a saturated or unsaturated heterocycle group, and examples thereof include pyridyl group, quinolyl group, quinoxalinyl group, pyrazinyl group, benzotriazolyl group, pyrazolyl group, imidazolyl group, benzimidazolyl group, tetrazolyl group, hydantoin-1-yl group, succinimide group, and phthalimide group.

In the general formula (6) or (7), $X^1$ and $X^2$ preferably represent a substituent, and more preferably an alkoxy group or an aryloxy group because the dye image is not substantially formed after the development and an influence is hardly exerted on the image color tone of the heat-developable photosensitive material. The substituents represented by $X^1$ and $X^2$ may be further substituted with other substituents and may be any known substituents as far as it does not impair the photographic performance.

In the general formulae (6) and (7), $R^1$ to $R^3$ each independently represents a hydrogen atom or a substituent. m and p each independently represents an integer of 0 to 4, and n represents an integer of 0 to 2. The substituents represented by $R^1$ to $R^3$ may be any substituent as far as it does not exert an adverse influence on the photographic performance. Examples thereof include halogen atom (e.g. fluorine atom, chlorine atom, bromine atom, or iodine atom), straight-chain, branched, cyclic or combined alkyl group (preferably having 1 to 20 carbon atoms, more preferably 1 to 16 carbon atoms, and still more preferably 1 to 13, and examples thereof include methyl, ethyl, n-propyl, isopropyl, sec-butyl, tert-butyl, tert-octyl, n-amyl, tert-amyl, n-dodecyl, n-tridecyl, and cyclohexyl), alkenyl group (preferably having 2 to 20 carbon atoms, more preferably 2 to 16 carbon atoms, and still more preferably 2 to 12 carbon atoms, and examples thereof include vinyl, allyl, 2-butenyl, and 3-pentenyl), aryl group (preferably having 6 to 30 carbon atoms, more preferably 6 to 20 carbon atoms, and still more preferably 6 to 12 carbon atoms, and examples thereof include phenyl, p-methylphenyl, and naphthyl), alkoxy group (preferably having 1 to 20 carbon atoms, more preferably 1 to 16 carbon atoms, and still more preferably 1 to 12 carbon atoms, and examples thereof methoxy, ethoxy, propoxy, and butoxy), aryloxy group (preferably having 6 to 30 carbon atoms, more preferably 6 to 20, and still more preferably 6 to 12 carbon atoms, and examples thereof include phenyloxy and 2-naphthyloxy), acyloxy group (preferably having 2 to 20 carbon atoms, more preferably 2 to 16 carbon atoms, and still more preferably 2 to 12 carbon atoms, and examples thereof include acetoxy and benzoyloxy), amino group (preferably having 0 to 20 carbon atoms, more preferably 1 to 16 carbon atoms, and still more preferably 1 to 12 carbon atoms, and examples thereof include dimethylamino group, diethylamino group, dibutylamino group, and anilino group), acylamino group (preferably having 2 to 20 carbon atoms, more preferably 2 to 16 carbon atoms, and still more preferably 2 to 13, and examples thereof include acetylamino, tridecanoylamino, and benzoylamino), sulfonylamino group (preferably having 1 to 20 carbon atoms, more preferably 1 to 16 carbon atoms, and still more preferably 1 to 12 carbon atoms, and examples thereof include methanesulfonylamino, butanesulfonylamino, and benzenesulfonylamino), ureido group (preferably having 1 to 20 carbon atoms, more preferably 1 to 16 carbon atoms, and still more preferably 1 to 12 carbon atoms, and examples thereof include ureido, methylureido, and phenylureido), carbamate group (preferably having 2 to 20 carbon atoms, more preferably 2 to 16 carbon atoms, and still more preferably 2 to 12 carbon atoms, and examples thereof include methoxycarbonylamino and phenyloxycarbonylamino), carboxyl group, carbamoyl group (preferably having 1 to 20 carbon atoms, more preferably 1 to 16 carbon atoms, and still more preferably 1 to 12 carbon atoms, and examples thereof include carbamoyl, N,N-diethylcarbamoyl, N-dodecylcarbamoyl, and N-phenylcarbamoyl), alkoxycarbonyl group (preferably having 2 to 20 carbon atoms, more preferably 2 to 16 carbon atoms, and still more preferably 2 to 12 carbon atoms, and examples thereof include methoxycarbonyl, ethoxycarbonyl, and butoxycarbonyl), acyl group (preferably having 2 to 20 carbon atoms, more preferably 2 to 16 carbon atoms, and still more preferably 2 to 12 carbon atoms, and examples thereof include acetyl, benzoyl, formyl, and pivaroyl), sulfo group, sulfonyl group (preferably having 1 to 20 carbon atoms, more preferably 1 to 16 carbon atoms, and still more preferably 1 to 12 carbon atoms, and examples thereof inclyde mesyl and tosyl), sulfamoyl group (preferably having 0 to 20 carbon atoms, more preferably 0 to 16, and still more preferably 0 to 12, and examples thereof include sulfamoyl, methylsulfamoyl, dimethylsulfamoyl, and phenylsulfamoyl), cyano group, nitro group, hydroxyl group, mercapto group, alkylthio group (preferably having 1 to 20 carbon atoms, more preferably 1 to 16 carbon atoms, and still more preferably 1 to 12 carbon atoms, and examples thereof include methylthio and butylthio), and heterocycle group (preferably having 2 to 20 carbon atoms, more preferably 2 to 16 carbon atoms, and still more preferably 2 to 12 carbon atoms, and examples thereof include pyridyl, imidazoyl, and pyrrolidyl). These substituents may be further substituted with other substituents.

Among these groups, preferred substituents represented by $R^1$ to $R^3$ include halogen atom, alkyl group, aryl group, alkoxy group, aryloxy group, acyloxy group, anilino group, acylamino group, sulfonylamino group, carboxyl group, carbamoyl group, acyl group, sulfo group, sulfonyl group, sulfamoyl group, cyano group, hydroxyl group, mercapto group, alkylthio group, and heterocycle group.

More preferably, the compound represented by the general formula (6) preferably has a carbamoyl group (preferably having 1 to 20 carbon atoms, more preferably 1 to 16 carbon atoms, and still more preferably 1 to 12 carbon atoms, and examples thereof include carbamoyl, N,N-diethylcarbamoyl, N-dodecylcarbamoyl, N-phenylcarbamoyl, N-(2-chlorophenyl)carbamoyl, N-(4-chlorophenyl)carbamoylN-(2,4-dichlorophenyl)carbamoyl, and N-(3,4-dichlorophenyl)carbamoyl) at the 2-position and, particularly preferably, the compound has an aryl carbamoyl group (preferably having 7 to 20 carbon atoms, more preferably 7 to 16 carbon atoms, still more preferably 7 to 12 carbon atoms, and examples thereof include N-phenylcarbamoyl, N-(2-chlorophenyl)carbamoyl, N-(4-chlorophenyl)carbamoylN-(2,4-dichlorophenyl)carbamoyl, and N-(3,4-dichlorophenyl)carbamoyl) at the 2-position.

Next, specific examples of the compound represented by the general formulae (6) and (7) are described, but the compounds used in the invention are not limited to these specific examples. Compound numbers (H-1) to (H-34) denote specific examples of the compound represented by the general formula (6), while compound numbers (H-101) to (H-211) denote specific examples of the compound represented by the general formula (7).

(H-1)

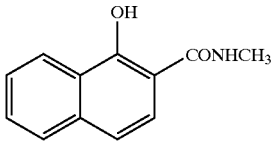

(H-2)

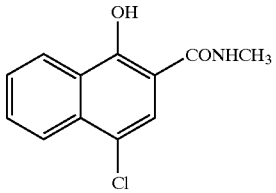

(H-3)

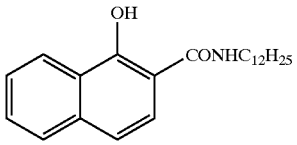

(H-4)

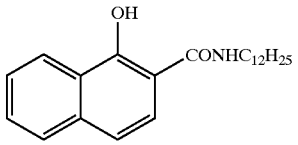

(H-5)

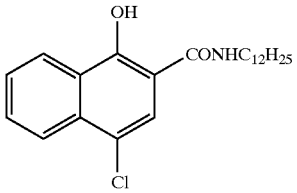

(H-6)

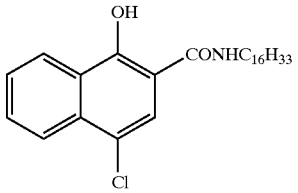

(H-7)

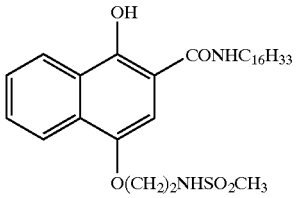

(H-8)

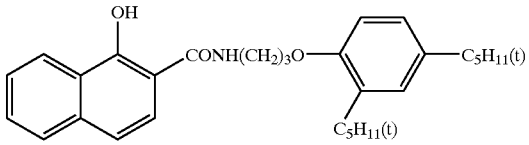

(H-9)

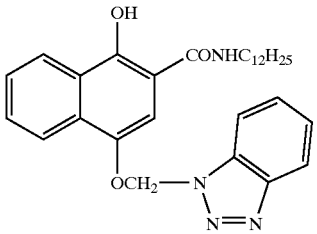

(H-10)

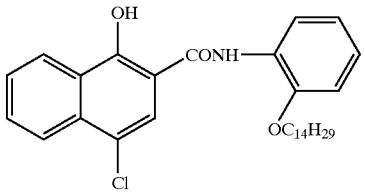

-continued
(H-11)
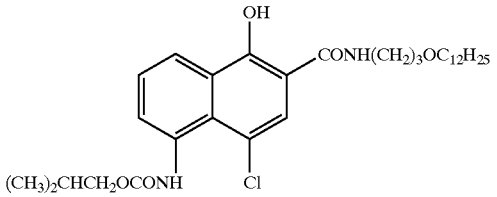
(H-12)
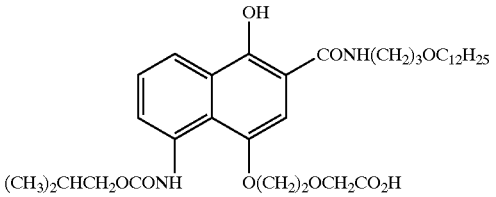
(H-13)
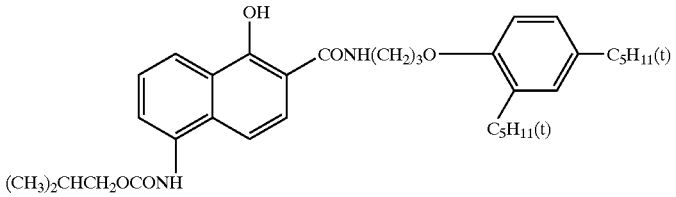
(H-14)
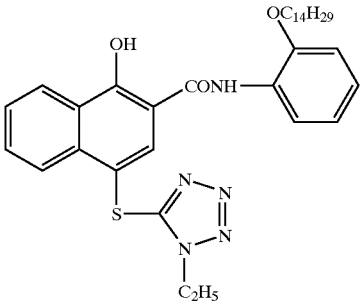
(H-16)
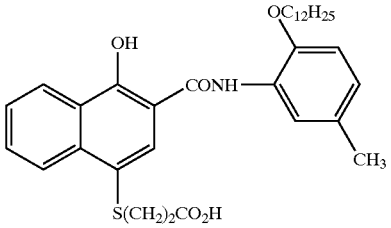
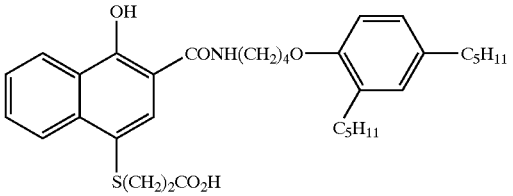
(H-17)
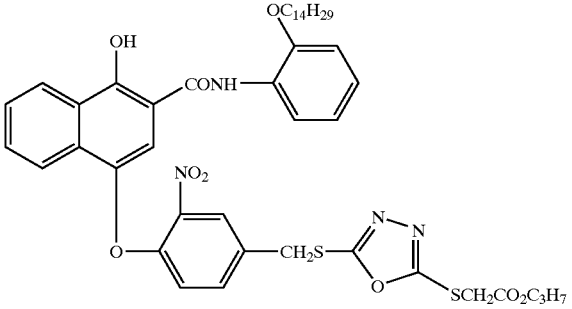

-continued
(H-18)
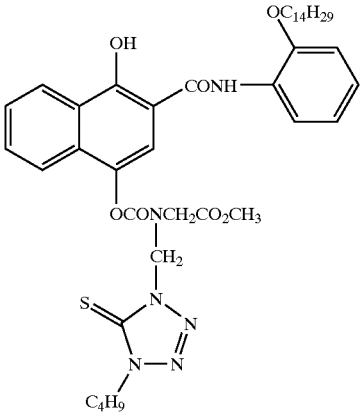
(H-19)
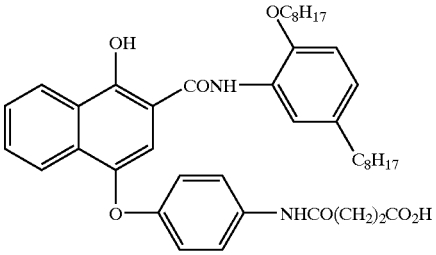
(H-20)
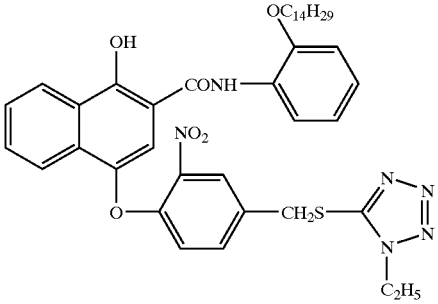
(H-21)
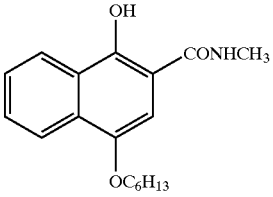
(H-22)
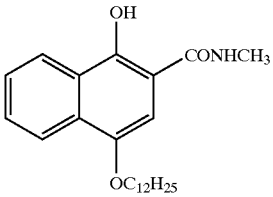
(H-23)
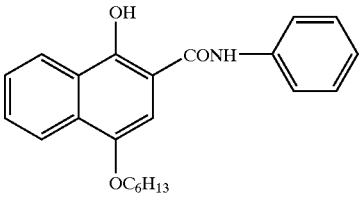
(H-24)
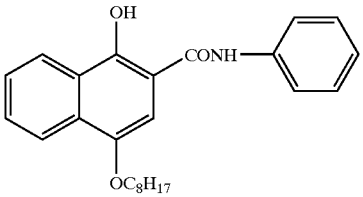
(H-25)
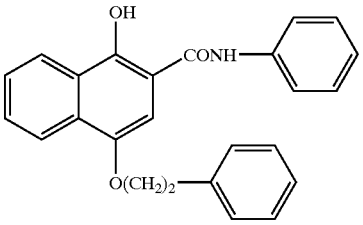
(H-26)
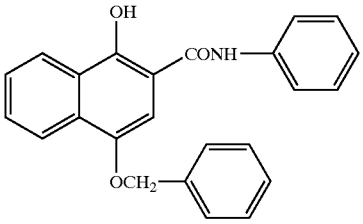
(H-27)
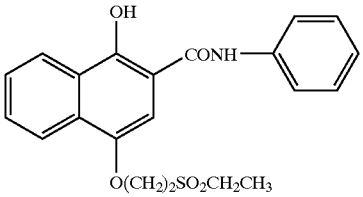
(H-28)
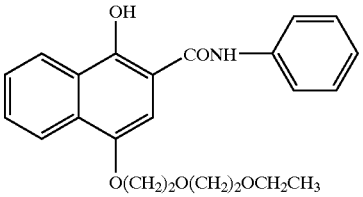

-continued
(H-29)
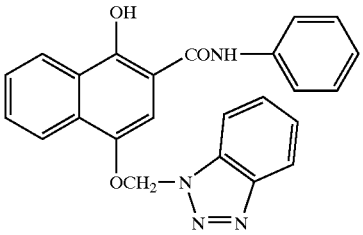
(H-30)
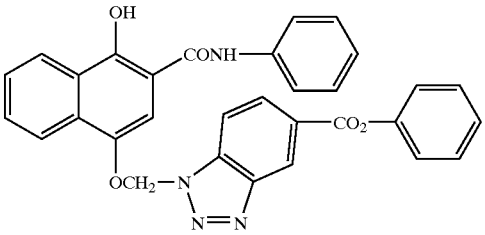
(H-31)
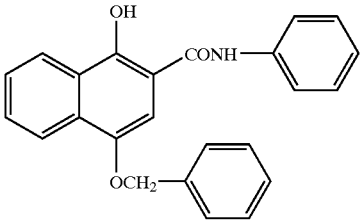
(H-32)
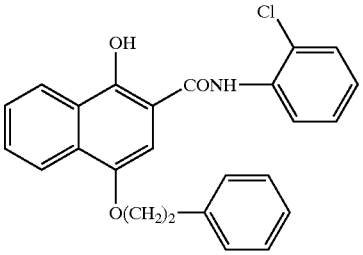
(H-33)
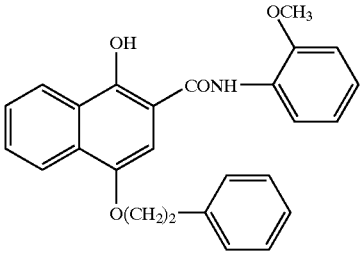
(H-34)
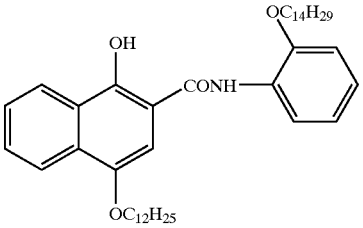
(H-101)
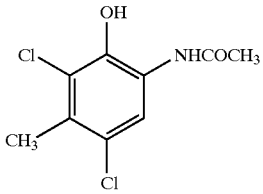
(H-102)
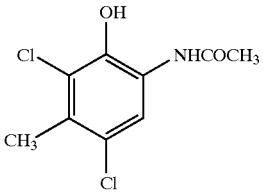
(H-103)
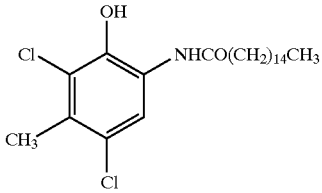
(H-104)
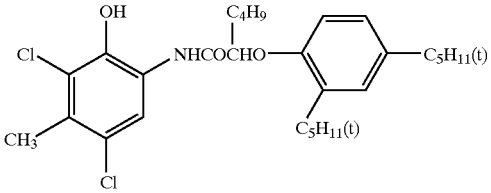
(H-105)
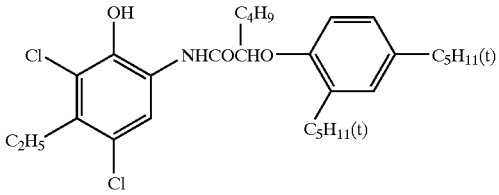
(H-106)
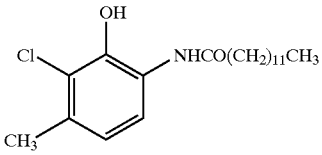
(H-107)
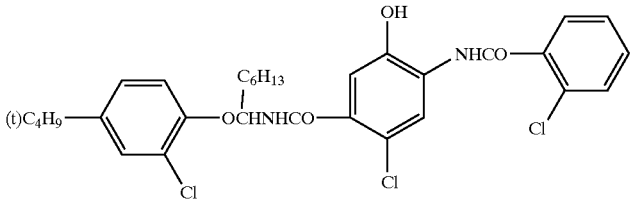

-continued
(H-108)
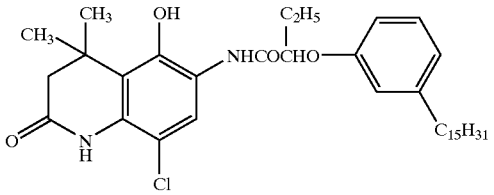
(H-109)
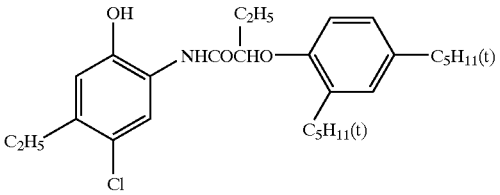
(H-110)
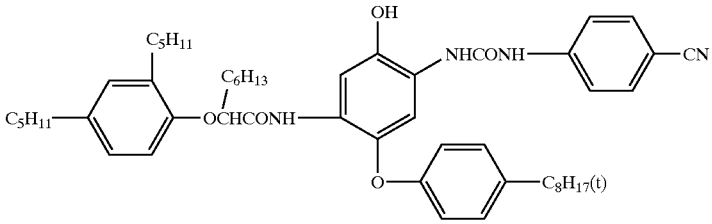
(H-111)
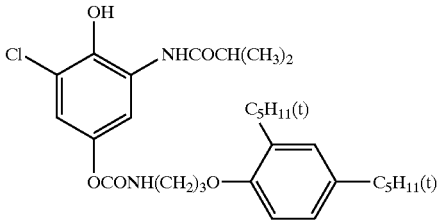
(H-112)
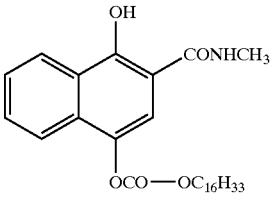
(H-113)
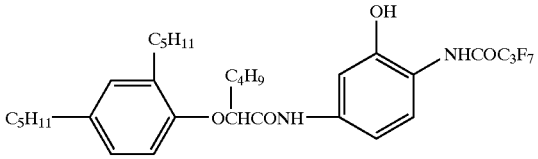
(H-114)
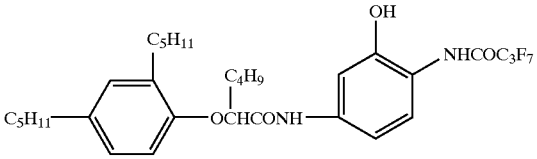
(H-115)
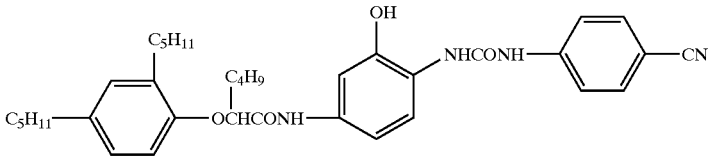
(H-116)
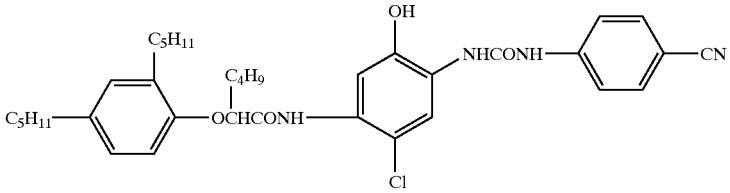
(H-117)
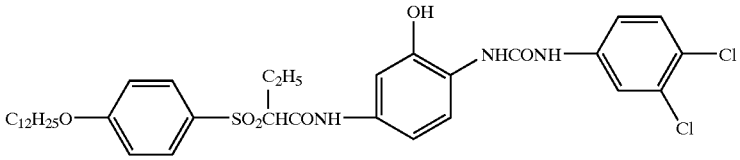
(H-118)
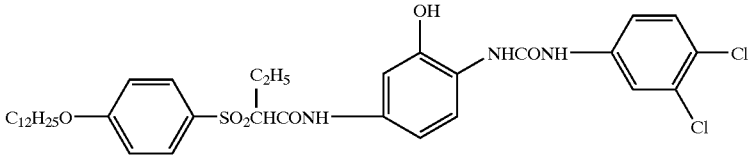

-continued
(H-119)
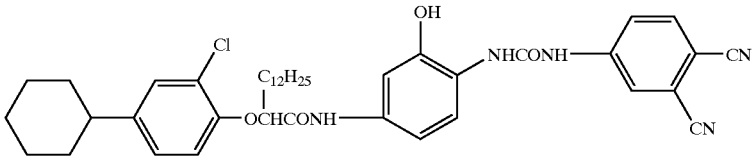
(H-120)
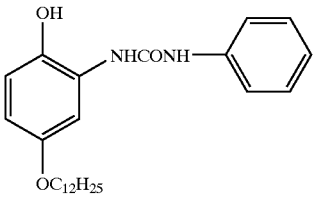
(H-121)
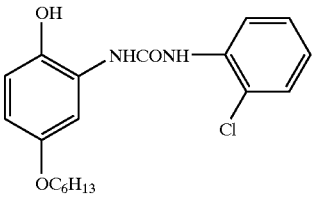
(H-122)
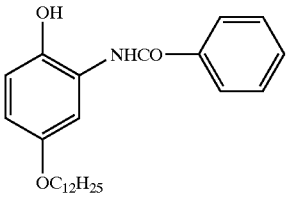
(H-123)
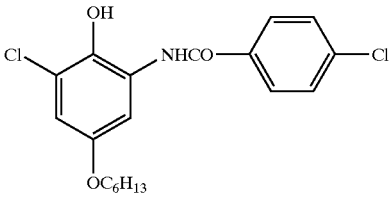
(H-124)
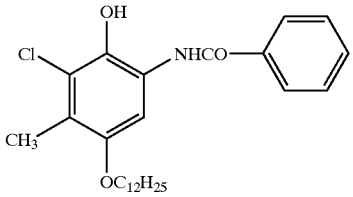
(H-125)
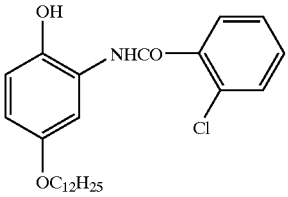
(H-126)
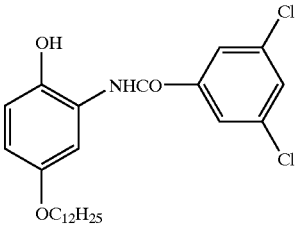
(H-127)
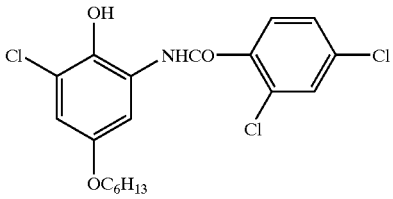
(H-128)
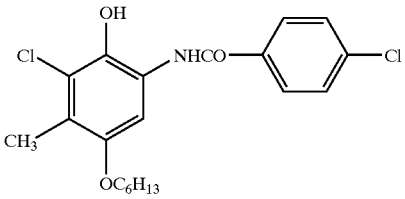
(H-129)
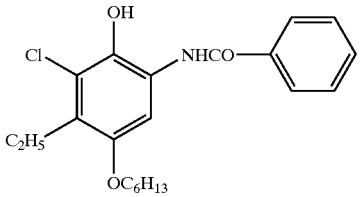
(H-130)
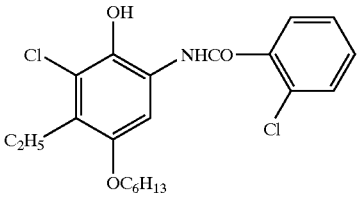
(H-131)
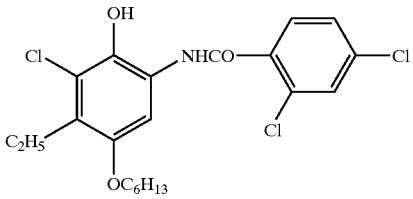
(H-132)
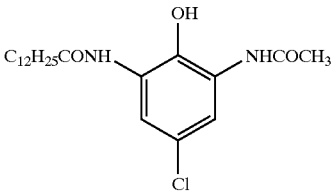

-continued
(H-133)
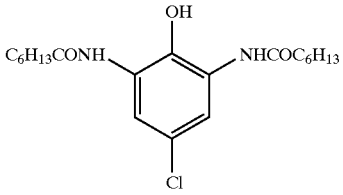
(H-134)
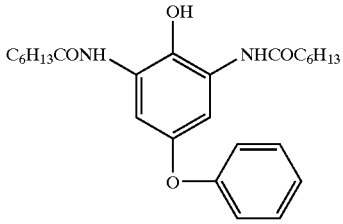
(H-135)
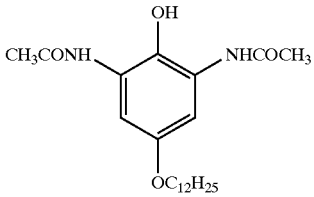
(H-136)
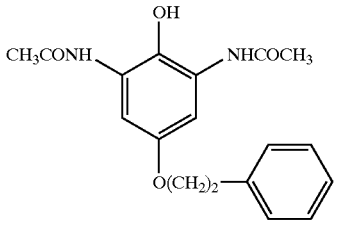
(H-137)
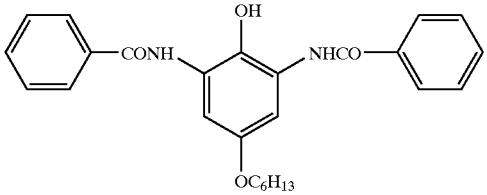
(H-138)
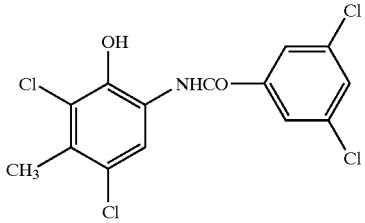
(H-139)
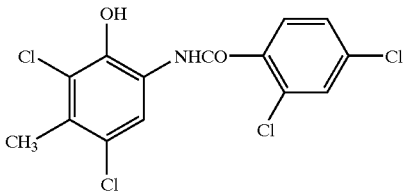
(H-140)
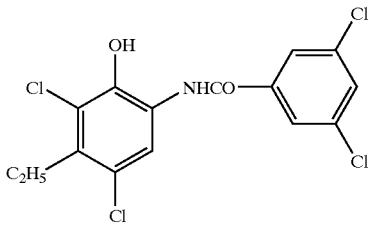
(H-141)
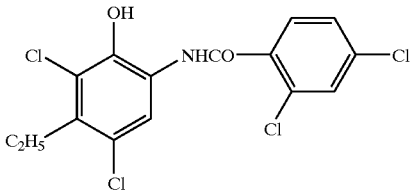
(H-142)
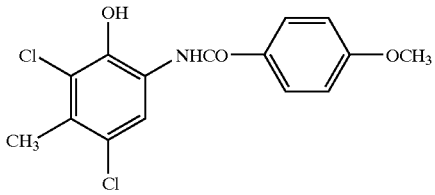
(H-143)
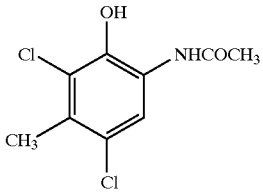
(H-144)
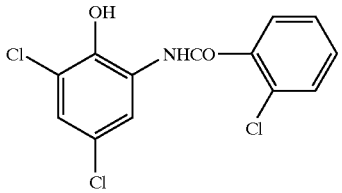
(H-145)
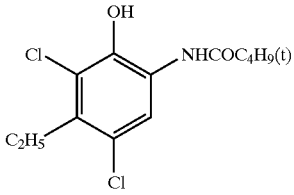
(H-146)
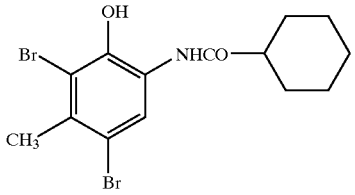

-continued
(H-147)
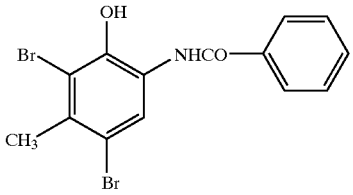
(H-148)
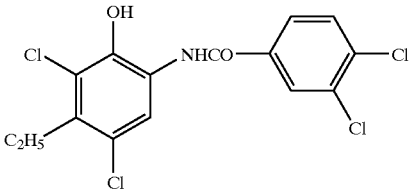
(H-149)
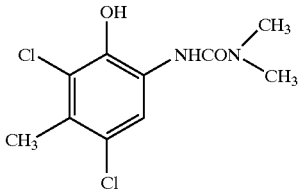
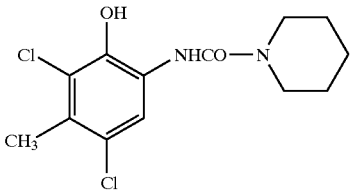
(H-151)
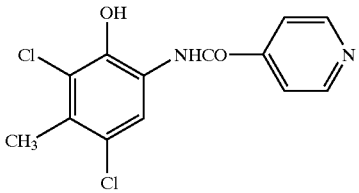
(H-152)
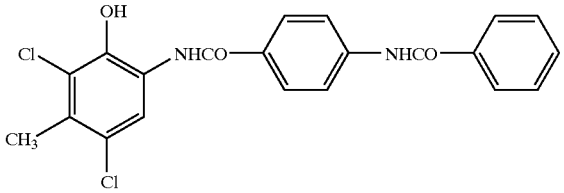
(H-153)
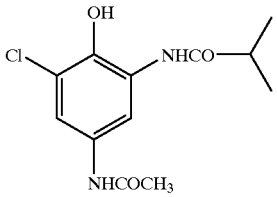
(H-154)
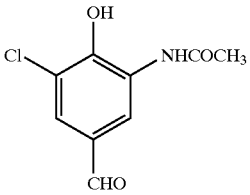
(H-155)
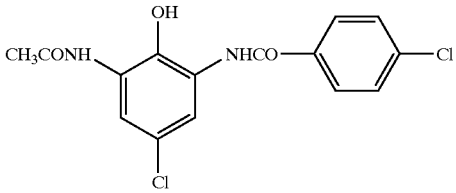
(H-156)
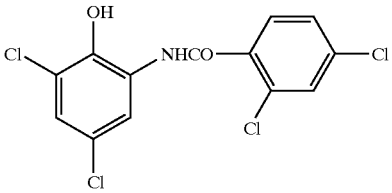
(H-157)
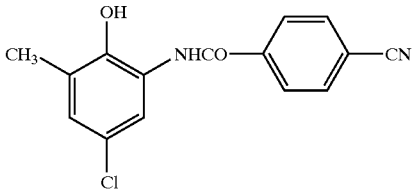
(H-158)
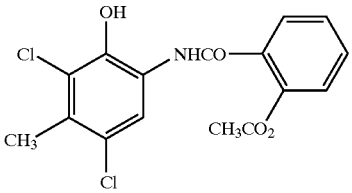
(H-159)
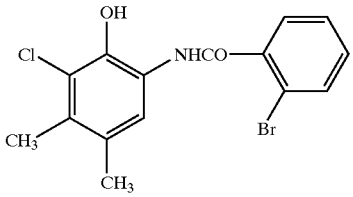
(H-160)
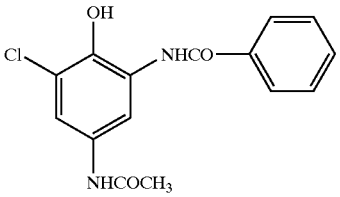

-continued
(H-161)
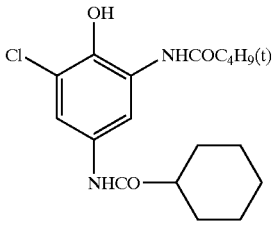
(H-162)
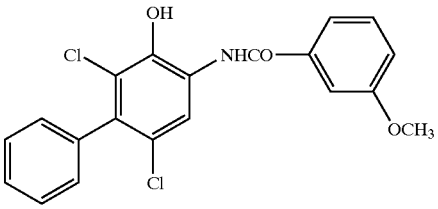
(H-163)
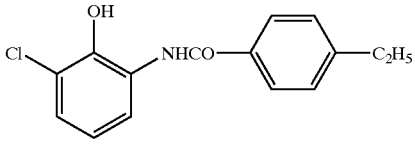
(H-164)
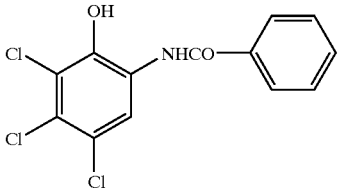
(H-165)
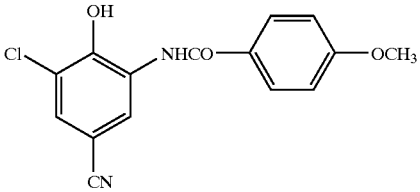
(H-166)
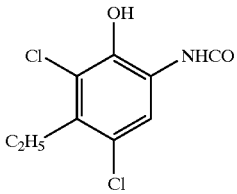
(H-167)
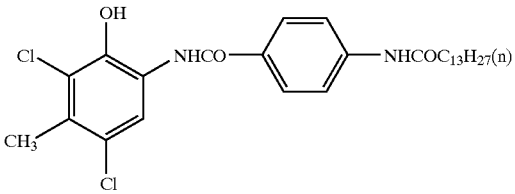
(H-168)
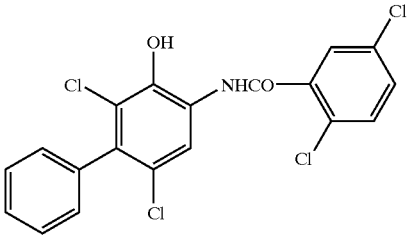
(H-169)
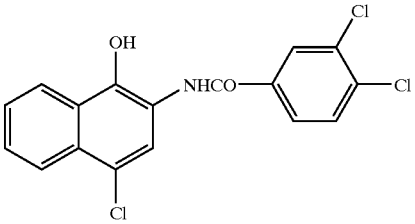
(H-170)
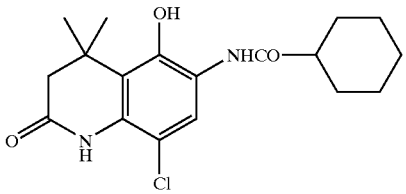
(H-171)
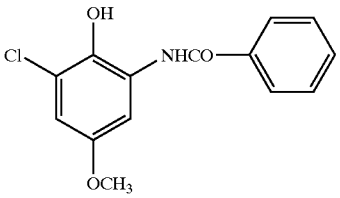
(H-172)
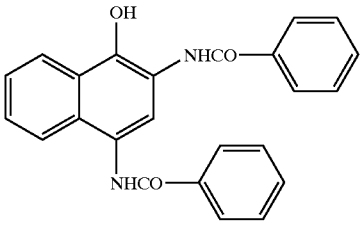
(H-173)
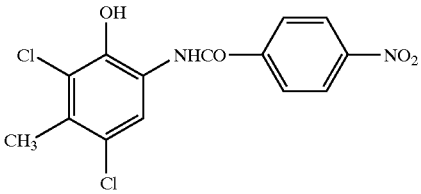

-continued
(H-174)
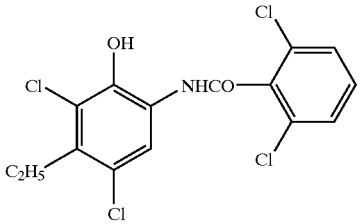
(H-175)
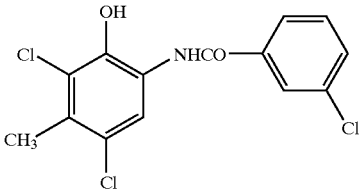
(H-176)
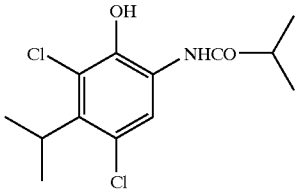
(H-177)
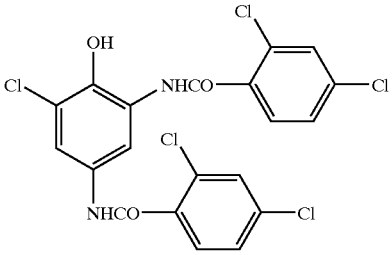
(H-178)
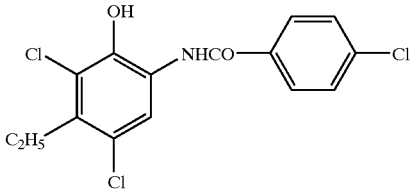
(H-179)
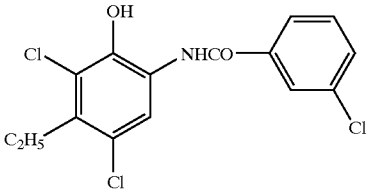
(H-180)
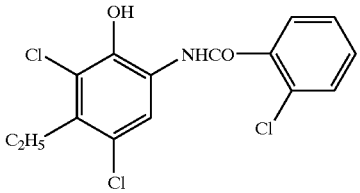
(H-181)
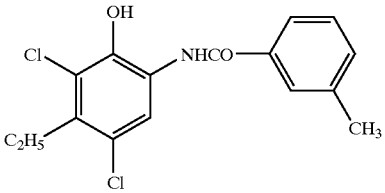
(H-182)
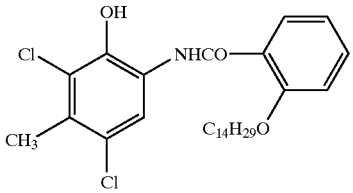
(H-183)
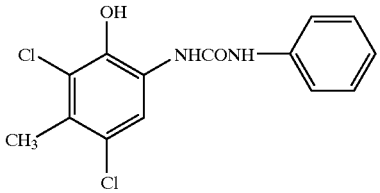
(H-184)
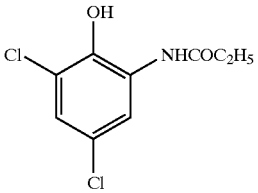
(H-185)
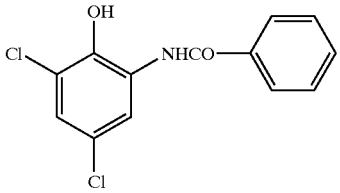
(H-186)
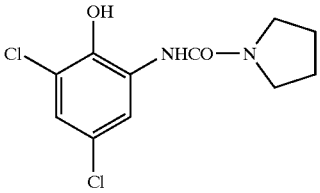

-continued
(H-187)
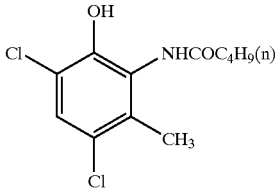
(H-188)
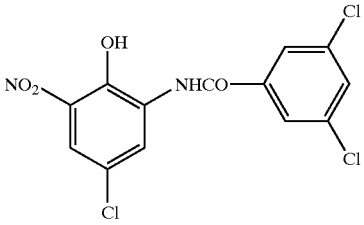
(H-189)
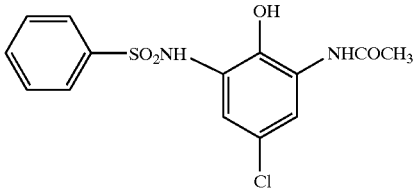
(H-190)
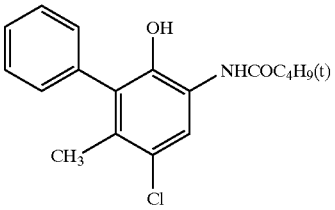
(H-191)
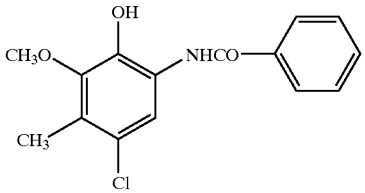
(H-192)
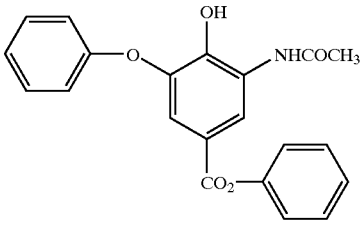
(H-193)
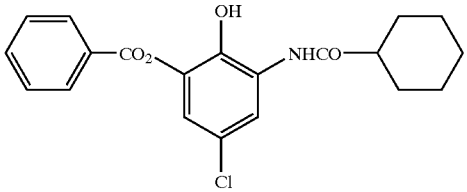
(H-194)
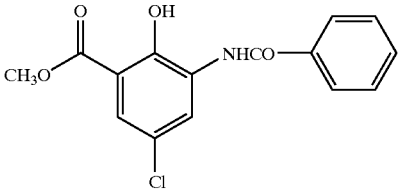
(H-195)
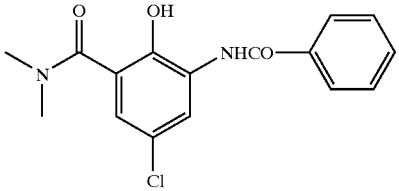
(H-197)
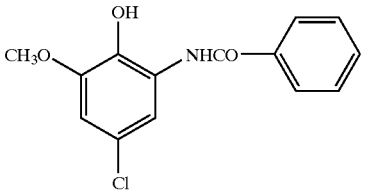
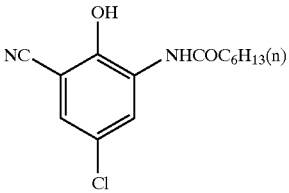
(H-198)
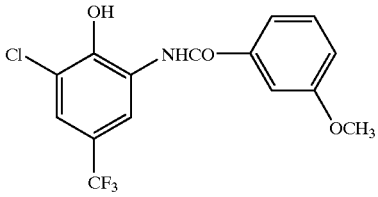
(H-199)
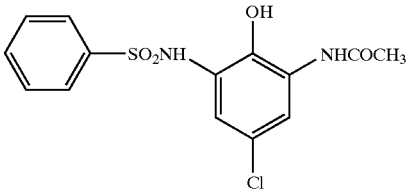

-continued
(H-200)
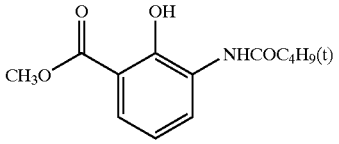
(H-201)
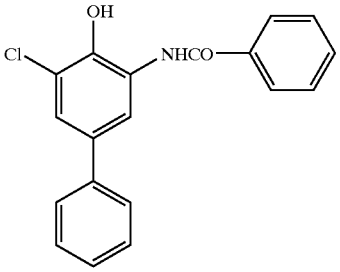
(H-202)
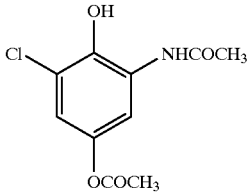
(H-203)
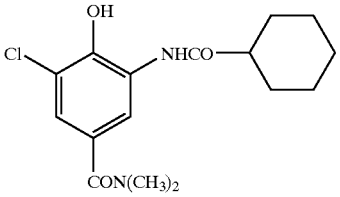
(H-204)
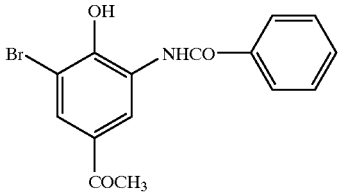
(H-205)
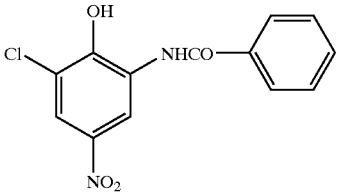
(H-206)
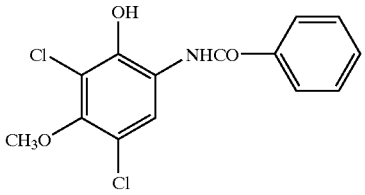
(H-207)
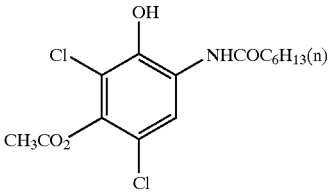
(H-208)
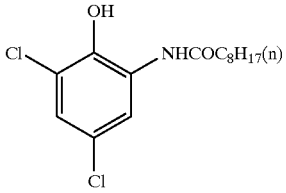
(H-209)
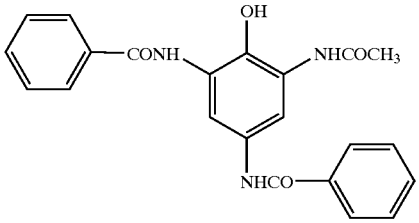
(H-210)
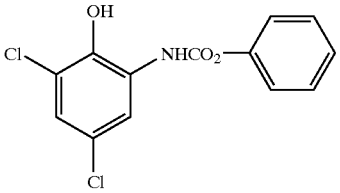
(H-211)
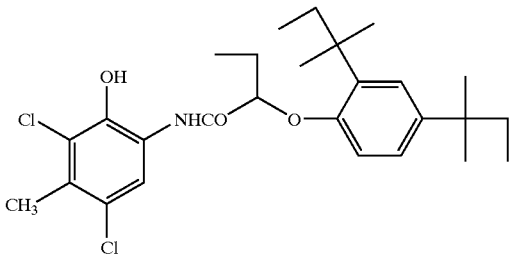

The compounds represented by the general formulae (6) and (7) can be synthesized by the method known publicly in the photographic field. The compounds represented by the general formulae (6) and (7) can be used as a solution prepared by dissolving in water or a proper organic solvent, for example, alcohols (e.g. methanol, ethanol, propanol, fluorinated alcohol), ketones (e.g. acetone, methyl ethyl ketone), dimethylformamide, dimethyl sulfoxide, or methylcellosolve.

Alternatively, the compounds may also be used as an emulsified dispersion mechanically prepared according to an already well known emulsification dispersion method by using an oil such as dibutyl phthalate, tricresyl phosphate, glyceryl triacetate or diethyl phthalate, ethyl acetate or cyclohexanone as an auxiliary solvent for dissolution. Alternatively, the compounds may be used after dispersion of a powder of the compound in a proper solvent such as water by using a ball mill, a colloid mill, a sand grinder mil, MANTON GAULIN, a microfluidizer, or by means of ultrasonic wave according to a known method for solid dispersion.

The compounds represented by the formulae (6) and (7) may be added to any layers on a substrate provided on the same surface as layers containing the aforementioned photosensitive silver halide and the reducible silver salt are present. However, it is preferably added to a layer containing the silver halide or a layer adjacent thereto. The additive amount of the compounds represented by the general formulae (6) and (7) is preferably within a range from 0.2 to 200 mmol, more preferably from 0.3 to 100 mmol, and still more preferably from 0.5 to 30 mmol, per mol of silver. These compounds represented by the general formulae (6) and (7) may be used individually or as a blend of two or more thereof.

The heat-developable photosensitive material of the invention contains the reducing agent for reducing other reducible silver salt (organic silver salt), in addition to the compounds represented by the general formulae (1) to (3) and (5) to (7). The reducing agent silver salt may be arbitrary substance capable of reducing silver ion into metal silver, and preferably an organic substance. While conventional photographic developers such as phenidone, hydroquinone and catechol are useful, a hindered phenol reducing agent is preferred. The reducing agent is preferably contained in an amount of from 5 to 50 mol %, more preferably from 10 to 40 mol % per mol of silver presents in the side where the image-forming layer is provided. A layer to which the reducing agent is added may be any layer on the surface having the image-forming layer. In the case of adding the reducing agent to a layer other than the image-forming layer, the reducing agent is preferably used in a slightly larger amount of from 10 to 50 mol % per mol of silver. The reducing agent may also be a so-called precursor which is derived to effectively exhibit its function only at the time of development.

In the heat-developable photosensitive material of the invention, since the reducing agents (compounds represented by the general formulae (1) to (3) and (11) to (7)) are bisphenols having an aromatic hydroxyl group (—OH), a non-reducing group having a group capable of forming a hydrogen bond with these groups (hereinafter referred to as a hydrogen-bonding compound) is preferably used in combination. Examples of the group capable of forming a hydrogen bond with the hydroxyl group or amino group include phosphoryl group, sulfoxide group, sulfonyl group, carbonyl group, amide group, ester group, urethane group, ureido group, tertiary amino group, and nitrogen-containing aromatic group. Among these, preferred is a compound having a phosphoryl group, a sulfoxide group, an amide group (which has not a >N—H group and is blocked like >N—R (R is a substituent other than H)), an urethane group (which has not a >N—H group and is blocked like >N—R(R is a substituent other than H)), and an ureido group (which has not a >N—H group and is blocked like >N—R(R is a substituent other than H)).

Particularly preferred hydrogen-bonding compound is a phosphione oxide compound described in Japanese Patent Application No. 2000-74278.

The hydrogen-bonding compound can be used in a photosensitive material after being added to a coating solution in any form of solution, emulsion or slid fine grain dispersion. The hydrogen-bonding compound forms a hydrogen-bonding complex with a compound having a phenolic hydroxyl group and an amino group in a solution state, and can be isolated as a complex in a crystal state depending upon the combination of the reducing agent and the hydrogen-bonding compound. The use of the isolated crystal powder as the slid fine grain dispersion is particularly preferred so as to obtain stable performance. It is also possible to preferably use the method of mixing the reducing agent with the hydrogen-bonding compound in a powder state and forming a complex by a sand grinder mill using a proper dispersant upon dispersion.

The hydrogen-bonding compound is preferably used in the amount within a range from 1 to 200 mol %, more preferably 10 to 150 mol %, and still more preferably 30 to 100 mol %, based on the reducing agent.

Next, the photosensitive silver halide will be explained.

The photosensitive silver halide used in the invention has no limitation with regard to its halogen composition, and any of silver chloride, silver chlorobromide, silver bromide, silver iodobromide and silver iodochlorobromide is available. Methods for producing photosensitive silver halide used in the invention are well known in the art, and, for example, the methods described in Research Disclosure, No. 17029 (June, 1978) and U.S. Pat. No. 3,700,458 may be applied. Specifically, the method of adding a silver-supplying compound and a halogen-supplying compound to gelatin or the other polymer solution, thereby to prepare a photosensitive silver halide grain, which is then mixed with an organic silver salt. The method described in the paragraph numbers [0217] to [0224] of JP-A No. 11-119374, the method described in Japanese Patent Application No. 11-98708 and the method described in Japanese Patent Application No. 11-84182.

The photosensitive silver halide grain preferably has a small particle size so as to prevent high white turbidity after image formation. Specifically, the particle size is preferably 0.20 $\mu$m or less, more preferably from 0.01 to 0.15 $\mu$m, and still more preferably from 0.02 to 0.12 $\mu$m. The term "particle size" as used herein means the diameter of a circle image having an area equal to the projected area of the major plane of the silver halide grain for the case that the grain is tabular.

Examples of the shape of the silver halide grain include cubic, octahedral, tabular, spherical, rod and pebble; among these, cubic and tabular shapes being preferred in the invention. Features of the shape of the grain such as aspect ratio and Miller indices are the same as those described in the paragraph number [0225] of JP-A No. 11-119374. The halogen composition distribution within the grain may be uniform, or the halogen composition may be changed stepwise or continuously. Silver halide grain with a core/shell structure may preferably be used, in which the structure is preferably of two- to five-fold, and more preferably of two- to four-fold. It is also preferable to adopt a technique for localizing silver bromide on the side of silver chloride or silver cholorobromide.

The photosensitive silver halide grain is preferably a silver halide grain comprising a grain and a hexacyano metal complex deposited on the outermost surface of the grain. Examples of the hexacyano metal complex include [Fe(CN)6]4-, [Fe(CN)6]3-, [Ru(CN)6]4-, [Os(CN)6]4-, [Co(CN)6]3-, [Rh(CN)6]3-, [Ir(CN)6]3-, [Cr(CN)6]3- and [Re(CN)6]3-. In the invention, a hexacyano Fe complex is preferred.

Since the hexacyano metal complex exists in the form of ions in an aqueous solution, a countercation is not important. It is preferred to use alkali metal ion (e.g. sodium ion, potassium ion, rubidium ion, cesium ion, or lithium ion), ammonium ion, and alkyl ammonium ion (e.g. tetramethyl ammonium ion, tetraethyl ammonium ion, tetrapropyl ammonium ion, or tetra(n-butyl)ammonium ion), which is easily miscible with water and is suited for use in the sedimentation operation of the photosensitive silver halide emulsion.

The hexacyano metal complex can be added mixing with water, a mixed solvent of water and a proper organic solvent miscible with water (e.g. alcohols, ethers, glycols, ketones, esters, or amides), or gelatin.

The additive amount of the hexacyano metal complex is within a range from $1\times10^{-5}$ mol to $1\times10^{-2}$ mol, and more preferably from $1\times10^{-4}$ mol to $1\times10^{-3}$ mol, per mol of silver.

To deposite the hexacyano metal complex on the outermost surface of the silver halide grain, after the completion of the addition of an aqueous silver nitrate solution used in formation of the grain, the hexacyano metal complex is directly added before the completion of the changing step up to the chemical sensitization step of effecting sulfur sensitization, selenium sensitization, tellurium sensitization, chalcogen, or noble metal sensitization such as gold densitization, during the washing step, during the dispersion step, or before the chemical sensitization step. To prevent silver halide microgram from growing, the hexacyano metal complex is preferably added immediately after the formation of the grain, and preferably added before the completion of the charging step.

The addition of the hexacyano metal complex may be started after adding 96% by weight of the total amount of silver nitrate to be added to form the grain, and the addition is preferably started after adding 96% by weight of silver nitrate, and particularly preferably after adding 96% by weight of silver nitrate.

When the hexacyano metal complex is added after adding the aqueous silver nitrate solution immediately before the formation of the grain, the hexacyano metal complex can be adsorbed on the outermost surface of the silver halide grain and almost all of it can form a slightly soluble salt with silver ions on the surface of the grain. Since a silver salt of hexacyanoferrate (II) is a slightly soluble salt as compared with AgI, redissolution due to the microgram can be prevented, thus making it possible to produce silver halide micrograms having a small particle size.

With regard to the particle size distribution of the photosensitive silver halide grain, the value of monodispersion degree is 30% or less, preferably from 1 to 20%, and more preferably from 5 to 15%. As used herein, the term "monodispersion degree" is defined as a percentage (%) (variation coefficient) of a value determined by dividing a standard deviation of the particle size by the average particle size. For convenience, the particle size of the silver halide grain means the length of an edge of the silver halide grain for the case that the grain is a normal crystal having cubic shape, while it means the diameter of a circle image having an area equal to the projected area of the major plane of the silver halide grain for the case that the grain has other shapes (e.g. octahedral, tetradecahedral and tabular).

The photosensitive silver halide grain for use in the invention preferably contains a Group VII metal or Group VIII metal in the Periodic Table, or metal complex. The Group VII metal or Group VIII metal in the Periodic Table, or a center metal of the metal complex is preferably rhodium, rhenium, ruthenium, osmium or iridium. Particularly preferred metal complexes are (NH4)3Rh($H_2O$)C16, K2Ru(NO)C15, K3IrC16 and K4Fe(CN)6. These metal complexes may be used individually, or in combination of two or more complexes of the same metal or different metals. The metal complex content is preferably from 1×10−9 to $1\times10^{-3}$ mol per mol of silver, and more preferably from 1×10−8 to $1\times10^{-4}$ mol. With respect to the specific structure of the metal complexes, those having the structures described in JP-A No. 7-225449 may be used. The kind and addition method of these heavy metals are described in the paragraph numbers [0227] to [0240] of JP-A No. 11-119374.

The photosensitive silver halide grain may be desalted by water washing according to a method known in the art, such as noodle washing and flocculation, but the grain may not be desalted in the invention.

The silver halide emulsion is preferably subjected to chemical sensitization. The chemical sensitization may be performed using the method described in the paragraph numbers [0242] to [0250] JP-A No. 11-119374. To the photosensitive silver halide emulsion, a thiosulfonic acid compound may be added using the method disclosed in European Patent No. 293917A.

As the gelatin contained in the photosensitive silver halide grains (emulsion), a lower-molecular weight gelatin is preferably used to satisfactorily maintain the dispersion state of the photosensitive silver halide emulsion in the organic silver salt-containing coating. The molecular weight of the lower-molecular weight gelatin is preferably within a range from 500 to 60,000, and more preferably from 1,000 to 40,000. The lower-molecular weight gelatin may be used upon formation of grains or dispersion after the completion of the desalting treatment, but is preferably used upon dispersion after the completion of the desalting treatment.

Upon formation of grains, a conventional gelatin (molecular weight: about 100,000) is used and the lower-molecular weight gelatin may be used upon dispersion after the completion of the desalting treatment. The concentration of the dispersion medium can be adjusted within a range from 0.05 to 20% by weight, but is preferably from 5 to 15% by weight in view of the handling property. As the gelatin, an alkali-treated gelatin is commonly used, but a modified gelatin such as acid-treated gelatin or phthalized gelatin can also be used.

As the sensitization dye for spectral sensitization of the photosensitive silver halide grains, there can be advantageously selected sensitization dyes which can perform spectral sensitization of the silver halide grains at the desired wavelength range upon adsorption on the silver halide grains and have a spectral sensitivity suited to spectral properties of an exposure light source. The sensitization dyes and addition methods are disclosed in the following literatures and examples of the sensitization dye include compound described in the paragraph numbers [0103] to [0109] of JP-A No. 11-65021, compound represented by the formula (II) in JP-A No. 10-186572, dye represented by the general formula (I) in JP-A No. 11-119374 and paragraph number [0106], dyes described in U.S. Pat. No. 5,510,236 and Example 5 of U.S. Pat. No. 3,871,887, and dyes disclosed in JP-A Nos. 2-96131 and 59-48753. Also the sensitization dye is described in page 19, line 38 to page 20, line 35 of EP-AL No. 0803764A1, Patent Application No. 2000-86865, Patent Application No. 2000-102560 and Patent Application No. 2000-205399.

As the pigment for spectral sensitization in a wavelength range from 550 to 750 nm, a dye represented by the formula (II) of JP-A No. 10-186572 is listed and specific examples of preferred dye include dyes II-6, II-7, II-14, II-15, II-18, II-23 and II-25. As the pigment for spectral sensitization in a wavelength range from 750 to 1400 nm, a dye represented by the formula (I) of JP-A No. 11-119374 is listed and specific examples of preferred dye include dyes (25), (26), (30), (32), (36), (37), (41), (49) and (54). As dyes forming J-band, for example, dyes disclosed in U.S. Pat. No. 5,510,236, Example 5 of U.S. Pat. No. 3,871,887 (Example 5), JP-A Nos. 2-96131 and 59-48753 are listed as preferred dyes. Each of these sensitization dyes may be used alone or in any combination.

The sensitization dye may be preferably added to photosensitive silver halide grains (emulsion) at the time period from the desalting process to the coating process, and more preferably from the desalting process to initiation of chemical ripening. The amount of the sensitization dye used may be appropriately selected depending on the performance such as sensitivity or fog. The amount may be preferably from $10^{-6}$ to 1 mol, and more preferably from $10^{-4}$ to $10^{-1}$ mol, per mole of silver halide in the photosensitive layer.

To improve the spectral sensitization efficiency, a strong sensitizing agent can be used in the photosensitive silver halide grains (emulsion). Examples of the strong sensitizing agent include compounds described in EP-A No. 587,338, U.S. Pat. Nos. 3,877,943, 4,873,184, JP-A Nos. 5-341432, 11-109547 and 10-111543.

The photosensitive silver halide grains (emulsion) is preferably subjected to chemical sensitization using a known method such as sulfur sensitization, selenium sensitization or tellurium sensitization. As the compounds used preferably in the method such as sulfur sensitization, selenium sensitization or tellurium sensitization, for example, tellurium sensitization is particularly preferred in the invention, and a compound described in literatures disclosed in the paragraph numbers [0030] of JP-A No. 11-65021 and compounds represented by the formulae (II), (III) and (IV) in JP-A No. 5-313284 are more preferred.

The spectral sensitization of the photosensitive silver halide grains can be effected at any time, for example, (1) before spectral sensitization, (2) upon spectral sensitization, (3) after spectral sensitization and (4) immediately before application, after the completion of desalting. It is particularly preferred to effect chemical sensitization after spectral sensitization. The amounts of the selenium and tellurium sensitizing agents vary depending on the silver halide grains and chemical ripening conditions, but may be preferably from about 10–8 to $10^{-2}$ mol, and more preferably from about 10–7 to $10^{-3}$ mol, per mole of silver halide. Although the conditions of chemical sensitization in the invention are not specifically limited, the pH is within a range from 5 to 8, pAg is within a range from 6 to 11, and the temperature is within a range from about 40 to 95° C.

The photosensitive silver halide grains (emulsion) may be used alone, or two or more photosensitive silver halide grains (photosensitive silver halide grains having different average grain sizes, different halogen compositions, different crystal habits and different chemical sensitization conditions) may be used in combination. The gradation can be adjusted by using plural kinds of photosensitive silver halides having different sensitivities. Technologies with respect to them are described in JP-A Nos. 57-119341, 53-106125, 47-3929, 48-55730, 46-5187, 50-73627 and 57-150841. A difference in sensitivity between emulsions is preferably 0.2 log E or more.

The amount of the photosensitive silver halide used in the invention is preferably from 0.01 to 0.5 mol per mol of the organic silver salt, more preferably from 0.02 to 0.3 mol, still more preferably from 0.03 to 0.25 mol. Methods for mixing a photosensitive silver halide grain and a reducible silver salt (organic silver salt) separately prepared include such that mixing, after completion of the individual preparation, the silver halide grains and the organic silver salt in a high-speed stirrer, ball mill, sand mill, colloid mill, vibrating mill, homogenizer or the like; and such that mixing, at any timing during preparation of the organic silver salt, already-finished photosensitive silver halide to prepare the organic silver salt; while not being limited thereto as far as sufficient effects of the invention are obtained. To control photographic performance, two or more organic silver salt water dispersions are preferably mixed with two or more photosensitive silver salt water dispersions.

Next, the reducible silver salt (hereinafter referred sometimes to a non-photosensitive silver slat) will be explained.

The reducible silver salt is preferably an organic silver salt and this organic silver salt is a silver salt which is relatively stable against light exposure but can produce silver image when heated at 80° C. or higher in the presence of light-exposed photocatalyst (e.g. latent image of photosensitive silver halide) and reducing agent. The organic silver salt may be any organic substance containing a source capable of reducing the silver ion. Silver salt of organic acid, in particular, silver salt of long-chained aliphatic carboxylic acid (having 10 to 30 carbon atoms, and preferably 15 to 28 carbon atoms) is preferred. Complex of organic or inorganic silver salt, whose ligand has a complex stability constant of from 4.0 to 10.0, is also preferred. The silver-supplying substance may preferably constitute about 5 to 70% by weight of the image-forming layer. Preferable organic silver salt includes silver salt of organic compound having a carboxyl group. Examples thereof include silver salts of aliphatic carboxylic acid and aromatic carboxylic acid, while not being limited thereto. Preferred examples of the silver salt of the aliphatic carboxylic acid include silver behenate, silver arachidinate, silver stearate, silver oleate, silver laurate, silver caproate, silver myristate, silver palmitate, silver maleate, silver fumarate, silver tartrate, silver linoleate, silver butyrate, silver camphorate and mixtures thereof.

Among these organic acid silvers or mixtures of organic acid silvers, an organic acid silver containing 75 mol % of behenic acid silver is preferably used and an organic acid silver containing 85 mol % of behenic acid silver is more preferably used. As used herein, the term "content of behenic acid silver" refers to a mol fraction of behenic acid silver based on the organic acid silver used. As the organic acid silver other than behenic acid silver contained in the organic acid silvers used in the invention, the organic acid silvers listed above can be preferably used.

The organic acid silver is prepared by reacting an alkali metal salt (including Na salt, K salt or Li salt) solution or suspension of aforementioned organic acid with silver nitrate, particularly preferably. As the preparation method, the method described in the paragraph numbers [0019] to [0021] of Patent Application No. 11-104187 and the method described in EP-A1 No. 0962812. In the invention, the method of preparing an organic acid silver by adding an aqueous silver nitrate solution and an organic acid alkali metal salt solution in a closing means (mixing means including no vapor-liquid interface) for mixing a liquid is preferably used. Specifically, methods described in Japanese Patent Application Nos. 11-203413 and 2000-195621 can be used.

In the preparation of the organic acid silver, an aqueous silver nitrate solution and an organic acid alkali metal salt solution can be added, or a dispersant, which is soluble in water, can be added to the reaction solution. In the paragraph number [0052] of Japanese Patent Application, No. 11-115457, specific examples of the kind and amount of the dispersant used herein are described.

The organic acid silver is preferably prepared in the presence of a tertiary alcohol. As the tertiary alcohol, a compound having 15 or less carbon atoms in total is preferred and a compound having 10 carbon atoms are particularly preferred. Preferred tertiary alcohol include tert-butanol, but the tertiary alcohol used in present invention is not limited thereto. In this case, the tertiary alcohol may be added at any time in the preparation of the organic acid silver, but the organic acid alkali metal salt is preferably dissolved by adding the tertiary alcohol in the preparation of the organic acid alkali metal salt. The tertiary alcohol used in the invention can be used in a weight ratio within a range from 0.01 to 10, and preferably from 0.03 to 1, relative to water as a solvent in the preparation of the organic acid silver.

The shape and size of the organic silver salt, which can be used in the invention, are not specifically limited but those described in the paragraph number [0024] of Japanese Patent Application No. 11-104187 and those described in EP-A1 No. 0962812 are preferably used. The shape of the organic silver salt can be determined based on the image of organic silver salt dispersion observed with a transmission type electron microscope. Another method for determining the monodispersibility is such that obtaining the standard deviation of volume load average diameter of the organic silver salt. The percentage (coefficient of variation) of the value obtained by dividing the standard deviation by the volume load average diameter is preferably 80% or less, more preferably 50% or less, and still more preferably 30% or less. The measurement procedures include irradiating laser light to the organic silver salt dispersed in a solution, deriving an autocorrelation function with respect to the time-dependent fluctuation in the scattered light, and thereby obtaining grain size (volume load average diameter). The average grain size determined by this measurement procedure of the slid fine grain dispersion is preferably within a range from 0.05 to 10.0 $\mu$m. More preferably the average grain size is within a range from 0.1 to 5.0 $\mu$m, and still more preferably from 0.1 to 2.0 $\mu$m.

The organic silver salt that can be used in the invention is preferably desalted. The desalting method is not specifically limited and any known method may be used. Known filtration methods such as centrifugal filtration, suction filtration, ultrafiltration and flocculation washing by coagulation may be preferably used. As the ultrafiltration method, methods described in Japanese Patent Application Nos. 11-115457 and 2000-90093 can be used. In the invention, for the purpose of obtaining an organic silver salt solid dispersion having a high S/N ratio and a small grain size and being free from coagulation, a preferable example include a dispersion method comprising the steps of converting a water dispersion, that contains an organic silver salt as an image-forming medium and contains substantially no photosensitive silver salt, to a high-speed flow dispersion, and then releasing the pressure. As this dispersion method, the method described in the paragraph numbers [0027] to [0038] of Japanese Patent Application No. 11-104187 can be used.

The grain size distribution of the organic silver salt is preferably monodisperse. Specifically, the percentage (coefficient of variation) of the value obtained by dividing the standard deviation of the volume load average diameter by the volume load average diameter is preferably 80% or less, more preferably 50% or less, and still preferably 50% or less. The ratio of the organic solver salt to water is not specifically limited, but the amount of water is preferably within a range from 5 to 50% by weight, and particularly preferably from 10 to 30% by weight, based on entire organic acid salt. Aforementioned dispersion aid is preferably used, but is preferably used in an amount suited to make the grain size minimum. The amount is preferably within a range from 0.5 to 30% by weight, and particularly preferably from 1 to 15% by weight, based on the organic silver salt. The organic silver salt can be used in a desired amount and the amount of silver is preferably within a range from 0.1 to 5 g/m$^2$, and more preferably from 1 to 3 g/m$^2$.

Next, the binder will be explained.

The binder is used in the image-forming layer (e.g. photosensitive layer and emulsion layer) of the same side as the surface provided with the photosensitive silver halide and reducible silver salt on the substrate and, specifically, arbitrary one can be selected from well-known natural or synthetic resins, for example, gelatin, polyvinyl acetal, polyvinyl chloride, polyvinyl acetate, cellulose acetate, polyolefin, polyester, polystyrene, polyacrylonitrile, and polycarbonate. As a matter of course, copolymers and terpolymer are also included. Preferred polymers are polyvinyl butyral, butylethylcellulose, methacrylate copolymers, anhydrous maleate ester copolymer, polystyrene, and bytadiene-styrene copolymer. These polymers may be used individually or, as required, as a blend of two or more thereof. These polymers may be used in the amount enough to retain the components therein. That is, these polymers are used in the amount that is effective to function as the binder. The effective range can appropriately be selected by those skilled in the art. To retain at least the organic silver salt, a ratio of the binder to the organic silver salt is preferably within a range from 15:1 to 1:2, and particularly from 8:1 to 1:1.

In the invention, at least one layer among image-forming layers preferably contains, as the binder, a polymer latex described hereinafter in the amount of 50% by weight or more based on entire binder. (hereinafter this binder is referred to as an "image-forming layer in the invention", while a polymer latex used as the binder is referred to as a "polymer latex used in the invention). The polymer latex may be used not only in the image-forming layer, but also in a protective layer and a backing layer, in addition to. Particularly, when using the heat-developable photosensitive material of the invention in printing application where dimensional change will raise a critical problem, the polymer latex must be used in the protective layer and the backing layer. As used herein, the term "polymer latex" is that prepared by dispersing a water-soluble hydrophobic polymer in a water-dispersible dispersion medium in the form of fine grains. The polymer latex may have any form of a polymer emulsified in dispersion medium, emulsion-polymerized or dispersed as micells; or the polymer can be dispersed so that its molecular chain per se disperses when the polymer has, in a part of its body, some hydrophilic structure. Such water-dispersions are generally noted as polymer latex in a broad sense. Details for the polymer latex are found, for example, in "Gosei Jushi Emulsion (Synthetic Resin Emulsion)", ed. by Taira OKUDA and Hiroshi INAGAKI, issued by Kobunshi Kanko Kai (1978); "Gosei Latex no O-yo (Applications of Synthetic Latex)", ed. by Takaaki SUGIMURA, Yasuo KATAOKA, Souichi SUZUKI and Keiji KASAHARA, issued by Kobunshi Kanko Kai (1993); and Soichi MUROI, "Gosei Latex no Kagaku (Chemistry of Synthetic Latex)", issued by Kobunshi Kanko Kai (1970). The dispersed particles preferably have an average particle size of 1 to 50,000 nm, and more preferably about 5 to 1,000 nm. The particle size distribution of the dispersed particles is not specifically limited, and the dispersed particles may have a broad particle size distribution or a monodisperse particle size distribution.

As the water-dispersed thermoplastic resin for use in the invention, not only an ordinary uniform-structured polymer latex, but also a so-called core/ shell type latex are available. In some cases, it is preferred that the core and the shell have different glass transition temperatures. Preferable range of the glass transition temperature (Tg) of the thermoplastic resin used as the binder in the invention differ according to its use for the protective layer, back layer or image-forming layer. For use in the image-forming layer, the glass transition temperature is preferably 40° C. or lower, and more preferably from −30 to 40° C., so that the photographically useful material can acceleratingly disperse at the time of heat development. For use in the protective layer and back layer, a glass transition temperature of 25 to 70° C. is preferable since the layers come into contact with various kinds of equipment.

The polymer latex for use in the invention preferably has a minimum film-forming temperature (MFT) of from −30 to 90° C., more preferably from 0 to 70° C. In order to control the MFT, a film-forming aid may be added. The film-forming aid, also called a temporary plasticizer, refers to an organic compound (usually an organic solvent) capable of lowering the MFT of the polymer latex, which is described in "Gosei Latex no Kagaku (Chemistry of Synthetic Latex)", by Souichi MUROI, issued by Kobunshi Kanko Kai (1970), supra. The polymer species of the polymer latex for use in the invention include acrylic resin, vinyl acetate resin, polyester resin, polyurethane resin, rubber-based resin, vinyl chloride resin, vinylidene chloride resin, polyolefin resin or copolymers thereof. The polymer may be a straight-chain polymer, a branched polymer or a cross-linked polymer. The polymer may be a so-called homopolymer consisting of a single kind of monomer or may be a copolymer consisting of two or more kinds of monomers. Both of random copolymer and block copolymer are allowable as the copolymer. The polymer preferably has a number average molecular weight of from 5,000 to 1,000,000, and more preferably from 10,000 to 100,000. Too small molecular weight will result in poor mechanical strength of the image-forming layer, whereas too large in degraded and undesirable film-forming property.

Specific examples of the polymer latex used as the binder of the image-forming layer in the invention include methyl methacrylate/ethyl acrylate/methacrylic acid copolymer latex, methyl methacrylate/2-ethylhexyl acrylate/styrene/acrylic acid copolymer latex, styrene/butadiene/acrylic acid copolymer latex, styrene/butadiene/divinylbenzene/methacrylic acid copolymer latex, methyl methacrylate/vinyl chloride/acrylic acid copolymer latex, and vinylidene chloride/ethyl acrylate/acrylonitrile/methacrylic acid copolymer latex. Such polymers are also commercially available, which include acrylic resins such as CEBIAN A-4635, 46583 and 4601 (all manufactured by Dicel Chemical Industries Co., Ltd.) and Nipol Lx811 ,814, 821, 820, 857 (all manufactured by Nippon Zeon Co., Ltd.); polyester resins such as FINETEX ES650, 611, 675, 850 (all manufactured by Dai-Nippon Ink & Chemicals, Inc.), WD-size and WMS (both manufactured by Eastman Chemical); polyurethane resins such as HYDRAN AP10, 20, 30, 40 (all manufactured by Dai-Nippon Ink & Chemicals, Inc.); rubber-based resins such as LACSTAR 7310K, 3307B, 4700H, 7132C (all manufactured by Dai-Nippon Ink & Chemicals, Inc.), Nipol Lx416, 410, 438C and 2507 (all manufactured by Nippon Zeon Co., Ltd.); vinyl chloride resins such as G351, G576 (both manufactured by Nippon Zeon Co., Ltd.); vinylidene chloride resins such as L502, L513 (both manufactured by Asahi Chemical Industry Co., Ltd.), ARON D7020, D504 and D5071 (all manufactured by Mitsui Toatsu Chemical Co., Ltd.); and olefin resins such as CHEMIPEARL S120 and SA100 (both manufactured by Mitsui Chemical Co., Ltd.). These polymers may be used individually or, as required, as a blend of two or more thereof.

In the image-forming layer of the invention, the polymer latex preferably accounts for 50% by weight or more of the total binder, and more preferably 70% by weight or more.

The total amount of the binder in the image-forming layer of the invention is within a range from 0.2 to 30 g/m$^2$, and more preferably from 1 to 15 g/m$^2$. To the image-forming layer, cross-linking agents for cross-linking and surfactants for improving the coatability may be added.

To the image-forming layer in the invention, it is allowable to add, as required, hydrophilic polymer such as gelatin, polyvinyl alcohol, methyl cellulose, hydroxypropyl cellulose, carboxymethyl cellulose, and hydroxypropylmethyl cellulose, in the amount of 50% by weight or less. The amount of addition of these hydrophilic polymers is preferably 30% by weight or less of the total binder of the image-forming layer, and more preferably 5% by weight or less.

It is preferable that the image-forming layer in the invention is formed by coating water-based liquid, which is followed by drying. As used herein, "water-based" in the context of the invention refers to that water accounts for 60% by weight or more of the solvent (dispersion medium) of the coating liquid. Possible component other than water may be water-miscible organic solvent such as methanol, ethanol, isopropanol, methylcellosolve, ethylcellosolve, dimethylformamide and ethyl acetate. Specific examples of the solvent composition include water/methanol=90/10, water/methanol=70/30, water/ethanol=90/10, water/isopropanol=90/10, water/ dimethylformamide=95/5, water/methanol/dimethylformamide=80/15/5 and water/methanol/dimethylformamide=90/5/5 (the numerals are in % by weight).

Next, the substrate will be explained.

Various substrates can be used as the substrate. Typical substrates include polyester film, undercoat polyester film, poly(ethylene terephthalate) film, poly(ethylene naphthalate) film, cellulose nitrate film, cellulose ester film, poly(vinyl acetal) film, polycarbonate film and related resin material, glass, paper and metal. Typically used are flexible materials, in particular, partially acetylated paper substrate; and paper substrate coated with baryta and/or α-olefin polymer; the α-olefin polymer being, in particular, a polymer of α-olefin with a carbon number of 2 to 10, such as polyethylene, polypropylene and ethylene-butene copolymer. Both of transparent and opaque substrates are allowable, the former being more preferable. Among these, exceptionally preferable is polyethylene terephthalate (PFT) film of 75 to 200 μm thick processed by biaxial stretching.

In general, plastic film will alter its dimension when passed through a heat developing apparatus for processes at 80° C. or higher. Such dimensional change will raise a critical problem in precision multicolor printing when the processed film is used for printing plate making. It is therefore preferable in the invention to use a film with less dimensional change devised so that the residual internal distortion in the film is relieved during the biaxial stretching to prevent distortion by heat shrinking during the heat development. Preferably used is a polyethylene terephthalate film subjected to heat treatment at 100 to 210° C. before the photosensitive silver halide emulsion (heat-developable photosensitive emulsion) is coated thereon. Materials with high glass transition temperatures are also preferably used, and such materials include polyether ethyl ketone, polystyrene, polysulfone, polyethersulfone, polyarylate and polycarbonate.

In the case of the medical heat-developable photosensitive material, a transparent substrate may be colored with a blue dye (e.g. dye-1 described in Examples of JP-A No. 8-240877) or not colored. To the substrate, techniques of undercoating a water-soluble polyester of JP-A No. 11-84574, a styrene-butadiene copolymer of JP-A No. 10-186565, and a vinylidene chloride copolymer described in the paragraph numbers [0063] to [0080] of Japanese Patent Application No. 11-106881 are preferably applied. To the antistatic layer or undercoat, techniques described in JP-A Nos. 56-143430, 56-143431, 58-62646, 56-120519, the paragraph numbers [0040] to [0051] of JP-A No. 11-84573, U.S. Pat. No. 5,575,957, and the paragraph numbers [0078] to [0084] of JP-A No. 11-223898 can be applied.

Next, additives and layer constitutions will be explained.

The photosensitive silver halide and/or reducible silver salt for use in the heat-developable photosensitive material of the invention can successfully be prevented, by addition of already-known antifoggants and stabilizer precursor, from additional fogging and from lowered sensitivity during the stock storage. Appropriate examples of proper antifoggants, stabilizers and stabilizer precursors, available individually or in combination, include thiazonium salts described in U.S. Pat. Nos. 2,131,038 and 2,694,716; azaindenes described in U.S. Pat. Nos. 2,886,437 and 2,444,605; mercury salts described in U.S. Pat. No. 2,728,663; urazoles described in U.S. Pat. No. 3,287,135; sulfocatechol described in U.S. Pat. No. 3,235,652; oximes, nitrons and nitroindazoles described in British Patent No. 623,448; polyvalent metal salts described in U.S. Pat. No. 2,839,405; thiuronium salts described in U.S. Pat. No. 3,220,839; palladium, platinum and gold salts described in U.S. Pat. No. 2,566,263 and U.S. Pat. No. 2,597,915; halogen-substituted organic compounds described in U.S. Pat. Nos. 4,108,665 and 4,442,202; triazines described in U.S. Pat. Nos. 4,128,557, 4,137,079, 4,138,365 and 4,459,350; and phosphorus compounds described in U.S. Pat. No. 4,411,985.

The antifoggant which is preferably used in the invention is organic halide, and the typical compounds are disclosed in JP-A Nos. 50-119624, 50-120328, 51-121332, 54-58022, 56-70543, 56-99335, JPA-59-90842, 61-129642, 62-129845, 6-208191, 7-5621, 7-2781, 8-15809 and U.S.

Pat. Nos. 5,340,712, 5,369,000 and 5,464,737. Among these compounds, an organic polyhalogen compound represented by the following general formula (4) is particularly preferred.

$$Q^2\text{-}(Y)n\text{-}CZ^1Z^2X \qquad \text{Formula (4)}$$

In the general formula (4), $Q^2$ represents an alkyl group, aryl group or heterocycle group, which may have a substituent.

The alkyl group represented by $Q^2$ is a straight-chain, branched, cyclic or combined alkyl group, and preferably has 1 to 20 carbon atoms, more preferably 1 to 12 carbon atoms, and still more preferably 1 to 6 carbon atoms. Examples thereof include methyl, ethyl, allyl, n-propyl, isopropyl, sec-butyl, isobutyl, t-butyl, sec-pentyl, isopentyl, t-pentyl, t-octyl, and 1-methylcyclohexyl. Preferred is a tertiary alkyl group.

The alkyl group represented by $Q^2$ may have a substituent and the substituent may be any group as far as it does not exert an adverse influence on photographic performance. Examples thereof include halogen atom (fluorine atom, chlorine atom, bromine atom, or iodine atom), alkyl group, alkenyl group, alkynyl group, aryl group, heterocycle group (including N-substituted nitrogen-containing heterocycle group such as morpholino group), alkoxycarbonyl group, aryloxycarbonyl group, carbamoyl group, imino group, imino group substituted with an N atom, thiocarbonyl group, carbazoyl group, cyano group, thiocarbamoyl group, alkoxy group, aryloxy group, heterocycle oxy group, acyloxy group, (alkoxy or aryloxy)carbonyloxy group, sulfonyloxy group, acylamide group, sulfoamide group, ureido group, thioureido group, imide group, (alkoxy or aryloxy) carbonylamino group, sulfamoylamino group, semicarbazide group, thiosemicarbazide group, (alkyl or aryl) sulfonylureido group, nitro group, (alkyl or aryl)sulfonyl group, sulfamoyl group, group having an amide phosphate or phosphate ester structure, silyl group, carboxyl group or a salt thereof, sulfo group or a salt thereof, phosphoric acid group, hydroxy group, and quaternary ammonium group. These substituents may be further substituted with these substituents.

The aryl group represented by $Q^2$ is a monocyclic or condensed ring aryl group, and preferably has 6 to 20 carbon atoms, more preferably 6 to 16 carbon atoms, and still more preferably 6 to 10 carbon atoms. Preferred is a phenyl group or a naphthyl group.

The aryl group represented by $Q^2$ may have a substituent and the substituent may be any group as far as it does not exert an adverse influence on photographic performance. Examples thereof include the same groups as those listed as the substituent of the alkyl group.

The heterocycle of the heterocycle group represented by $Q^2$ is preferably a 5- to 7-membered saturated or unsaturated monocyclic or condensed ring containing at least one hetero atom selected from the group consisting of nitrogen, oxygen and sulfur atoms. Examples of the heterocycle are preferably pyridine, quinoline, isoquinoline, pyrimidine, pyrazine, pyridazine, phthalazine, triazine, furan, thiophene, pyrrole, benzoxazole, thiazole, benzothiazole, imidazole, thiadiazole, and triazole, more preferably pyridine, quinoline, pyrimidine, thiaziazole, and benzothiazole, and particularly preferably pyridine, quinoline, and pyrimidine.

The heterocycle group represented by $Q^2$ may have a sub stituent.

In the general formula (4), $Q^2$ is preferably a phenyl group, a naphthyl group, a quinolyl group, a pyridyl group, a pyrimidyl group, a thiadiazolyl group, or a benzothiazolyl group, and particularly preferably a phenyl group, a naphthyl group, a quinolyl group, a pyridyl group, and a pyrimidyl group.

It also may have a balast group, an adsorbing group to a silver salt or a group capable of impairing the water solubility used in the photographic material in order to lower the diffusibility as the substituent of $Q^2$. Alternatively, they may be combined with each other to form a polymer, or substituents may be combined to form a bis, tris or tetrakis type.

In the general formula (4), Y represents a divalent linking group, preferably $SO_2$—, —SO—, or —CO—, and particularly preferably $SO_2$—.

In the general formula (4), n represents 0 or 1, and preferably 1.

In the general formula (4), $Z^1$ and $Z^2$ each independently represents a halogen atom (e.g. fluorine, chlorine, bromine, or iodine), and most preferably both $Z^1$ and $Z^2$ are bromine atoms.

In the general formula (4), X represents a hydrogen atom or an electron withdrawing group. The electron withdrawing group represented by X is a functional group having a Hammett's functional group constant $\delta p$ of a positive value, and specific examples thereof include cyano group, alkoxycarbonyl group, aryloxycarbonyl group, carbamoyl group, sulfamoyl group, alkylsulfonyl group, arylsulfonyl group, halogen atom, acyl group, and heterocycle group. X is preferably a hydrogen atom or a halogen atom, and most preferably a bromine atom.

Examples of the organic polyhalogen compound represented by the general formula (4) include compounds described in U.S. Pat. Nos. 3,874,946, 4,756,999, 5,340,712, 5,369,000, 5,464,737, JP-A Nos. 50-137126, 50-89020, 50-119624, 59-57234, 7-2781, 7-5621, 9-160164, 10-197988, 9-244177, 9-244178, 9-160167, 9-319022, 9-258367, 9-265150, 9-319022, 10-197989, 11-242304, Japanese Patent Application Nos. 10-181459, 10-292864, 11-90095, 11-89773, and 11-205330.

Organic polyhalogen compounds represented by the general formula (4) may be used alone or in any combination. The coating weight is preferably within a range from $1\times10^{-6}$ to $1\times10^{-2}$ mol/m$^2$, more preferably from $1\times10^{-5}$ to $5\times10^{-3}$ mol/m$^2$, and still more preferably from $2\times10^{-5}$ to $1\times10^{-3}$ mol/m$^2$, per m$^2$ of the heat-developable photosensitive material.

The organic polyhalogen compound represented by the general formula (4) may be added to any layers on a substrate provided on the same surface as layers containing the aforementioned photosensitive silver halide and the reducible silver salt are present. However, it is preferably added to a layer containing the silver halide or a layer adjacent thereto.

The organic polyhalogen compound represented by the general formula (4) can be used as a solution prepared by dissolving in water or a proper organic solvent, for example, alcohols (e.g. methanol, ethanol, propanol, fluorinated alcohol), ketones (e.g. acetone, methyl ethyl ketone, ethyl isobutyl ketone), dimethylformamide, dimethyl sulfoxide, or methylcellosolve. Alternatively, the compound may also be used as an emulsified dispersion mechanically prepared used in a form of emulsified dispersion obtained mechanically by the well-known emulsifying dispersion method by which the compounds are dissolved in oil such as dibutyl phthalate, tricresyl phosphate, glyceryl triacetate and diethyl phthalate; or in auxiliary solvent such as ethyl acetate and cyclohexanone. Alternative method relates to the solid dispersion method by which powders of the compounds are dispersed into water with aid of a ball mill, colloid mill, sand grinder mill, MANTON GAULIN, micro-fluidizer or ultrasonic wave.

Preferred examples of the organic polyhalogen compound represented by the general formula (4) include are listed below, but the organic polyhalogen compounds used in the invention are not limited thereto.

(P-1)

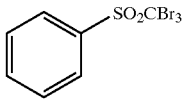

(P-2)

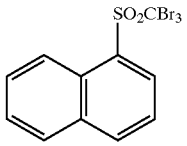

(P-3)

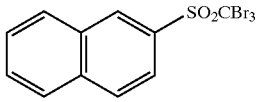

(P-4)

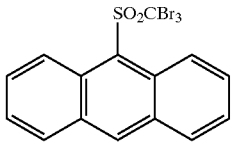

(P-5)

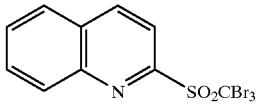

(P-6)

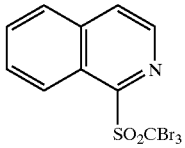

(P-7)

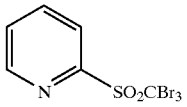

(P-8)

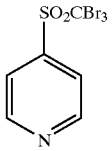

-continued (P-9)

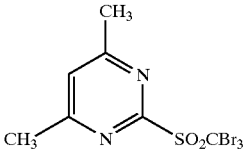

(P-10)

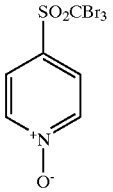

(P-11)

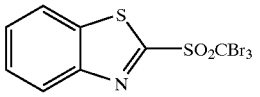

(P-12)

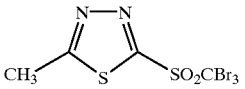

(P-13)

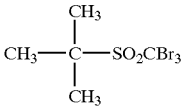

(P-14)

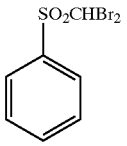

(P-15)

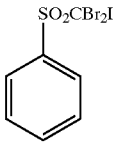

(P-16)

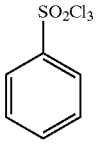

(P-17)

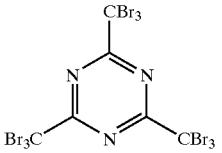

(P-18)

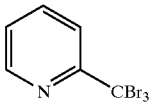

-continued
(P-19)
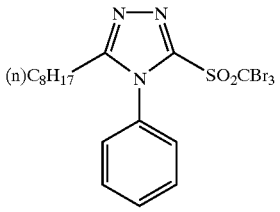
(P-20)
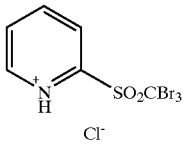
(P-21)
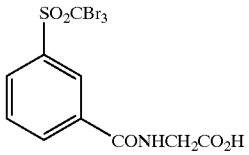
(P-22)
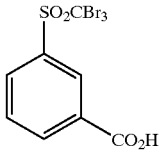
(P-23)
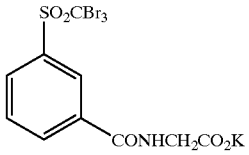
(P-24)
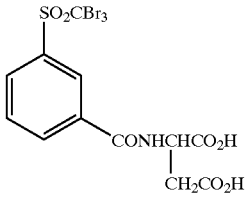
(P-25)
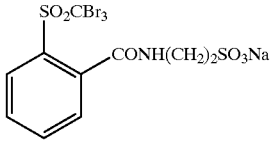
(P-26)
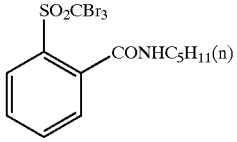
(P-27)
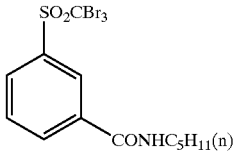
-continued
(P-28)
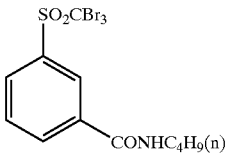
(P-29)
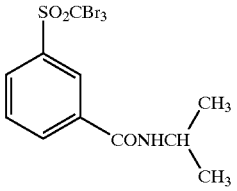
(P-30)
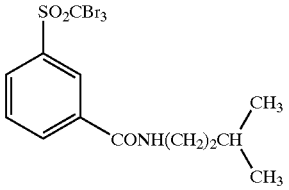
(P-31)
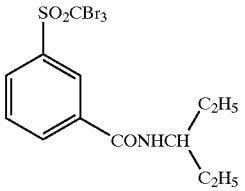
(P-32)
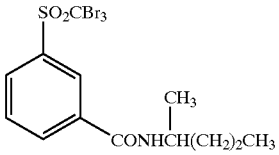
(P-33)
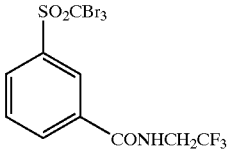
(P-34)
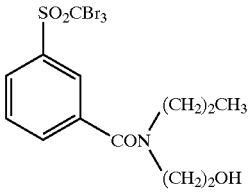
(P-35)
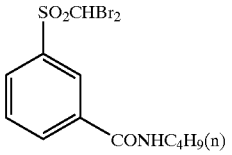
(P-36)
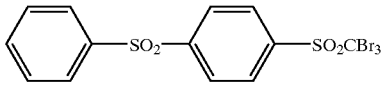

-continued (P-37)

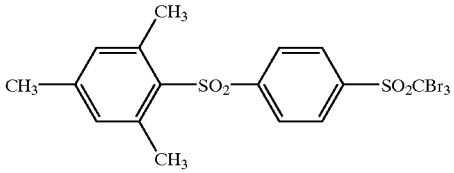

(P-38)

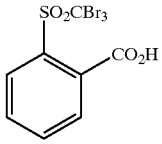

(P-39)

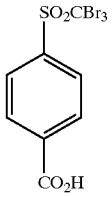

(P-40)

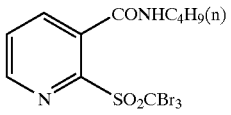

Although not necessary for practicing the invention, it is advantageous in some cases to add a mercury (II) salt as an antifoggant to the emulsion layer. Preferred mercury (II) salts to this purpose are mercury acetate and mercury bromide.

The heat-developable photosensitive material of the invention may contain benzoic acids for improving the sensitivity and for preventing fog. Any kind of benzoic acid derivatives are available for the invention, where preferred examples of the structure include those described in U.S. Pat. Nos. 4,784,939 and 4,152,160 and JP-A Nos. 9-329863, 9-329864 and 9-281637.

The amount of addition of the benzoic acids can arbitrarily set, where a preferable range being from 1 to 2 mol, and more preferably from 1 to 0.5 mol, per mol of silver. The benzoic acids may be added in any form of solution, powder or slid fine grain dispersion. It is also allowable to add the benzoic acids in a form of mixed solution containing other additives such as a sensitizing dye, reducing agent and color-tone adjustor. The benzoic acids may be added at any step during the preparation of the coating liquid. In the case of addition to the organic silver salt-containing layer, the benzoic acids may be added at any step within a period from the preparation of the organic silver salt to the preparation of the coating liquid, where addition in a period following the preparation of the organic silver salt and immediately before the coating is preferable.

In the heat-developable photosensitive material of the invention, compounds called as "color-tone adjustor" can be added, as required, to improve the image density of the silver image, color tone of silver and the heat developability.

Particularly in the heat-developable photosensitive material utilizing the organic silver salt of the invention, a wide variety of color-tone adjustors can be used. For example, color-tone adjustors are disclosed in JP-A Nos. 46-6077, 47-10282, 49-5019, 49-5020, 49-91215, 50-2524, 50-32927, 50-67132, 50-67641, 50-114217, 51-3223, 51-27923,52-14788, 52-99813, 53-1020, 53-76020, 54-156524, 54-156525, 61-183642, 4-56848, JP-B Nos. 49-10727, 54-20333, U.S. Pat. Nos. 3,080,254, 3,446,648, 3,782,941, 4,123,282 and 4,510,236, British Patent No. 1,380,795, Belgian Patent No. 841910, and Japanese Patent Application Publication (JP-B) No. 1-25050.

These color-tone adjustors have been researched in view of required performances (image density, silver color tone and improvement in heat development), properties such as volatility and sublimability from the photosensitive material, and propitious of the photosensitive material when used in combination for other additives such as antifoggants, and thus a lot of color-tone adjustors have been reported. It is known that a combination of phthalazines and phthalic acid derivatives is excellent among these color-tone adjustors.

Preferred examples of the phthalazine compound and its production are disclosed in JP-A Nos. 10-339928, 10-339930, 10-339931, 10-332234, 11-52511, 13-2660, and 13-19679.

The amount of the phthalazine compound is preferably within a range from $10^{-4}$ to 1 mol, more preferably from $10^{-3}$ to 0.3 mol, and still more preferably from $10^{-4}$ to 0.3 mol, per mol of silver.

The phthalazine compound may be added in any form of solution, powder, slid fine grain dispersion, emulsion or oil-protected dispersion. Dispersion of the solid microparticle is effected using a known pulverizing means (e.g. ball mill, vibrating ball mill, sand mill, colloid mill, jet mill and roller mill). A dispersion aid may be available for dispersing the solid microparticle.

The phthalazine compound may be added to any layers on a substrate provided on the same surface as layers containing the aforementioned photosensitive silver halide and the reducible silver salt are present. However, it is preferably added to a layer containing the silver halide or a layer adjacent thereto.

In the heat-developable photosensitive material of the invention, a base required generally in a treatment of a photographic photosensitive material can be fed by a base feeding method. For example, in case of imparting a base generating function to the photosensitive material side, a base precursor can be introduced into the photosensitive material. Examples of the base precursor include salts of organic acids and bases, which are decarboxylated through heat, and compounds capable of releasing amines through intramolecular nucleophilic substitution reaction, Lossen rearrangement or Beckmann rearrangement. Examples thereof are described in U.S. Pat. Nos. 4,514,493 and 4,657,848.

In the heat-developable photosensitive material of the invention, an ultrahigh-contrast agent is preferably used. The ultrahigh-contrast agent used in the invention is not specifically limited, and examples of preferred ultrahigh-contrast agent include hydrazine derivative represented by the formula (H) described in the specification of Japanese Patent Application No. 11-87297 (e.g. hydrazine derivatives described in Table 1 to Table 4 in the same specification) and all hydrazine derivatives described in JP-A Nos. 10-10672, 10-161270, 10-62898, 9-304870, 9-304872, 9-304871, 10-31282, U.S. Pat. No. 5,496,695 and EP-A No. 741,320.

Also a substituted alkene derivative, a substituted isoxazole derivative and a specific acetal compound, which are represented by the general formulae (1) to (3) described in the specification of Japanese Patent Application No. 2000-284399, and more preferably cyclic compounds represented by the formulae (A) and (B) described in the same specification, for example, compounds 1 to 72 described in Chemical Formulas 8 to 12 described in the same specification can be used. These ultrahigh-contrast agents may be used in any combination.

The ultrahigh-contrast agent can be used as a solution prepared by dissolving in water or a proper organic solvent, for example, alcohols (e.g. methanol, ethanol, propanol, fluorinated alcohol), ketones (e.g. acetone, methyl ethyl ketone), dimethylformamide, dimethyl sulfoxide, or methylcellosolve.

Alternatively, the ultrahigh-contrast agent may also be used as an emulsified dispersion mechanically prepared according to an already well known emulsification dispersion method by using an oil such as dibutyl phthalate, tricresyl phosphate, glyceryl triacetate or diethyl phthalate, ethyl acetate or cyclohexanone as an auxiliary solvent for dissolution. Alternatively, the ultrahigh-contrast agent may be used after dispersion of a powder of the compound in a proper solvent such as water by using a ball mill, a colloid mill, or by means of ultrasonic wave according to a known method for solid dispersion.

The ultrahigh-contrast agent may be added to any layers on a substrate provided on the same surface as the image-forming layer. However, it is preferably added to the image-forming layer or a layer adjacent thereto.

The additive amount of the ultrahigh-contrast agent is preferably within a range from $1\times10^{-6}$ to 1 mol, more preferably from $1\times10^{-5}$ to $5\times10^{-1}$ mol, and more most preferably from $2\times10^{-5}$ to $2\times10^{-1}$ mol, per mol of silver.

In addition to aforementioned compounds, compounds described in U.S. Pat. Nos. 5,545,515, 5,635,339, 5,654,130, International Patent Publication WO97/34196 and U.S. Pat. No. 5,686,228 and compounds described in JP-A Nos. 11-119372, 11-133546, 11-119373, 11-109546, 11-95365, 11-95366 and 11-149136 may be used as the ultrahigh-contrast agent.

In the heat-developable photosensitive material of the invention, a contrast accelerator may be used in combination with aforementioned nucleating agent for the formation of an ultrahigh-contrast image. For example, amine compounds described in U.S. Pat. No. 5,545,505, specifically, AM-1 to AM-5; hydroxamic acids described in U.S. Pat. No. 5,545,507, specifically, HA-1 to HA-11; acrylonitriles described in U.S. Pat. No. 5,545,507, specifically, CN-1-CN-13; hydrazine compounds described in U.S. Pat. No. 5,558,983, specifically, CA-1 to CA-6; and onium salts described in JP-A No. 9-297368, specifically, A-1 to A-42, B-1 to B-27 and C-1 to C-14 may be used.

In the heat-developable photosensitive material of the invention, formic acid or a formate serves as a strong fogging agent. In the invention, the content of formic acid or a formate in the side having an image-forming layer containing the photosensitive silver halide in the heat-developable photosensitive material is preferably 5 mmol or less, and more preferably 1 mmol or less, per mol of silver.

In the heat-developable photosensitive material of the invention, an acid formed by hydration of diphosphorus pentoxide or a salt thereof is preferably used in combination with the ultrahigh-contrast agent. Examples of the acid formed by hydration of diphosphorus pentoxide or a salt thereof include metaphosphoric acid (salt), pyrophosphoric acid (salt), orthophosphoric acid (salt), triphosphoric acid (salt), and tetraphosphoric acid (salt), hexametaphosphoric acid (salt). Particularly preferably used acids formed by hydration of diphosphorus pentoxide or salts thereof are orthophosphoric acid (salt) and hexametaphosphoric acid (salt). Specific examples of the salt are sodium orthophosphate, sodium orthodihydrogenphosphate, sodium hexametaphosphate, and ammonium hexametaphosphate.

The acid formed by hydration of diphosphorus pentoxide or a salt thereof that can be preferably used for the invention is added to the image-forming layer or a binder layer adjacent thereto in order to obtain the desired effect with a small amount.

The acid formed by hydration of diphosphorus pentoxide or a salt thereof may be used in a desired amount (coating amount per square meters of the photosensitive material) depending on the desired performance including sensitivity and fog, preferably in an amount witin a range from 0.1 to 500 $mg/m^2$, and more preferably from 0.5 to 100 $mg/m^2$.

The heat-developable photosensitive material of the invention may contain a mercapto compound, a disulfide compound or a thione compound, for example, to control the development by inhibition or acceleration, to improve spectral sensitization efficiency, and to improve storage stability before or after the development.

When a mercapto compound is used in the invention, a mercapto compound having any chemical structure may be used, and those represented by Ar—SMO or Ar—S—S—Ar are preferred, wherein M is hydrogen atom or an alkali metal atom, and Ar is an aromatic ring or condensed aromatic ring containing one or more nitrogen, sulfur, oxygen, selenium or tellurium atoms. Preferably, the heteroaromatic ring may be benzimidazole, naphthimidazole, benzothiazole, naphthothiazole, benzoxazole, naphthoxazole, benzoselenazole, benzotellurazole, carbazole, imidazole, oxazole, pyrazole, triazole, thiadiazole, tetrazole, triazine, pyrimidine, pyridazine, pyrazine, pyridine, purine, quinoline and quinazolinone.

The heteroaromatic ring may have a substituent selected from, for example, the group consisting of halogen (e.g. Br, Cl), hydroxyl, amino, carboxyl, an alkyl group (e.g. alkyl having one or more carbon atoms, preferably from 1 to 4 carbon atoms), an alkoxy group (e.g. alkoxy having one or more carbon atoms, preferably from 1 to 4 carbon atoms), and an aryl group (which may have one or more substituents). Examples of the mercapto substituted heteroaromatic compound include, but are not limited to, 2-mercaptobenzimidazole, 2-mercaptobenzoxazole, 2-mercaptobenzothiazole, 2-mercapto-5-methylbenzimidazole, 6-ethoxy-2-mercaptobenzothiazole, 2, 2-dithiobis(benzothiazole), 3-mercapto-1,2,4-triazole, 4,5-diphenyl-2-imidazolethiol, 2-mercaptoimidazole, 1-ethyl-2-mercaptobenzimidazole, 2-mercaptoquinoline, 8-mercaptopurine, 2-mercapto-4(3H)-quinazolinone, 7-trifluoromethyl-4-quinolinethiol, 2,3,5,6-tetrachloro-4-pyridinethiol, 4-amino-6-hydroxy-2-mercaptopyrimidine monohydrate, 2-amino-5-mercapto-1,3,4-thiadiazole, 3-amino-5-mercapto-1,2,4-triazole, 4-hydroxy-2-mercaptopyrimidine, 2-mercaptopyrimidine, 4,6-diamino-2-mercaptopyrimidine, 2-mercapto-4-methyl-pyrimidine hydrochloride, 3-mercapto-5-phenyl-1,2,4-triazole, 1-phenyl-5-mercaptotetrazole, sodium 3-(5-mercaptotetrazole)benzenesulfonate, N-methyl-N-{3-(5-mercaptotetrazolyl)phenyl}urea, 2-mercapto-4-phenyloxazole, and N-[3-(mercaptoacetylamino)propyl] carbazole.

The amount of the mercapto compound may preferably be from 0.0001 to 1.0 mol, and more preferably from 0.001 to 0.3 mol, per mole of silver in the image-forming layer.

The image-forming layer (photosensitive layer) for use in the heat-developable photosensitive material of the invention may contain, as a plasticizer or a lubricant, polyhydric alcohols (for example, glycerins and diols described in U.S. Pat. No. 2,960,404), fatty acids or esters described in U.S. Pat. Nos. 2,588,765 and 3,121,060, and silicone resins described in British Patent No. 955,061.

The image-forming layer for use in the heat-developable photosensitive material of the invention may contain a dye or a pigment of various types to improve color tone or prevent irradiation. Any dye or pigment may be used in the photosensitive layer for use in the invention, and examples thereof include pigments and dyes described in the color index. Specific examples thereof include organic pigments and inorganic pigments such as pyrazoloazole dyes, anthraquinone dyes, azo dyes, azomethine dyes, oxonol dyes, carbocyanine dyes, styryl dyes, triphenylmethane dyes, indoaniline dyes, indophenol dyes and phthalocyanines. Preferred examples of the dye for use in the invention include anthraquinone dyes (e.g. compounds 1 to 9 described in JP-A No. 5-341441, compounds 3-6 to 3-18 and 3-23 to 3-38 described in JP-A No. 5-165147), azomethine dyes (e.g. compounds 17 to 47 described in JP-A No. 5-341441), indoaniline dyes (e.g. compounds 11 to 19 described in JP-A No. 5-289227, compound 47 described in JP-A No. 5-341441, compounds 2-10 and 2-11 described in JP-A No. 5-165147) and azo dyes (compounds 10 to 16 described in JP-A No. 5-341441).

The amount of the compound may be determined depending on a desired amount of absorption. In general, the compound is preferably used in an amount of from 1 mg to 1 g per square meter of the photosensitive material. These dyes may be added in any form, for example, as a solution, emulsified product or solid fine grain dispersion, or as a dye mordanted with a polymer mordant.

The heat-developable photosensitive material of the invention may have a surface protective layer for preventing adhesion of the image-forming layer.

Any kind of polymer is available for a binder contained in the surface protective layer in the heat-developable photosensitive material of the invention, where it is preferable that a polymer having carboxylic acid residues is used at an amount from 100 to 5 g/m$^2$. The polymers having carboxylic acid residues described herein include natural polymers (e.g. gelatin, arginic acid); modified natural polymers (e.g. carboxymethylcellulose, phthalized gelatin); and synthetic polymers (e.g. polymethacrylate, polyacrylate, polyalkylmethacrylate/acrylate copolymer, polystyrene/polymethacrylate copolymer). The content of the carboxylic acid residues in these polymers is preferably within a range from 10 to 1.4 mmol per 100 g of the polymer. The carboxylic acid residues can form salts with, for example, alkali metal ion, alkali earth metal ion and organic cation.

Any kind of adhesion preventive material is available for the surface protective layer in the invention. Examples of the adhesion preventive material include wax; silica particle; styrene-containing elastomeric block copolymer (e.g. styrene-butadiene-styrene, styrene-isoprene-styrene); cellulose acetate; cellulose acetate butylate; cellulose propionate; and mixtures thereof. The surface protective layer may also contain a crosslinking agent for crosslinking, and surfactant for improving coating property.

The image-forming layer and the protective layer thereof in the heat-developable photosensitive material of the invention may contain a photographic element comprising a light absorbing substance and filter dye as described in U.S. Pat. Nos. 3,253,921, 2,274,782, 2,527,583 and 2,956,879. It is also allowable to dye through mordanting as described, for example, in U.S. Pat. No. 3,282,699. The filter dye is preferably used in an amount so as to attain an absorbance of 0.1 to 3, and more preferably 0.2 to 1.5.

In the heat-developable photosensitive material of the invention, the photosensitive image-forming layer or non-photosensitive layer adjacent theerto may contain various dyes and pigments (e.g. C.I. Pigment Blue 60, C.I. Pigment Blue 64, and C.I. Pigment Blue 15:6) so as to improve the color tone or prevent generation of interference fringe upon exposure to laser and irradiation. These dyes and pigments are described in detail in International Patent Publication WO98/36322, JP-A Nos. 10-268465 and 11-338098.

The heat-developable photosensitive material of the invention is preferably a so-called single-sided photosensitive material comprising a substrate having on one side thereof at least one photosensitive layer (preferably image-forming layer) containing a silver halide emulsion and on the other side thereof a backing layer.

In the invention, the backing layer preferably has a maximum absorption of from about 0.3 to 2.0 in a desired wavelength range. Where the desired range is from 750 to 1,400 nm, the backing layer may preferably have an optical density of from 0.005 to less than 0.5 at from 360 to 750 nm, and more preferably act as an antihalation layer having optical density of from 0.001 to less than 0.3. Where the desired range is less than 750 nm, the backing layer may preferably be an antihalation layer having a maximum absorption of from 0.3 to 2.0 in a desired range of wavelength before the formation of an image, and an optical density of from 0.005 to less than 0.3 at from 360 to 750 nm after the formation of an image. The method for decreasing the optical density after the formation of an image to aforementioned range is not particularly limited. For example, a method for reducing the density through decoloration of a dye by heating as described in Belgian Patent No. 733,706, or a method for reducing the density using decoloration by light irradiation as described in JP-A No. 54-17833 may be used.

The antihalation layer is described in the paragraph number [0123] to [0124] of JP-A Nos. 11-65021, 11-223898, 9-230531, 10-36695, 10-104779, 11-231457, 11-352625 and 11-352626.

When antihalation dyes are used in the invention, the dyes may be any compounds so far that they have an intended absorption in a desired wavelength region and sufficiently low absorption in a visible region, and also provide an absorption spectral property desired for the aforementioned backing layer. Examples of the dye include, as a single dye, the compounds described in JP-A Nos. 59-56458, 2-216140, 7-13295, 7-11432, U.S. Pat. No. 5,380,635, JP-A No. 2-68539 (from page 13, lower left column, line 1 to page 14, lower left column, line 9) and JP-A No. 3-24539 (from page 14, lower left column to page 16, lower right column); and as a dye which is decolored after the treatment, the compounds described in JP-A Nos. 52-139136, 53-132334, 56-501480, 57-16060, 57-68831, 57-101835, 59-182436, 7-36145, 7-199409, JP-B Nos. 48-33692, 50-16648, 2-41734 and U.S. Pat. Nos. 4,088,497, 4,283,487, 4,548,896 and 5,187,049. However, the scope of the invention is not limited to these examples.

The binder suitable for the backing layer of the invention may be transparent or translucent, and generally colorless. Examples include natural polymers and synthetic resins including homopolymers and copolymers, and other film-forming media. Specific examples thereof include, for example, gelatin, gum arabic, poly(vinyl alcohol), hydroxyethyl cellulose, cellulose acetate, cellulose acetate butyrate, poly(vinylpyrrolidone), casein, starch, poly(acrylic acid), poly(methyl methacrylate), poly(vinyl chloride), poly (methacrylic acid), copoly(styrene-maleic anhydride), copoly(styrene-acrylonitrile), copoly(styrene-butadiene), poly(vinyl acetals) (e.g., poly(vinyl formal), poly(vinyl butyral)), poly(esters), poly(urethanes), phenoxy resin, poly (vinylidene chloride), poly(epoxides), poly(carbonates), poly(vinyl acetate), cellulose esters and poly(amides). The binder may be coated and formed after being dissolved in water or an organic solvent or in the form of an emulsion.

The single-sided photosensitive material of the invention may contain, in the surface protective layer for the photosensitive layer (preferably image-forming layer) and/or the backing layer or in the surface protective layer for the backing layer, a matting agent to improve transferability. The matting agent is, in general a fine particle of a water-insoluble organic or inorganic compound. Any matting agent may be employed, and those well known in the art may be used, such as organic matting agents described in U.S. Pat. Nos. 1,939,213, 2,701,245, 2,322,037, 3,262,782, 3,539,344 and 3,767,448, or inorganic matting agents described in U.S. Pat. Nos. 1,260,772, 2,192,241, 3,257,206, 3,370,951, 3,523,022 and 3,769,020. Specific examples of the organic compound which can be used as the matting agent include, for example, water-dispersible vinyl polymers such as polymethyl acrylate, polymethyl methacrylate, polyacrylonitrile, acrylonitrile/oc-methylstyrene copolymer, polystyrene, styrene/divinylbenzene copolymer, polyvinyl acetate, polyethylene carbonate and polytetrafluoroethylene; cellulose derivatives such as methyl cellulose, cellulose acetate and cellulose acetate propionate; starch derivatives such as carboxy starch, carboxynitrophenyl starch and urea/formaldehyde/starch reaction product; and gelatin hardened with a known hardening agent and hardened gelatin subjected to coacervation hardening so as to be a microcapsule hollow particle. Examples of the inorganic compound include, for example, silicon dioxide, titanium dioxide, magnesium dioxide, aluminum oxide, barium sulfate, calcium carbonate, silver chloride desensitized by a known method, silver bromide desensitized by a known method, glass, and diatomaceous earth. The aforementioned matting agents may be used as a mixture of different kinds of substances. The size and shape of the matting agent are not particularly limited and the matting agent may have any particle size. A matting agent having a particle size of preferably from 0.1 to 30 $\mu$m may be used to carry out the invention. The matting agent may have either a narrow or broad particle size distribution. The matting agent may greatly affect the haze of the photosensitive layer or surface gloss of a coated layer, and accordingly, the particle size, shape and particle size distribution may preferably be controlled to meet a desired purpose at the preparation of the matting agent or by mixing several matting agents.

In the invention, the matting agent may preferably be incorporated in the outermost surface layer of the photosensitive material or a layer which functions as the outermost surface layer, or alternatively, in a layer close to the outer surface or a layer which acts as a so-called protective layer. The matting degree on the surface protective layer on the emulsion can be freely chosen so long as the star dust trouble does not occur. The degree may preferably be within a range of from 300 to 10,000 seconds, particularly preferably from 500 to 2,000 seconds as indicated by the Beck's smoothness.

In the invention, the backing layer preferably contains a matting agent. The matting degree of the backing layer is preferably 10 to 1,200 seconds, further preferably from 50 to 700 seconds as indicated by the Beck's smoothness.

In the heat-devolopable photosensitive material of the invention, the heat-developable photographic emulsion (heat-devolopable photographic emulsion) is coated on a substrate to form one or more layers. In the case of a single layer, the layer should contain an organic silver salt, a silver halide, a developer, a binder, and optionally added materials such as a color-tone adjustor, a coating aid and other auxiliary agents. In the case of a double-layer structure, the first emulsion layer (usually a layer adjacent to the substrate) should contain an organic silver salt and a silver halide, and the second layer or both layers should contain some other components. A double-layer structure comprising a single emulsion layer containing all of the components and a protective topcoat may also be contemplated. A multi-color heat-developable photosensitive material may have the combination of aforementioned two layers for each of the colors, or as described in U.S. Pat. No. 4,708,928, a structure comprising a single layer containing all components. In the case of a multi-dye multi-color photosensitive heat-developable material, a functional or non-functional barrier layer is generally provided between respective emulsion layers (photosensitive layers) to keep the emulsion layer away from each other as described in U.S. Pat. No. 4,460,681.

A backside resistive heating layer described in U.S. Pat. No. 4,460,681 and U.S. Pat. No. 4,374,921 may also be used in the photosensitive heat-developable photographic image system of the invention. In the heat-developable photosensitive material of the invention, a hardening agent may be used in layers such as the image-forming layer (photosensitive layer), the protective layer, and the backing layer. Examples of the hardening agent include chromium alum, 2,4-dichloro-6-hydroxy-s-triazine sodium salt, N,N-ethylenebis(vinylsulfoneacetamide), N,N-propylenebis (vinylsulfoneacetamide), polyvalent metal ions described in page 78 of "THE THEORY OF THE PHOTOGRAPHIC PROCESS FOURTH EDITION" (published by Macmillan-Publishing Co., Inc., 1977), pp.77-87, written by T. H. James, polyisocyanates described in U.S. Pat. No. 4,281,060 and JP-A No. 6-208193, epoxy compounds described in U.S. Pat. No. 4,791,042, and vinyl sulfone-based compounds described in JP-A No. 62-89048.

In the invention, a surfactant may also be used to improve the coating property or electrostatic charge property. Examples of the surfactant include nonionic, anionic, cationic and fluorocarbon surfactants, which may be appropriately chosen and used. Specific examples include fluorocarbon polymer surfactants described in JP-A No. 62-170950 and U.S. Pat. No. 5,380,644, fluorocarbon surfactants described in JP-A Nos. 60-244945 and 63-188135, polysiloxane-based surfactants described in U.S. Pat. No. 3,885,965, and polyalkylene oxides and anionic surfactants described in JP-A No. 6-301140.

For the purpose of preventing the electrostatic charge, the heat-developable photosensitive material of the invention may comprise a metallized layer or a layer containing a soluble salt (e.g. chloride, nitrate), an ionic polymer described in U.S. Pat. Nos. 2,861,056 and 3,206,313, an insoluble inorganic salt described in U.S. Pat. No. 3,428,451, or tin oxide fine particles described in JP-A Nos. 60-252349 and 57-104931.

To obtain a color image by using the heat-developable photosensitive material of the invention, the method described in JP-A No. 7-13295, from page 10, left column, line 43 to page 11, left column, line 40 may be applied. Examples of a stabilizer for a color dye image include those described in British Patent 1,326,889, U.S. Pat. Nos. 3,432,300, 3,698,909, 3,574,627, 3,573,050, 3,764,337 and 4,042,394.

The heat-developable photographic emulsion for use in the invention may be coating by various coating operations such as dip coating, air knife coating, flow coating or extrusion coating using a hopper such as described in U.S. Pat. No. 2,681,294. If necessary, two or more layers may be simultaneously coated by a method described in U.S. Pat. No. 2,761,791 and British Patent No. 837,095.

The heat-developable photosensitive material of the invention may comprise additional layers such as a dye-accepting layer for accepting a moving dye image, an opaque layer for the case of reflective printing, a protective topcoat layer or a primer layer known in the field of photothermic photographic technology.

It is preferable that the heat-developable photosensitive material of the invention is capable of producing image solely by itself. That is, it is preferable that the functional layer necessary for forming image, such as image accepting layer, is not provided on the separate photosensitive material.

The method of forming images of the invention will be explained hereinafter.

The heat-developable photosensitive material of the invention can form an image by heat development after being exposed to light (image forming method of the invention). Preferred embodiments of the heat-developing apparatus include, as a type of contacting a heat-developable photosensitive material with a heat source such as heat roller or heat drum, the heat-developing apparatuses described in JP-B No. 5-56499, Japanese Patent No. 684453, JP-A Nos. 9-292695, 9-297385 and International Patent Publication WO95/30934, and as a non-contacting type, the heat-developing apparatuses described in JP-A No. 7-13294, International Patent publications WO97/28489, WO97/28488 and WO97/28287. A non-contacting type heat-developing apparatus is particularly preferred. The development temperature may preferably be from 80 to 250° C., more preferably from 100 to 140° C. The development time may preferably be from 1 to 180 seconds, more preferably from 10 to 90 seconds.

For preventing uneven processing due to dimensional changes in the heat-developable photosensitive material of the invention during heat development, it is preferable to heat the material at a temperature of 80° C. or higher and lower than 115° C. for 5 seconds or more so as to prevent the image from appearing, and then develop the material by heating at a temperature of 110 to 140° C. to produce the image (so-called multi-stage heating method).

The heat-developable photosensitive material of the invention may be exposed to light by any method, but laser light is preferred as an exposure light source. The laser light in the invention is preferably from a gas laser, a YAG laser, a dye laser or a semiconductor laser. Also the semiconductor laser and a second harmonic generation device can be used.

The heat-developable photosensitive material of the invention has a low haze upon light exposure, and is liable to occur generation of interference fringes. For preventing the generation of interference fringes, a technique of entering a laser ray obliquely with respect to the photosensitive material disclosed in JP-A No. 5-113548 and a method of using a multimode laser disclosed in International Patent Publication WO95/31754 have been known, and these techniques are preferably used.

To expose the heat-developable photosensitive material of the invention to light, as disclosed in SPIE, Vol.169, Laser printing 116, p.128 (1979), JP-A No. 4-51043 and International Patent Publication WO95/31754, exposure is preferably conducted so that laser lights are not overlapped and a scanning line is not visible.

An example of the structure of a heat-developing apparatus used for the heat development of the heat-developable photosensitive material of the invention is shown in FIG. 1. The apparatus shown in FIG. 1 comprises carrying-in roller pairs 11 (lower rollers are heating rollers), which carry a heat-developable photosensitive material 10 into the heating section while making the material in a flat shape and preheating it, and carrying-out roller pairs 12, which carry out the heat-developable photosensitive material 10 after heat development from the heating section while maintaining the material to be in a flat shape. The heat-developable photosensitive material 10 is heat-developed while it is conveyed by the carrying-in roller pairs 11 and then by the carrying-out roller pairs 12. As a conveying means for carrying the heat-developable photosensitive material 10 under the heat development, multiple rollers 13 is provided in such a way that they are contacted with the side of the image-forming layer, and a flat surface 14 adhered with non-woven fabric (composed of aromatic polyamide or Teflon (R)) or the like is provided on the opposite side so that it should be contacted with the back surface. The heat-developable photosensitive material 10 is conveyed by driving of the multiple rollers 13 contacted with the image-forming layer side, while the back surface slides on the flat surface 14. As a heating means, heaters 15 are provided over the rollers 13 and under the flat surface 14 so that the heat-developable photosensitive material 10 should be heated from the both sides. Examples of the heating means include panel heaters and so forth. While clearance between the rollers 13 and the flat surface 14 may vary depending on the member of the flat surface, it is suitably adjusted to a clearance that allows the conveyance of the heat-developable photosensitive material 10. The clearance is preferably within a range from 0 to 1 mm.

The material of the surface of the rollers 13 and the member of the flat surface 14 may be composed of any materials so long as they have heat resistance and they should not cause any troubles in the conveyance of the heat-developable photosensitive material 10. However, the material of the roller surface is preferably composed of silicone rubber, and the member of the flat surface is preferably composed of non-woven fabric made of aromatic polyamide or Teflon (R) (PTFE). The heating means preferably comprises multiple heaters so that temperature of each heater can be adjusted freely.

The heating section is constituted by a preheating section A comprising the carrying-in roller pairs 11 and a heat development section B comprising the heaters 15. The temperature of the preheating section A located upstream of the heat development section B is preferably selected to be lower than the heat development temperature (for example, by about 10 to 30° C.), and the temperature and heat development time are desirably adjusted so that they are sufficient for evaporating moisture contained in the heat-developable photosensitive material 10. The temperature is also adjusted to be higher than the glass transition temperature (Tg) of the substrate of the heat-developable photosensitive material 10 so that uneven development should be prevented.

Moreover, guide panels 16 are provided downstream from the heat development section B, and they constitute a gradual cooling section C together with the carrying-out roller pairs 12. The guide panels 16 are preferably composed of a material of low heat conductivity, and it is preferred that the cooling is performed gradually.

While the heat-development apparatus was explained with reference to the accompanying drawing, the apparatus is not limited to the example. For example, the heat-development apparatus used for the invention may have a variety of structures such as disclosed in JP-A No. 7-13294. For the multi-stage heating method, which is preferably used in the invention, the heat-developable photosensitive material may be successively heated at different temperatures in such an apparatus as mentioned above, which is provided with two or more heat sources at different temperatures.

EXAMPLES

The present invention will be explained in more detail with reference to the following examples. However, materials, reagents, ratios, operations and so forth described hereinafter are properly be altered without departing from the spirit of the invention. The scope of the invention, therefore, is not limited to specific examples described below.

(Prepartion of PET Substrate)

PET having IV (intrinsic viscosity) of 0.66 (measured in phenol/tetrachloroethane=6/4 (weight ratio) at 25° C.) was obtained by using terephthalic acid and ethylene glycol in a conventional manner. The product was pelletized, dried at 130° C. for 4 hours, melted at 300° C., then extruded from a T-die and rapidly cooled to form an unstretched film having a thickness of 175 μm after thermal fixation.

The film was stretched along the longitudinal direction by 3.3 times using rollers of different peripheral speeds, and then stretched along the transverse direction by 4.5 times using a tenter. The temperatures used for these operations were 110° C. and 130° C., respectively. Then, the film was subjected to thermal fixation at 240° C. for 20 seconds, and relaxed by 4% along the transverse direction at the same temperature. Then, the chuck of the tenter was released, the both edges of the film were knurled, and the film was rolled up at 4 kg/cm$^2$. Thus, a roll of a film having a thickness of 175 μm was obtained.

(Surface Corona Discharge Treatment)

The both surfaces of the substrate were subjected to corona discharge treatment at room temperature at a speed of 20 m/minute by using a solid state corona processor Model 6 KVA (manufactured by Piller Co., Ltd.). The readings of electric current and voltage during the treatment indicated that the substrate underwent the treatment of 0.375·kVA·minute/m$^2$. The discharging frequency of the treatment was 9.6 kHz, and the gap clearance between the electrode and the dielectric roll was 1.6 mm.

(Preparation of Substrate having Undercoat Layer)

| (1) Preparation of coating solution for undercoat layer) | |
|---|---|
| Formulation (1) (for undercoat layer of photosensitive layer side) | |
| Pesresin A-515GB (30 wt % solution, manufactured by TAKAMATSU OIL&FAT CO., LTD.) | 234 g |
| Polyethylene glycol monononyl phenyl ether (10 wt % solution, average exthylene oxide number = 8.5) | 21.5 g |
| MP-1000 manufactured by Soken Chemical & Engineering Co., Ltd. (fine polymer grains, average grain size: 0.4 μm) | 0.91 g |
| Distilled water | 744 ml |
| Formulation (2) (for first layer of back surface) | |
| Styrene-butadiene copolymer latex (solid content: 40% by weight, weight ratio of styrene/butadiene = 68/32) | 158 g |
| Aqueous 8 wt % solution of 2,4-dichloro-6-hydroxy-S-triazine sodium salt | 20 g |
| Aqueous 1 wt % solution of sodium laurylbenzene sulfonate | 10 ml |
| Distilled water | 854 ml |
| Formulation (3) (for second layer of back surface) | |
| $SnO_2$/SbO (weight ratio: 9/1, average grain size: 0.038 μm, 17 wt % dispersant) | 84 g |
| Gelatin (aqueous 10 wt % solution) | 89.2 g |
| METOLOSE TC-5 (aqueous 2 wt % solution), manufactured | 8.6 g |

-continued

| (1) Preparation of coating solution for undercoat layer) | |
|---|---|
| by Shin-Etsu Chemical Co., Ltd. | |
| MP-1000 manufactured by Soken Chemical & Engineering Co., Ltd. | 0.01 g |
| Aqueous 1 wt % solution of sodium dodecylbenzene sulfonate | 10 ml |
| NaOH (1% by weight) | 6 ml |
| Proxel (manufactured by ICI) | 1 ml |
| Distilled water | 805 ml |

(Preparation of Substrate having Undercoat Layer)

After subjecting both surfaces of aforementioned biaxially stretched polyethylene terephthalate substrate having a thickness of 175 μm to the aforementioned corona discharge treatment, an undercoat coating solution of the formulation (1) was applied on one surface (surface of the photosensitive layer) by a wire bar in a wet amount of 6.6 ml/m$^2$ (per one surface) and dried for 5 minutes at 180° C. Then, the back surface was applied with an undercoat coating solution of the formulation (2) by a wire bar in a wet coating amount of 5.7 ml/m$^2$ and dried for 5 minutes at 180° C. The back surface was further applied with an undercoat coating solution of the formulation (3) by a wire bar in a wet coating amount of 7.7 ml/m$^2$ and dried for 6 minutes at 180° C. to obtain a substrate having an undercoat layer.

(Preparation of Coating Solution for Back Surface)

(Preparation of Solid Fine Grain Dispersion (a) of Basic Precursor)

A solid fine grain dispersion (a) of a basic precursor, which has an average grain size of 0.2 μm, was obtained by mixing 64 g of a basic precursor compound 11, 28 g of diphenylsulfone, 10 g of a surfactant DEMOL manufactured by Kao Corporation and 220 ml of distilled water and performing beads dispersion of the mixed solution using a sand mill (¼ Gallon sand grinder mill, manufactured by Aimex Co., Ltd.).

(Preparation of Dye Solid Fine Grain Dispersion)

A solid fine grain dispersion (a) having an average grain size of 0.2 μm was obtained by mixing 9.6 g of a cyanine dye compound, 5.8 g of sodium p-dodecylbenzene sulfonate and 305 ml of distilled water and performing beads dispersion of the mixed solution using a sand mill (¼ Gallon sand grinder mill, manufactured by Aimex Co., Ltd.).

(Preparation of Coating Solution for Antihalation Layer)

A coating solution for antihalation layer was prepared by mixing 17 g of gelatin, 9.6 g of polyacrylamide, 70 g of the solid fine grain dispersion (a) of the basic precursor, 56 g of the dye solid fine grain dispersion, 1.5 g of fine monodispersed polymethyl methacryalte grains (average grain size: 8 μm, grain size standard deviation: 0.4), 0.03 g of benzoisothiazoline, 2.2 g of sodium polyethylene sulfonate, 0.2 g of a blue dye compound, 3.9 g of an yellow dye compound and 844 ml of water.

(Preparation of Coating Solution for Back Surface Protective Layer)

A coating solution for back surface protective layer was prepared by heating a vessel to 40° C. and mixing 50 g of gelatin, 0.2 g of polystyrene sulfonate, 2.4 g of N,N-ethylenebis(vinylsulfoneacetamide), 1 g of sodium t-octylphenoxyethoxyethane sulfonate, 30 mg of benzoisothiazolinone, 37 mg of a fluorine-based surfactant (F-1: N-perfluorooctylsulfonyl-N-propylalanine potassium salt), 0.15 g of a fluorine-based surfactant (F-2: polyethylene glycol mono(N-perfluorooctylsulfonyl-N-propyl-2-aminoethyl)ether [ethylene oxide average polymerization degree: 15]), 64 mg of a fluorine-based surfactant (F-3), 32 mg of a fluorine-based surfactant (F-4), 8.8 g of an acrylic acid/ethyl acrylate copolymer (copolymerization weight ratio: 5/95), 0.6 g of aerosol OT (manufactured by American Cyanamide Co.), 1.8 g of a liquid paraffin emulsion as liquid paraffin and 950 ml of water.

<<Preparation of Silver Halide Emulsion 1>>

While stirring a solution prepared by adding 3.1 ml of a 1 wt % potassium bromide solution to 1421 ml of distilled water and further adding 3.5 ml of sulfuric acid and 31.7 g of phthalized gelatin in a reaction pot, a liquid temperature was maintained at 30° C. and the whole volume of a solution A prepared by adding distilled water to 22.22 g of silver nitrate thereby to dilute it to 95.4 ml and the whole volume of a solution B prepared by diluting 15.3 g of potassium bromide and 0.8 g of potassium iodide with distilled water to a volume of 97.4 ml were added in entire amount at a fixed flow rate over 45 seconds. Then, 10 ml of a 3.6 wt % an aqueous hydrogen peroxide was added and 10.8 ml of an aqueous 10 wt % solution of benzimidazole. Furthermore, the whole volume of a solution C prepared by adding distilled water to 51.86 g of silver nitrate thereby to dilute it to 317.5 ml was added at a fixed flow rate over 20 seconds, while the whole volume of a solution D prepared by diluting 44.2 g of potassium bromide and 2.2 g of potassium iodide with distilled water to a volume of 400 ml was added by the controlled double jet method while maintaining pAg at 8.1. A hexachloroiridium (III) potassium salt was added after 10 minutes have passed since the beginning of the addition of the solution C and the solution D in such an amount that its final concentration should be $1\times10^{-4}$ mol per mole of silver. After 5 seconds have passed since the completion of the addition of the solution C, an aqueous iron (III) hexacyanide potassium solution was added in such an amount that its final concentration should be $3\times10^{-4}$ mol per mole of silver. The mixture was adjusted to pH 5.9 using sulfuric acid of a concentration of 0.5 mol/L and the stirring was stopped. Then, the mixture was subjected to precipitation, desalting and washing with water. Using sodium hydroxide of a concentration of 1 mol/L, the mixture was adjusted to pH 8.0 to form a silver halide dispersion having pAg of 8.0.

The aforementioned silver halide emulsion was maintained at 38° C. with stirring and 5 ml of a 0.34 wt % methanol solution of 1,2-benzoisothiazolin-3-one was added. After 40 minutes, a methanol solution of a spectral sensitization dye A and a sensitization dye B in a molar ratio of 1:1 was added in an amount of $1.2\times10^{-3}$ mol per mol of silver in terms of the total of the sensitization dye A and the sensitization dye B. After one minute, the mixture was heated to 47° C. After 20 minutes have passed since heating, a methanol solution of sodium benzenethiosulfonate was added in an amount of $7.6\times10^{-5}$ mol per mole of silver. After 5 minutes, a methanol solution of a tellurium sensitization dye B was added in an amount of $2.9\times10^{-4}$ mol per mole of silver, and then ripened for 91 minutes. 1.3 ml of a 0.8 wt % methanol solution of N,N"-dihydroxy-N"-diethylmelamine was added and, after 4 minutes, a methanol solution of 5-methyl-2-mercaptobenzimidazole was added in an amount of $4.8\times10^{-3}$ mol per mole of silver, and its temperature was lowered and a methanol solution of 1-phenyl-2-heptyl-5-mercapto-1,3,4-triazole was added in an amount of $5.4\times10^{-3}$ mol per mole of silver to form a silver halide emulsion 1.

The grains in the completed silver halide emulsion were silver iodobromide grains having an average grain size of 0.042 μm and a variation coefficient of the projected area of 20%, which uniformly contain 3.5 mol % of iodine. The grain size and the like were obtained from averages for 1000 grains by using an electron microscope. The [100] face ratio of these grains were determined to be 80% by the Kubelka-Munk method.

<<Preparation of Silver Halide Grain 2>>

In the same manner as in the preparation of the silver halide grain 1, except that the liquid temperature of 30° C. upon the formation of grains was changed to 40° C. and the solution B was prepared by diluting 15.9 g of potassium bromide with distilled water to a volume of 97.4 ml, and that the solution D was prepared by diluting 45.8 g of potassium bromide with distilled water to a volume of 400 ml, and that the addition time of the solution C was changed to 30 minutes and hexaferro(II)cyanide potassium was removed in the preparation of the silver halide grain 1, a silver halide emulsion 2 was prepared. In the same manner as in the preparation of the silver halide grain 1, the mixture was subjected to precipitation, desalting and washing with water. Furthermore, in the same manner as in the preparation of the emulsion 1, except that the amount of the methanol solution of the spectral sensitization dye A and the sensitization dye B in a molar ratio of 1:1 was changed to $7.5\times10^{-4}$ mol per mol of silver in terms of the total of the sensitization dye A and the sensitization dye B and the amount of the tellurium sensitization dye B was changed to $1.1\times10^{-4}$ mol per mole of silver, and the amount of 1-phenyl-2-heptyl-5-mercapto-1,3,4-triazole was changed to $3.3\times10^{-3}$ mol per mole of silver, the spectral sensitization dye, the chemical sensitization dye, 5-methyl-2-mercaptobenzimidazole and 1-phenyl-2-heptyl-5-mercapto-1,3,4-triazole were added to obtain a silver halide emulsion 2. The emulsion grains in the silver halide emulsion 2 were pure cubic silver iodobromide grains having an average grain size of 0.080 μm and a variation coefficient of the projected area of 20%.

<<Preparation of Silver Halide Grain 3>>

In the same manner as in the preparation of the silver halide grain 1, except that the liquid temperature of 30° C. upon the formation of grains was changed to 20° C. a silver halide emulsion 3 was prepared. In the same manner as in the preparation of the silver halide grain 1, the mixture was subjected to precipitation, desalting and washing with water. Furthermore, in the same manner as in the preparation of the emulsion 1, except that the amount of a solid dispersion (aqueous gelatin solution) of the spectral sensitization dye A and the sensitization dye B in a molar ratio of 1:1 was changed to $6\times10^{-3}$ mol per mol of silver in terms of the total of the sensitization dye A and the sensitization dye B and the amount of the tellurium sensitization dye B was changed to $5.2\times10^{-4}$ mol per mole of silver, a silver halide emulsion 3 was obtained. The emulsion grains in the silver halide emulsion 3 were silver iodobromide grains having an average grain size of 0.034 μm and a variation coefficient of the projected area of 20%, which uniformly contain 3.5 mol % of iodine.

<<Preparation of Mixed Emulsion A for Coating Solution>>

70% by weight of the silver halide emulsion 1, 15% by weight of the silver halide emulsion 2 and 15% by weight of the silver halide 3 were dissolved and an aqueous 1 wt % solution of benzothiazolium iodide was added in an amount of $7\times10^{-3}$ mol per mol of silver. Furthermore, water was added so that the content of silver halide becomes 38.2 g per kg of the mixed emulsion for coating solution.

<<Preparation of Fatty Acid Silver Dispersion>>

87.6 kg of behenic acid (trade name: EDENOR C22-85JP GW) manufactured by COGNIS DEUTSCHLAND GmbH, 423 L of distilled water, 49.2 L of an aqueous NaOH solution of a concentration of 5 mol/L and 120 L of tert-butanol were mixed and then reacted at 75° C. with stirring for one hour to obtain a sodium behenate solution. Separately, 206.2 L of an aqueous solution (pH 4.0) of 40.4 kg of silver nitrate was prepared and maintained at 10° C. A reaction vessel containing 635 L of distilled water and 30 L of tert-butanol was maintained at 30° C. and the total volume of aforementioned sodium behenate solution and the whole volume of aforementioned aqueous silver nitrate solution were added while stirring sufficiently over 93 minutes and 15 seconds and 90 minutes, respectively. At this time, only the aqueous silver nitrate solution was added during 11 minutes after the beginning of the aqueous silver nitrate solution, and then the addition of the sodium behenate solution was started. During 14 minutes and 15 seconds after the completion of the addition of the aqueous silver nitrate solution, only the sodium behenate solution was added. At this time, the temperature in the reaction vessel was controlled to 30° C. and the outside temperature was controlled so that the liquid temperature is fixed. Piping of the addition system of the sodium behenate solution was kept warm by circulating warm water around the outside of a double tube and the liquid temperature of an outlet of an addition nozzle tip was controlled to 75° C. Piping of the addition system of the aqueous silver nitrate solution was kept warm by circulating cold water around the outside of the double tube. The addition position of the sodium behenate solution and the addition point of the aqueous silver nitrate solution were made symmetric with respect to a stirring axis as a center and the height was controlled so as not to contact with the reaction solution.

After the completion of the addition of the sodium behenate solution, the mixture was allowed to stand at the same temperature for 20 minutes, heated to 35° C. over 30 minutes, and then ripened for 210 minutes. Immediately after the completion of ripening, the solid was removed by centrifugal filtration and ten washed with water until the conductivity of the filtered water becomes 30 μS/cm. In that case, an operation of converting a wet cake into a slurry by addition of pure water was effected three times in order to accelerate reduction of the conductivity. The resulting wet cake of fatty acid silver was centrifuged at a centrifugal force of 70 G for one hour. G is represented by the formula: $1.119\times10^{-5}\times$radius (cm) of vessel×rotation number (rpm) 2. The solid content (measured after drying 1 g of the wet cake at 110° C. for 2 hours) of the fatty acid silver wet cake thus obtained was 44%.

The form of the resulting silver behenate grains was evaluated by electron microscopy. As a result, the grains were scaly crystals having a of 0.14 μm on average, b of 0.4

μm on average, C of 0.6 μm on average, an average aspect ratio of 5.2, an average grain size of 0.052 μm and a variation coefficient of the projected area of 15% (a, b and C are defined in the specification)

19.3 kg of polyvinyl alcohol (trade name: PVA-217) and water were added to about 260 kg of the solid to make 1000 kg in total, and then the mixture was converted into a slurry using a dissolver blade and the slurry was previously dispersed using a pipeline mixer (Model PM-10, manufactured by Mizuho Industry Co., Ltd.).

After controlling the pressure of a dispersing machine (trade name: microfluidizer M-610, manufactured by Microfluidex International Corporation, using a Z type interaction chamber) to 1260 kg/cm$^2$, the previously dispersed stock solution was treated three times to obtain a silver behenate dispersion. With respect to the cooling operation, each spiral tube type heat exchanger was mounted to the front and rear of the interaction chamber and the dispersion temperature was adjusted to 18° C. by controlling the temperature of a coolant.

<<Preparation of Dispersion of Reducing Agent-1>>

To 10 kg of an aqueous 20 wt % solution of a reducing agent-1 (1,1-bis(2-hydroxy-3,5-dimethylphenyl)-3,5,-trimethylhexane: compound (I-1) represented by the general formula (3)) and modified polyvinyl alcohol (Poval MP203, manufactured by Kuraray Co., Ltd.), 16 kg of water was added and thoroughly stirred to obtain a slurry. The slurry was fed using a diaphram pump and dispersed in a horizontal type sand mill (UVM-2, manufactured by Imex) packed with zirconia beads having an average diameter of 0.5 mm for 3 hours and 30 minutes. After adding 0.2 g of a benzoisothiazoline sodium salt and water, the mixture was prepared so that the concentration of the reducing agent becomes 25% by weight to obtain a reducing agent-1 dispersion. The reducing agent particles contained in the reducing agent dispersion thus obtained had a median diameter of 0.42 μm and a maximum particle size of 2.0 μm or less. The resulting reducing agent dispersion was filtered through a polypropylene filter having a pore diameter of 10.0 μm and a foreign substance such as dust was removed, and then the resulting product was received.

<<Preparation of Dispersion of Reducing Agent-2>>

To 10 kg of an aqueous 20 wt % solution of a reducing agent-2 (2,2-isobutylidene-bis-(4,6-dimethylphenol)-3,5,-trimethylhexane: compound (1-2) represented by the general formula (3)) and modified polyvinyl alcohol (Poval MP203, manufactured by Kuraray Co., Ltd.), 16 kg of water was added and thoroughly stirred to obtain a slurry. The slurry was fed using a diaphram pump and dispersed in a horizontal type sand mill (UVM-2, manufactured by Imex) packed with zirconia beads having an average diameter of 0.5 mm for 3 hours and 30 minutes. After adding 0.2 g of a benzoisothiazoline sodium salt and water, the mixture was prepared so that the concentration of the reducing agent becomes 25% by weight to obtain a reducing agent-2 dispersion. The reducing agent particles contained in the reducing agent dispersion thus obtained had a median diameter of 0.38 μm and a maximum particle size of 2.0 μm or less. The resulting reducing agent dispersion was filtered through a polypropylene filter having a pore diameter of 10.0 μm and a foreign substance such as dust was removed, and then the resulting product was received.

<<Preparation of Dispersion of Reducing Agent Complex-3>>

To 10 kg of an aqueous 10 wt % solution of a complex of a reducing agent complex-3 (2,2'-methylenebis-(4-ethyl-6-tert-butylphenol)-3,5,-trimethylhexane and triphenylphosphine oxide in a ratio of 1:1: a complex of a compound (1-35) represented by the general formula (3)) and triphenylphosphine oxide in a ratio of 1:1) and modified polyvinyl alcohol (Poval MP203, manufactured by Kuraray Co., Ltd.), 2.7 kg of water was added and thoroughly stirred to obtain a slurry. The slurry was fed using a diaphram pump and dispersed in a horizontal type sand mill (UVM-2, manufactured by Imex) packed with zirconia beads having an average diameter of 0.5 mm for 4 hours and 30 minutes. After adding 0.2 g of a benzoisothiazoline sodium salt and water, the mixture was prepared so that the concentration of the reducing agent becomes 25% by weight to obtain a reducing agent complex-3 dispersion. The reducing agent particles contained in the reducing agent complex dispersion thus obtained had a median diameter of 0.46 μm and a maximum particle size of 1.6 μm or less. The resulting reducing agent dispersion was filtered through a polypropylene filter having a pore diameter of 3.0 μm and a foreign substance such as dust was removed, and then the resulting product was received.

<<Preparation of Dispersion of Reducing Agent-4>>

To 10 kg of an aqueous 10 wt % solution of a reducing agent-4 (2,2'-butylidene-(4-methyl6-tert-butyl: compound (1-36) represented by the general formula (3)) and modified polyvinyl alcohol (Poval MP203, manufactured by Kuraray Co., Ltd.), 6 kg of water was added and thoroughly stirred to obtain a slurry. The slurry was fed using a diaphram pump and dispersed in a horizontal type sand mill (UVM-2, manufactured by Imex) packed with zirconia beads having an average diameter of 0.5 mm for 3 hours and 30 minutes. After adding 0.2 g of a benzoisothiazoline sodium salt and water, the mixture was prepared so that the concentration of the reducing agent becomes 25% by weight to obtain a reducing agent-4 dispersion. The reducing agent particles contained in the reducing agent dispersion thus obtained had a median diameter of 0.40 μm and a maximum particle size of 1.5 μm or less. The resulting reducing agent dispersion was filtered through a polypropylene filter having a pore diameter of 3.0 μm and a foreign substance such as dust was removed, and then the resulting product was received.

<<Preparation of Dispersion of Compounds Represented by the General Formulae (1), (2), (5), (6) and (7) of the Invention>>

To 20 kg of an aqueous 10 wt % solution of the compound represented by the general formula (1) (described in Table 1 and Table 2) and modified polyvinyl alcohol (Poval MP203, manufactured by Kuraray Co., Ltd.), 6 kg of water was added and thoroughly stirred to obtain a slurry. The slurry was fed using a diaphram pump and dispersed in a horizontal type sand mill (UVM-2, manufactured by Imex) packed with zirconia beads having an average diameter of 0.5 mm for 3 hours and 30 minutes. After adding 0.2 g of a benzoisothiazoline sodium salt and water, the mixture was prepared so that the concentration of the compound (1) becomes 15% by weight to obtain a dispersion of the compound represented by the general formula (1) of the invention. The particles of the compound contained in the dispersion thus obtained had a median diameter of 0.38 μm and a maximum particle size of 1.5 μm or less. The resulting dispersion was filtered through a polypropylene filter having a pore diameter of 3.0 μm and a foreign substance such as dust was removed, and then the resulting product was received. The compounds represented by the general formulae (2), (5), (6) and (7) (described in Table 1 and Table 2) were prepared in the same manner.

<<Preparation of Dispersion of Hydrogen-Bonding Compound-2>>

To 10 kg of an aqueous 10 wt % solution of a hydrogen-bonding compound-2 (tri(4-t-butylphenyl)phosphine oxide) and modified polyvinyl alcohol (Poval MP203, manufactured by Kuraray Co., Ltd.), 10 kg of water was added and thoroughly stirred to obtain a slurry. The slurry was fed using a diaphram pump and dispersed in a horizontal type sand mill (UVM-2, manufactured by Imex) packed with zirconia beads having an average diameter of 0.5 mm for 3 hours and 30 minutes. After adding 0.2 g of a benzoisothiazoline sodium salt and water, the mixture was prepared so that the concentration of the reducing agent becomes 22% by weight to obtain a hydrogen-bonding compound-2 dispersion. The reducing agent particles contained in the reducing agent dispersion thus obtained had a median diameter of 0.35 μm and a maximum particle size of 1.5 μm or less. The resulting dispersion of the hydrogen-bonding compound-2 was filtered through a polypropylene filter having a pore diameter of 3.0 μm and a foreign substance such as dust was removed, and then the resulting product was received.

<<Preparation of Dispersion of Organic Polyhalogen Compound-1>>

To 10 kg of an aqueous 20 wt % solution of an organic polyhalogen compound-1 (2-tribromomethanesulfonyl naphthalene) and modified polyvinyl alcohol (Poval MP203, manufactured by Kuraray Co., Ltd.) and 0.4 kg of an aqueous 20 wt % solution of sodium triisopropylnaphthalene sulfonate, 16 kg of water was added and thoroughly stirred to obtain a slurry. The slurry was fed using a diaphram pump and dispersed in a horizontal type sand mill (UVM-2, manufactured by Imex) packed with zirconia beads having an average diameter of 0.5 mm for 5 hours. After adding 0.2 g of a benzoisothiazoline sodium salt and water, the mixture was prepared so that the concentration of the organic polyhalogen compound becomes 23.5% by weight to obtain an organic polyhalogen compound-1 dispersion. The reducing agent particles contained in the polyhalogen compound dispersion thus obtained had a median diameter of 0.36 μm and a maximum particle size of 2.0 μm or less. The resulting organic polyhalogen compound dispersion was filtered through a polypropylene filter having a pore diameter of 10.0 μm and a foreign substance such as dust was removed, and then the resulting product was received.

<<Preparation of Dispersion of Organic Polyhalogen Compound-2>>

To 10 kg of an aqueous 20 wt % solution of an organic polyhalogen compound-2 (2-tribromomethanesulfonyl benzene) and modified polyvinyl alcohol (Poval MP203, manufactured by Kuraray Co., Ltd.) and 0.4 kg of an aqueous 20 wt % solution of sodium triisopropylnaphthalene sulfonate, 16 kg of water was added and thoroughly stirred to obtain a slurry. The slurry was fed using a diaphram pump and dispersed in a horizontal type sand mill (UVM-2, manufactured by Imex) packed with zirconia beads having an average diameter of 0.5 mm for 5 hours. After adding 0.2 g of a benzoisothiazoline sodium salt and water, the mixture was prepared so that the concentration of the organic polyhalogen compound becomes 26% by weight to obtain an organic polyhalogen compound-2 dispersion. The reducing agent particles contained in the polyhalogen compound dispersion thus obtained had a median diameter of 0.41 μm and a maximum particle size of 2.0 μm or less. The resulting organic polyhalogen compound dispersion was filtered through a polypropylene filter having a pore diameter of 10.0 μm and a foreign substance such as dust was removed, and then the resulting product was received.

<<Preparation of Dispersion of Organic Polyhalogen Compound-3>>

To 20 kg of an aqueous 10 wt % solution of an organic polyhalogen compound-3 (N-butyl-3-tribromomethanesulfonyl benzaimide) and modified polyvinyl alcohol (Poval MP203, manufactured by Kuraray Co., Ltd.) and 0.4 kg of an aqueous 20 wt % solution of sodium triisopropylnaphthalene sulfonate, 8 kg of water was added and thoroughly stirred to obtain a slurry. The slurry was fed using a diaphram pump and dispersed in a horizontal type sand mill (UVM-2, manufactured by Imex) packed with zirconia beads having an average diameter of 0.5 mm for 5 hours. After adding 0.2 g of a benzoisothiazoline sodium salt and water, the mixture was prepared so that the concentration of the organic polyhalogen compound becomes 25% by weight to obtain an organic polyhalogen compound-3 dispersion. The reducing agent particles contained in the polyhalogen compound dispersion thus obtained had a median diameter of 0.36 μm and a maximum particle size of 1.5 μm or less. The resulting organic polyhalogen compound dispersion was filtered through a polypropylene filter having a pore diameter of 30.0 μm and a foreign substance such as dust was removed, and then the resulting product was received.

<<Preparation of Phthalazine Compound-1 Solution>>

8 kg of modified polyvinyl alcohol (Poval MP203, manufactured by Kuraray Co., Ltd.) was dissolved in 174.7 kg of water, and then 3.15 kg of an aqueous 20 wt % solution of sodium triisopropylnaphthalene sulfonate and 14.28 kg of an aqueous 70 wt % solution of a phthalazine compound-1 (6-isopropyl phthalazine) were added to prepare a 5 wt % solution of a phthalazine compound-1.

<<Preparation of Aqueous Mercapto Compound-1 Solution>>

7 g of a mercapto compound-1 (1-(3-sulfophenyl)-5-mercaptotetrazole sodium salt) was dissolved in 993 g of water to form an aqueous 0.7 wt % solution.

<<Preparation of Aqueous Mercapto Compound-2 Solution>>

20 g of a mercapto compound-1 (1-(3-methylureido)-5-mercaptotetrazole) was dissolved in 980 g of water to form an aqueous 2 wt % solution.

<<Preparation of Dispersion of Pigment-1>>

To 64 g of C.I. Pigment Blue 60 and 6.4 g of Demor N manufactured by Kao Corporation), 250 g of water was added and thoroughly stirred to obtain a slurry. The slurry was introduced into a vessel together with 800 g of zirconia beads having an average diameter of 0.5 mm and dispersed in a dispersing machine (¼G Sand Grinder Mill, manufactured by Imex) for 25 hours to obtain a pigment-1 dispersion. The pigment particles contained in the pigment dispersion obtained as described above had an average particle size of 0.21 μm.

<<Preparation of SBR Latex Solution>>

A SBR latex having Tg of 23° C. was prepared in the following manner. Using ammonium persulfate as a polymerization initiator and an anionic surfactant as an emulsifire, 70.5% by weight of styrene, 26.5% by weight of butadiene and 3% by weight of acrylic acid were emulsion-polymerized and aged at 80° C. for 8 hours. After the emulsion was cooled to 40° C. and adjusted to pH 7.0 using ammonia water, 0.22% of Sundet BL manufactured by Sanyo Chemical Industries, Ltd. was added. The emulsion was adjusted to pH 8.3 by adding an aqueous 5% sodium hydroxide solution, and then adjusted to pH 8.3 using ammonia water. A molar ratio of $Na^+$ ions to $NH^{4+}$ ions used was 1:2.3. To 1 kg of this solution, 0.15 ml of an aqueous 7% benzoisothiazolinone sodium salt was added to prepare a SBR latex solution.

(SBR latex: latex of -St(70.5)-Bu(26.5)-AA(3)-), Tg: 23° C.

Average particle diameter: 0.1 μm, concentration: 43% by weight, equilibrium moisture content at 25° C. and 60% RH: 0.6% by weight, ionic conductivity: 4.2 mS/cm (ionic conductivity of a latex stock solution (43% by weight) was measured at 25° C. using a conductivity sensor CM-30S manufactured by Toa Denpa Kogyo K.K., pH: 8.4.

SBR latexes having different TGs were prepared in the same manner, except that a ratio of styrene to butadiene was appropriately changed.

<<Preparation of Coating Solution-1 for Emulsion Layer (Photosensitive Later)>>

1000 g of the fatty acid silver dispersion obtained above, 125 ml of water, 113 g of the reducing agent-1 dispersion, 27 g of the reducing agent-2 dispersion, 82 g of the organic polyhalogen compound-1 dispersion, 40 g of the organic polyhalogen compound-2 dispersion, 173 g of the phthalazine compound-1 solution, 1082 g of the SBR latex (Tg: 20.5° C.), the compound represented by the general formula (1), (2), (5), (6) or (7) of the invention (kind and amount is described in Table 1 and Table 2) and 9 g of the aqueous mercapto compound-1 solution were added in order. Immediately before the application, 158 g of a silver halide mixed solution A was added and sufficiently mixed. The resulting coating solution was fed as it was to a coating die and then applied.

The viscosity of the aforementioned coating solution for emulsion layer was measured by a Brookfield viscometer of Tokyo Keiki, and found to be 85 [mPa·s] at 40° C. (No. 1 rotor, 60 rpm).

The viscosity of the coating solution was measured at 25° C. by an RFS fluid spectrometer manufactured by Rheometric Far East Co., Ltd., and found to be 1500, 220, 70, 40 and 20 [mPa·s] at shear rates of 0.1, 1, 10, 100 and 1000 [1/second], respectively.

Preparation of Coating Solution-2 for Emulsion Layer (Photosensitive Later)>>

1000 g of the fatty acid silver dispersion obtained above, 104 ml of water, 30 g of the pigment-1 dispersion, 21 g of the organic polyhalogen compound-2 dispersion, 69 g of the organic polyhalogen compound-3 dispersion, 173 g of the phthalazine compound-1 solution, 1082 g of the SBR latex (Tg: 23° C.), the compound represented by the general formula (1), (2), (5), (6) or (7) of the invention (kind and amount is described in Table 1 and Table 2) and 9 g of the aqueous mercapto compound-1 solution were added in order. Immediately before the application, 110 g of a silver halide mixed solution A was added and sufficiently mixed. The resulting coating solution was fed as it was to a coating die and then applied.

<<Preparation of Coating Solution-3 for Emulsion Layer (Photosensitive Later)>>

1000 g of the fatty acid silver dispersion obtained above, 114 ml of water, 49 g of the reducing agent-4 dispersion, 30 g of the pigment-1 dispersion, 21 g of the organic polyhalogen compound-2 dispersion, 69 g of the organic polyhalogen compound-3 dispersion, 173 g of the phthalazine compound-1 solution, 1082 g of the SBR core/shell latex (ratio of core having Tg of 20° C./shell having Tg of 30° C.=70/30 by weight), 106 g of the hydrogen-bonding compound-2 dispersion, the compound represented by the general formula (1), (2), (5), (6) or (7) of the invention (kind and amount is described in Table 1 and Table 2), 9 g of the mercapto compound-1 solution and 3 g of the mercapto compound-2 solution were added in order. Immediately before the application, 110 g of a silver halide mixed solution A was added and sufficiently mixed. The resulting coating solution was fed as it was to a coating die and then applied.

<<Preparation of Coating Solution for Intermediate Layer on Emulsion Layer Side>>

To 772 g of a 10 wt % aqueous solution of polyvinyl alcohol PVA205 (Kuraray Co., Ltd.), 5.3 g of a 20 wt % dispersion of a pigment and 226 g of a 27.5 wt % latex of methyl methacrylate/styrene/butyl acrylate/hydroxyethyl methacrylate/ acrylic acid copolymer (copolymerization weight ratio: 64/9/20/5/2), 2 ml of an aqueous 5 wt % solution of Aerosol OT (manufactured by American Cyanamid Co.) and 10.5 ml of an aqueous 20 wt % solution of a diammonium phthalate were added. Then, water was added so that the total amount should be 880 g and the mixture was adjusted to pH 7.5 using NaOH to form a coating solution for intermediate layer, which was fed to a coating die at such a feeding amount that its coating amount should be 10 $ml/m^2$.

The viscosity of the coating solution was measured by a Brookfield viscometer, and found to be 21 [mPa·s] at 40° C. (No. 1 rotor, 60 rpm).

<<Preparation of Coating Solution for First Protective Layer for Emulsion Layer>>

64 g of inert gelatin was dissolved in water, and 80 g of a 27.5 wt % solution of a latex of methyl methacrylate/styrene/butyl acrylate/hydroxyethyl methacrylate/acrylic acid copolymer (copolymerization weight ratio: 64/9/20/5/2), 23 ml of an aqueous 10 wt % solution of 1,4-methylphthalic acid, 28 ml of sulfuric acid of a concentration of 0.5 mol/L, 5 ml of an aqueous 5 wt % solution of Aerosol OT (manufactured by American Cyanamid Co.), 0.5 g of phenoxyethanol and 0.1 g of benzoisothiazoline were added, and then water was added so that the total amount should be 750 g to form a coating solution. The coating solution was mixed with 26 ml of 4% by weight of chromium alum by a static mixer immediately before application. The coating solution was fed to a coating die in such an amount that the coating amount should be 18.6 ml/m$^2$.

The viscosity of the coating solution was measured by a Brookfield viscometer, and found to be 17 [mPa·s] at 40° C. (No. 1 rotor, 60 rpm).

<<Preparation of Coating Solution for Second Protective Layer for Emulsion Layer>>

64 g of inert gelatin was dissolved in water, and 102 g of a 27.5 wt % solution of a latex of methyl methacrylate/styrene/butyl acrylate/hydroxyethyl methacrylate/acrylic acid copolymer (copolymerization weight ratio: 64/9/20/5/2), 3.2 ml of a 5 wt % solution of a fluorine-based surfactant (F-1: N-perfluorooctylsulfonyl-N-propylalanine potassium salt, 32 ml of an aqueous 2 wt % solution of a fluorine-based surfactant (F-2: polyethylene glycol mono(N-perfluorooctylsulformyl-N-propyl-2-aminoethyl)ether [ethylene oxide average polymerization degree: 15]), 23 ml of a 5 wt % solution (16 ml) of Aerosol OT (manufactured by American Cyanamid Co.), 4 g of polymethyl methacrylate microparticles (average diameter: 4.0 μm), 21 g of polymethyl methacrylate microparticles (average diameter: 0.7 μm), 1.6 g of 4-methylphthalic acid, 4.8 g of phthalic acid, 44 ml of sulfuric acid of a concentration of 0.5 mol/L and 10 mg of benzisothiazolinone were added, and then water was added so that the total amount should be 650 g to form a coating solution. The coating solution was mixed with 445 ml of an aqueous solution containing 4% by weight of chromium alum and 0.67% by weight of phthalic acid by a static mixer immediately before application to form a coating solution for surface protective layer. The coating solution for surface protective layer was fed to a coating die in such an amount that the coating amount should be 8.4 ml/m$^2$.

The viscosity of the coating solution was measured by a Brookfield viscometer, and found to be 9 [mPa·s] at 40° C. (No. 1 rotor, 60 rpm).

<<Preparation of Heat-Developable Photosensitive Material>>

On the back surface of aforementioned substrate having an undercoat layer, the coating solution for antihalation layer and the coating solution for buck surface protective layer were simultaneously applied as stacked layers so that the applied solid content amount of the solid fine grain dye in the antihalation layer should be 0.04 g/ m$^2$, and the applied amount of gelatin in the protective layer should be 1 g/m$^2$, and dried to form a backing layer.

Then, on the surface opposite to the back surface, an emulsion layer, an intermediate layer, a first protective layer, and a second protective layer were simultaneously applied in this order from the undercoat layer by the slide bead application method as stacked layers to form a heat-developable photosensitive material-1 (samples 101 to 103 and 1101 to 1103). At this time, the temperatures of the emulsion layer and the intermediate layer were controlled to 31° C., the temperature of the first protective layer was controlled to 36° C., and the temperature of the second protective layer was controlled to 37° C.

The coating weight (g/m$^2$) of each compound of the emulsion layer is as follows.

| | |
|---|---|
| Silver behenate: | 6.19 |
| Reducing agent-1: | 0.67 |
| Reducing agent-2: | 0.54 |
| Pigment (C.I.Pigment Blue 60): | 0.032 |
| Polyhalogen compound-1: | 0.46 |
| Polyhalogen compound-2: | 0.25 |
| Phthalazine compound-1: | 0.21 |
| SBR latex: | 11.1 |

Compounds of the general formulae (1), (2), (5), (6) and (7): kind and amount are described in Table 1 and Table 2

| | |
|---|---|
| Mercapt compound-1: | 0.002 |
| Silver halide (in terms of Ag): | 0.145 |

Application and drying conditions are as follows.

The application was performed at a speed of 160 m/min, and the gap between the tip of coating die and the substrate was set to be 0.18 mm. The pressure in the reduced pressure chamber was adjusted to be lower than the atmospheric pressure by 196 to 882 Pa. Static elimination of the substrate was effected by ionic air before application.

In the subsequent chilling zone, the coating solution was cooled with air showing a dry-bulb temperature of 10 to 20° C. and, after floating conveying, the coating solution was dried with air showing a dry-bulb temperature of 23 to 45° C. and a wet-bulb temperature of 15 to 21° C. in a floating type drying machine in a coiled shape.

After drying, the moisture content was adjusted at 25° C. and a humidity of 40 to 60% RH and the film surface was heated to 70 to 90° C. After heating, the film surface was cooled to 25° C.

With respect to the matting degree on the heat-developable photosensitive material thus obtained, the degree for the photosensitive layer side was 550 seconds and the degree for the back surface was 130 seconds as indicated by the Beck's smoothness. The pH of the film surface of the photosensitive layer side was cooled to 25° C.

<<Preparation of Heat-Developable Photosensitive Material-2>>

In the same manner as in case of the heat-developable photosensitive material-1, except that the coating solution-1 for emulsion layer was replaced by the coating solution-2 for emulsion layer and an yellow dye compound 15 was removed from the antihalation layer in the preparation of the heat-developable photosensitive material-1, a heat-developable photosensitive material-2 (samples 201 to 203 and 1201 to 1203) was prepared.

The coating weight (g/m$^2$) of each compound of the emulsion layer is as follows.

| | |
|---|---|
| Silver behenate: | 6.19 |
| Pigment (C.I.Pigment Blue 60): | 0.036 |
| Polyhalogen compound-2: | 0.13 |
| Polyhalogen compound-3: | 0.41 |
| Phthalazine compound-1: | 0.21 |
| SBR latex: | 11.1 |
| Reducing agent complex: | 1.54 |

Compounds of the general formulae (1), (2), (5), (6) and (7): kind and amount are described in Table 1 and Table 2

| | |
|---|---|
| Mercapt compound-1: | 0.002 |
| Silver halide (in terms of Ag): | 0.10 |

<<Preparatiion of Heat-Developable Photosensitive Material-3>>

In the same manner as in case of the heat-developable photosensitive material-1, except that the coating solution-1 for emulsion layer was replaced by the coating solution-3 for emulsion layer and an yellow dye compound 15 was removed from the antihalation layer, and that the fluorine-based surfactants F-1, F-2, F-3 and F-4 of the second protective layer and the back surface protective layer were replaced by the fluorine-based surfactants F-5, F-6, F-7 and F-8 in the same amount in the preparation of the heat-developable photosensitive material-1, a heat-developable photosensitive material-3 (samples 301 to 3203 and 1301 to 1313) was prepared.

The coating weight (g/m$^2$) of each compound of the emulsion layer is as follows.

| | |
|---|---|
| Silver behenate: | 5.57 |
| Pigment (C.I.Pigment Blue 60): | 0.032 |
| Reducing agent-4: | 0.76 |
| Polyhalogen compound-2: | 0.12 |
| Polyhalogen compound-3: | 0.37 |
| Phthalazine compound-1: | 0.19 |
| SBR latex: | 10.0 |
| Hydrogen-bonding compound: | 0.59 |

Compounds of the general formulae (1), (2), (5), (6) and (7): kind and amount are described in Table 1 and Table 2

| | |
|---|---|
| Mercapt compound-1: | 0.002 |
| Mercapt compound-2: | 0.001 |
| Silver halide (in terms of Ag): | 0.09 |

The chemical structures of compounds used in examples of the invention are shown below.

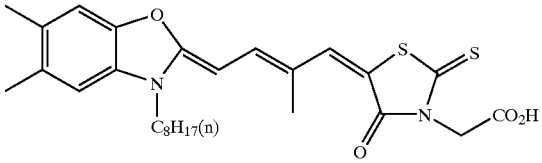

Spectral sensitization dye A

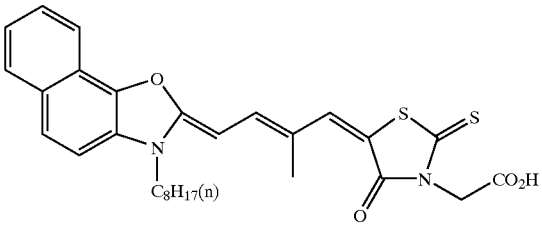

Spectral sensitization dye B

-continued

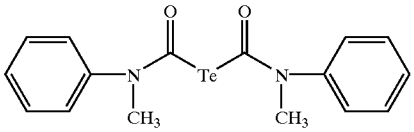

Tellurium sensitizer C

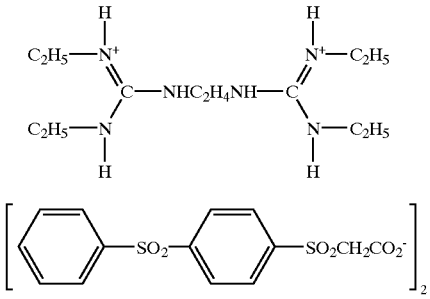

Base precursor compound 11

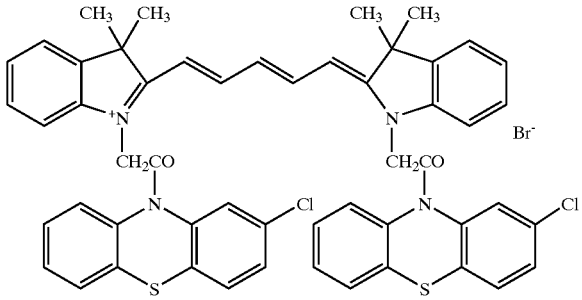

Cyanine dye compound 13

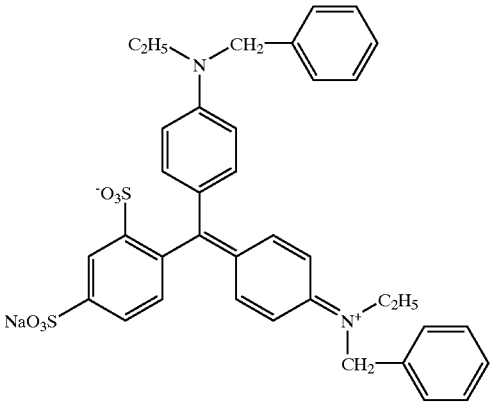

Blue dye compound 14

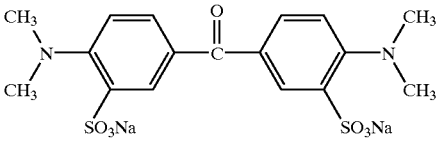

Yellow dye compound 15

-continued

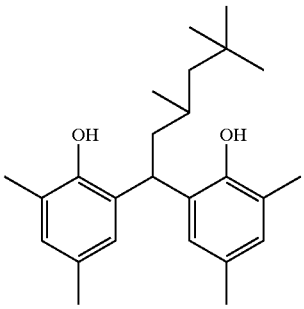

(Reducing agent 1)

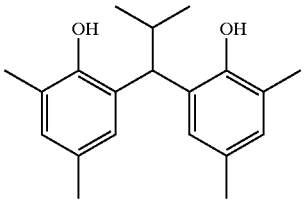

(Reducing agent 2)

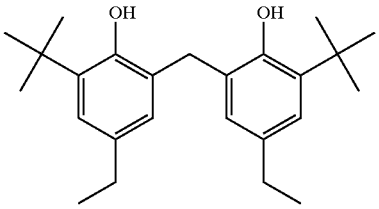

and (Reducing agent 3)

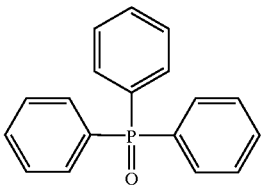

1:1 complex

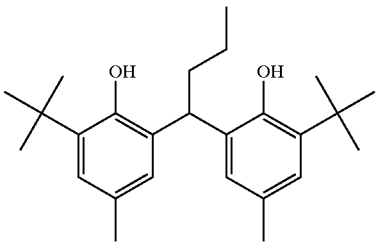

(Reducing agent 4)

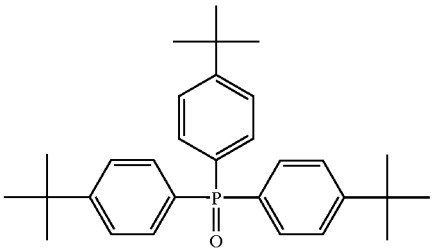

(Hydrogen-bonding compound 2)

-continued

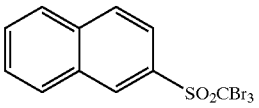

(Polyhalogen compound 1)

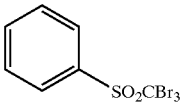

(Polyhalogen compound 2)

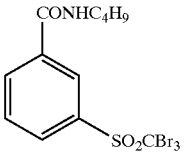

(Polyhalogen compound 3)

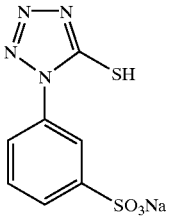

(Mercapto compound 1)

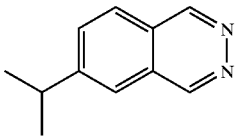

(Phthalazine compound 1)

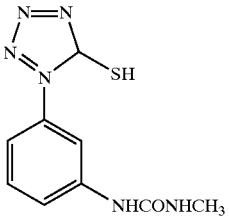

(Mercapto compound 2)

$C_8F_{17}SO_2-N(C_3H_7(n))-CH_2CO_2K$ (F-1)

$C_8F_{17}SO_2-N(C_3H_7(n))-CH_2CH_2O(CH_2CH_2O)_n-H$ (F-2)

n = 15 (average)

$C_8F_{17}SO_2-N(C_3H_7(n))-(CH_2CH_2O)_4(CH_2)_4SO_3Na$ (F-3)

$C_8F_{17}SO_3K$ (F-4)

$C_8F_{17}(CH_2)_2SO_2-N(C_3H_7(n))-CH_2CO_2K$ (F-5)

-continued (F-6)

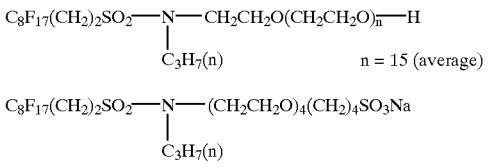

n = 15 (average)

(F-7)

(F-8)

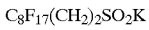

(Evaluation of Photographic Performance)

Using the resulting heat-developable photosensitive materials, the following development treatments (1) to (3) were conducted and the resulting image was evaluated by a Macbeth densitometer (manufactured by Macbeth Co.). The sensitivity was expressed by a relative value to the sensitivity of the heat-developable photosensitive material 101 (which belongs to 1XX series samples) obtained by standard development, that was taken as 100. The larger the relative value, the higher the sensitivity. In the same manner, the sensitivity of the non-image portion (non-exposed portion) was also expressed by the relative value and fogging was evaluated. Furthermore, the color developing density of the dye image formed by the compound represented by the general formula (5) and the compound represented by the general formula (6) or (7) was examined.

To change the heat development conditions, the test was conducted after transformation of the heat developing apparatus.

(1) Standard Development

Using a Fuji medical dry laser imager FM-DPL (equipped with a 660 nm semiconductor laser having a maximum output of 60 mW (IIIB)), photographic materials were exposed to light and heat-developed (four panel heaters set to 112° C.-119° C.-121° C.-121° C.), and heat-developable photosensitive materials (1XX and 2XX series samples) were heat-developed for 24 seconds, while heat-developable photosensitive materials (3XX series samples) were heat-developed for 14 seconds.

(2) Development at High Temperature of −3° C.

The treatment was conducted under the same conditions as those in case of the above standard development, except that the heat development section was set to 109° C.-116° C.-118° C.-118° C. using four panel heaters, and then the evaluation was conducted.

(3) Development for a Short Time

The treatment was conducted under the same conditions as those in case of the above standard development, except that the heat development time was reduced, for example, the treatment was conducted for 19 seconds when the standard development time is 24 seconds, while the treatment was conducted for 11 seconds when the standard development time is 14 seconds, and then the evaluation was conducted.

Measurement of Color Developing Density

The heat-developable photosensitive material, entire surface of which was exposed to light, was heat-developed and a dye formed by the compound represented by the general formula (5) and the compound represented by the general formula (6) or (7) was extracted by immersing in 10% hydrous methanol at 25° C. for one hour. Using a spectrophotometer, Model UV-310OPC, manufactured by Shimadzu Corporation, an absorption spectrum was measured and a maximum value of absorption at a wavelength between 500 to 600 nm was converted into transmission absorption of the heat-developable photosensitive material.

TABLE 1

| Samples | Heat-developable photo-sensitive materials | Compounds of the general formula (1) or (2) Kind | Amount (mol/m$^2$) | (1) Standard development Fogging | Sensitivity | (2) Development at high temperature of −3° C. Fogging | Sensitivity | (3) Development for a short time Fogging | Sensitivity | Remarks |
|---|---|---|---|---|---|---|---|---|---|---|
| 101 | 1 | A-7 | $5 \times 10^{-5}$ | 0.15 | 100 | 0.14 | 95 | 0.14 | 95 | Present invention |
| 102 | 1 | A-31 | $5 \times 10^{-5}$ | 0.15 | 102 | 0.14 | 96 | 0.14 | 96 | Present invention |
| 103 | 1 | C-1 | $5 \times 10^{-5}$ | 0.15 | 58 | 0.14 | 47 | 0.14 | 46 | Present invention |
| 201 | 2 | A-7 | $5 \times 10^{-5}$ | 0.15 | 99 | 0.14 | 95 | 0.14 | 96 | Present invention |
| 202 | 2 | A-47 | $5 \times 10^{-5}$ | 0.15 | 103 | 0.14 | 96 | 0.14 | 97 | Present invention |
| 203 | 2 | A-50 | $5 \times 10^{-5}$ | 0.15 | 104 | 0.14 | 96 | 0.14 | 97 | Present invention |
| 301 | 3 | A-5 | $8 \times 10^{-5}$ | 0.15 | 97 | 0.14 | 94 | 0.14 | 95 | Present invention |
| 302 | 3 | A-7 | $8 \times 10^{-5}$ | 0.15 | 97 | 0.14 | 94 | 0.14 | 97 | Present invention |
| 303 | 3 | A-13 | $8 \times 10^{-5}$ | 0.15 | 97 | 0.14 | 94 | 0.14 | 93 | Present invention |
| 304 | 3 | A-31 | $8 \times 10^{-5}$ | 0.15 | 99 | 0.13 | 96 | 0.13 | 95 | Present invention |
| 305 | 3 | A-32 | $8 \times 10^{-5}$ | 0.15 | 98 | 0.14 | 96 | 0.14 | 95 | Present invention |
| 306 | 3 | A-35 | $8 \times 10^{-5}$ | 0.15 | 99 | 0.14 | 97 | 0.14 | 95 | Present invention |
| 307 | 3 | A-37 | $8 \times 10^{-5}$ | 0.15 | 100 | 0.14 | 98 | 0.14 | 94 | Present invention |
| 308 | 3 | A-47 | $8 \times 10^{-5}$ | 0.15 | 103 | 0.14 | 100 | 0.14 | 93 | Present invention |
| 309 | 3 | A-50 | $8 \times 10^{-5}$ | 0.15 | 104 | 0.14 | 100 | 0.14 | 93 | Present invention |
| 310 | 3 | A-55 | $8 \times 10^{-5}$ | 0.15 | 94 | 0.14 | 91 | 0.14 | 92 | Present invention |
| 311 | 3 | A-58 | $8 \times 10^{-5}$ | 0.15 | 94 | 0.14 | 91 | 0.14 | 91 | Present invention |
| 312 | 3 | A-59 | $8 \times 10^{-5}$ | 0.15 | 95 | 0.14 | 91 | 0.14 | 90 | Present invention |
| 313 | 3 | A-70 | $8 \times 10^{-5}$ | 0.15 | 94 | 0.14 | 90 | 0.14 | 90 | Present invention |
| 314 | 3 | C-1 | $8 \times 10^{-5}$ | 0.14 | 65 | 0.14 | 58 | 0.14 | 55 | Comparative Example |
| 315 | 3 | C-2 | $8 \times 10^{-5}$ | 0.14 | 66 | 0.14 | 59 | 0.14 | 56 | Comparative Example |
| 316 | 3 | C-3 | $8 \times 10^{-5}$ | 0.14 | 60 | 0.14 | 50 | 0.14 | 52 | Comparative Example |
| 317 | 3 | — | — | 0.13 | 48 | 0.13 | 33 | 0.13 | 37 | Comparative Example |
| 318 | 3 | A-202 | $8 \times 10^{-5}$ | 0.14 | 100 | 0.14 | 97 | 0.14 | 93 | Present invention |

TABLE 1-continued

| Samples | Heat-developable photo-sensitive materials | Compounds of the general formula (1) or (2) Kind | Amount (mol/m$^2$) | (1) Standard development Fogging | Sensitivity | (2) Development at high temperature of −3° C. Fogging | Sensitivity | (3) Development for a short time Fogging | Sensitivity | Remarks |
|---|---|---|---|---|---|---|---|---|---|---|
| 319 | 3 | A-258 | $8 \times 10^{-5}$ | 0.14 | 101 | 0.14 | 98 | 0.13 | 94 | Present invention |
| 320 | 3 | A-240 | $8 \times 10^{-5}$ | 0.14 | 98 | 0.14 | 96 | 0.14 | 92 | Present invention |

Compounds for comparison C-1 to C-3 in the table are shown below.

Compounds for Comparison (C - 1)

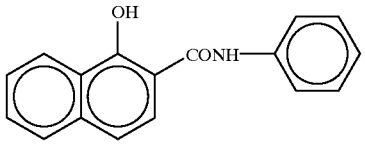

(C - 2)

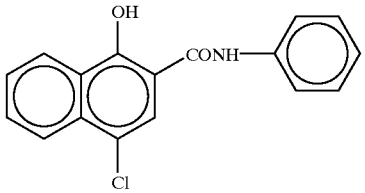

-continued (C - 3)

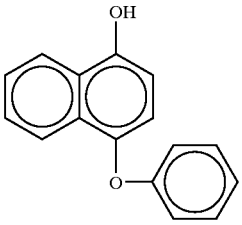

As is apparent from the results shown in Table 1, the heat-developable photosensitive materials using the compound represented by the general formula (1) or (2) in combination with the compound represented by the general formula (3) exhibit high sensitivity and less fogging, and is also developed within a short time and causes less change in performances due to change in treatment conditions such as high development temperature.

TABLE 2

| Samples | Heat-developable photo-sensitive materials | Compounds of the general formula (5) Kind | Amount (mol/m$^2$) | Compounds of the general formula (1), (6) or (7) Kind | Amount (mol/m$^2$) | Standard development Fogging | Sensitivity | Development at high temperature of +3° C. Fogging | Sensitivity | Redevelopment for a short time of −5 seconds Fogging | Sensitivity | Color developing density | Remarks |
|---|---|---|---|---|---|---|---|---|---|---|---|---|---|
| 1101 | 1 | D-168 | $6.5 \times 10^{-5}$ | H-23 | $3.0 \times 10^{-5}$ | 0.15 | 100 | 0.15 | 103 | 0.14 | 95 | Detection limitation or less | Present invention |
| 1102 | 1 | D-168 | $9.5 \times 10^{-5}$ | — | — | 0.15 | 100 | 0.45 | 104 | 0.14 | 96 | Detection limitation or less | Comparative Example |
| 1103 | 1 | — | — | H-23 | $9.5 \times 10^{-5}$ | 0.15 | 100 | 0.15 | 102 | 0.14 | 87 | Detection limitation or less | Comparative Example |
| 1201 | 2 | D-168 | $6.5 \times 10^{-5}$ | H-23 | $3.0 \times 10^{-5}$ | 0.15 | 101 | 0.15 | 102 | 0.14 | 96 | Detection limitation or less | Present invention |
| 1202 | 2 | D-168 | $9.5 \times 10^{-5}$ | — | — | 0.15 | 101 | 0.65 | 103 | 0.14 | 97 | Detection limitation or less | Comparative Example |
| 1203 | 2 | — | — | H-23 | $9.5 \times 10^{-5}$ | 0.15 | 101 | 0.15 | 102 | 0.14 | 85 | Detection limitation or less | Comparative Example |
| 1301 | 3 | D-168 | $6.5 \times 10^{-5}$ | H-23 | $3.0 \times 10^{-5}$ | 0.15 | 100 | 0.15 | 103 | 0.14 | 95 | Detection limitation or less | Present invention |
| 1302 | 3 | D-168 | $9.5 \times 10^{-5}$ | — | — | 0.15 | 100 | 0.29 | 103 | 0.14 | 97 | Detection limitation or less | Comparative Example |

TABLE 2-continued

| Samples | Heat-developable photosensitive materials | Compounds of the general formula (5) Kind | Compounds of the general formula (5) Amount (mol/m²) | Compounds of the general formula (1), (6) or (7) Kind | Compounds of the general formula (1), (6) or (7) Amount (mol/m²) | Standard development Fogging | Standard development Sensitivity | Development at high temperature of +3° C. Fogging | Development at high temperature of +3° C. Sensitivity | Redevelopment for a short time of −5 seconds Fogging | Redevelopment for a short time of −5 seconds Sensitivity | Color developing density | Remarks |
|---|---|---|---|---|---|---|---|---|---|---|---|---|---|
| 1303 | 3 | — | — | H-23 | $9.5 \times 10^{-5}$ | 0.15 | 100 | 0.15 | 103 | 0.14 | 8 | Detection limitation or less | Comparative Example |
| 1304 | 3 | — | — | — | — | 0.14 | 75 | 0.14 | 80 | 0.13 | 57 | Detection limitation or less | Comparative Example |
| 1305 | 3 | D-168 | $6.5 \times 10^{-5}$ | H-23 | $3.0 \times 10^{-5}$ | 0.15 | 100 | 0.15 | 103 | 0.14 | 95 | Detection limitation or less | Present invention |
| 1306 | 3 | D-166 | $6.5 \times 10^{-5}$ | H-23 | $3.0 \times 10^{-5}$ | 0.15 | 99 | 0.15 | 102 | 0.14 | 95 | Detection limitation or less | Present invention |
| 1307 | 3 | D-119 | $6.5 \times 10^{-5}$ | H-23 | $3.0 \times 10^{-5}$ | 0.15 | 98 | 0.15 | 102 | 0.14 | 94 | Detection limitation or less | Present invention |
| 1308 | 3 | D-172 | $6.5 \times 10^{-5}$ | H-23 | $3.0 \times 10^{-5}$ | 0.15 | 98 | 0.15 | 101 | 0.14 | 93 | Detection limitation or less | Present invention |
| 1309 | 3 | D-101 | $6.5 \times 10^{-5}$ | H-23 | $3.0 \times 10^{-5}$ | 0.15 | 97 | 0.15 | 101 | 0.14 | 93 | Detection limitation or less | Present invention |
| 1310 | 3 | D-168 | $6.5 \times 10^{-5}$ | H-25 | $3.0 \times 10^{-5}$ | 0.15 | 99 | 0.15 | 103 | 0.14 | 95 | Detection limitation or less | Present invention |
| 1311 | 3 | D-168 | $6.5 \times 10^{-5}$ | H-32 | $3.0 \times 10^{-5}$ | 0.15 | 99 | 0.15 | 102 | 0.14 | 95 | Detection limitation or less | Present invention |
| 1312 | 3 | D-168 | $6.5 \times 10^{-5}$ | H-134 | $3.0 \times 10^{-5}$ | 0.15 | 98 | 0.15 | 102 | 0.14 | 95 | Detection limitation or less | Present invention |
| 1313 | 3 | D-168 | $6.5 \times 10^{-5}$ | H-123 | $3.0 \times 10^{-5}$ | 0.15 | 97 | 0.15 | 101 | 0.14 | 94 | Detection limitation or less | Present invention |
| 1314 | 3 | D-168 | $6.5 \times 10^{-5}$ | A-31 | $3.0 \times 10^{-5}$ | 0.14 | 107 | 0.15 | 110 | 0.15 | 100 | Detection limitation or less | Present invention |
| 1315 | 3 | D-168 | $6.5 \times 10^{-5}$ | A-35 | $3.0 \times 10^{-5}$ | 0.14 | 105 | 0.14 | 109 | 0.14 | 79 | Detection limitation or less | Present invention |

As is apparent from the results shown in Table 2, the heat-developable photosensitive materials using the compound represented by the general formula (5) in combination with the compound represented by the general formula (3) hardly exert an influence on the image color tone and exhibit high sensitivity and less fogging, and is also developed within a short time and causes less change in performances due to change in treatment conditions such as high development temperature.

As described above, according to the invention, there can be provided a novel heat-developable photosensitive material which hardly exerts an influence on the image color tone and exhibits high sensitivity and less fogging, and is also developed quickly and causes less change in performances due to change in heat development temperature.

What is claimed is:

1. A silver image forming heat-developable photosensitive material comprising, a substrate having disposed on a same surface thereof at least a photosensitive silver halide, a reducible silver salt, a compound represented by the following structural formula (1), a binder, and a compound represented by the following structural formula (3), wherein the silver image forming heat developable photosensitive material is capable of producing an image by itself and a functional layer for forming an image is not provided on the silver image forming heat developable photosensitive material, wherein the amount of the compound represented by structural formula (1) is in the range from 0.3 to 100 mmol/mol Ag:

Structural formula (1)

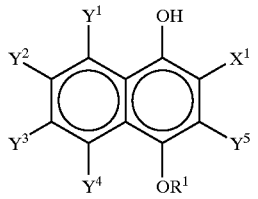

Structural formula (3)

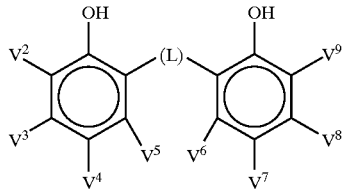

wherein, in the structural formula (1), $R^1$ represents an alkyl group, an aryl group, an alkenyl group o an alkynyl group, $X^1$ represents an acyl group, an alkoxycarbonyl group, a carbamoyl group, or a sulfonyl group, and $Y^1$ to $Y^5$ each independently represents a hydrogen atom or a substituent; and in the structural formula (3), $V^2$ to $V^9$ each independently represents a hydrogen atom or a substituent, L represents a linking group —CH($V^{10}$)- or a linking group —S—, and $V^{10}$ represents a hydrogen atom or a substituent.

2. The silver image forming heat-developable photosensitive material according to claim 1, wherein $X^1$ in the compound represented by the structural formula (1) represents a carbamoyl group.

3. The silver image forming heat-developable photosensitive material according to claim 1, wherein $X^1$ in the compound represented by the structural formula (1) represents an alkyl carbamoyl group or an aryl carbamoyl group.

4. The silver image forming heat-developable photosensitive material according to claim 1, wherein $X^1$ in the compound represented by the structural formula (1) represents an aryl carbamoyl group.

5. The silver image forming heat-developable photosensitive material according to claim 1, wherein $R^1$ in the compound represented by the structural formula (1) represents an alkyl group or an aryl group.

6. The silver image forming heat-developable photosensitive material according to claim 2, wherein $R^1$ in the compound represented by the structural formula (1) represents an alkyl group or an aryl group.

7. The silver image forming heat-developable photosensitive material according to claim 3, wherein $R^1$ in the compound represented by the structural formula (1) represents an alkyl group or an aryl group.

8. The silver image forming heat-developable photosensitive material according to claim 1, further comprising an ultrahigh-contrast agent.

9. The silver image forming heat-developable photosensitive material according to claim 2, further comprising an ultrahigh-contrast agent.

10. The silver image forming heat-developable photosensitive material according to claim 3, further comprising an ultrahigh-contrast agent.

11. The silver image forming heat-developable photosensitive material according to claim 1, wherein the amount of the compound represented by structural formula (1) is in the range from 0.5 to 30 mmol/mol Ag.

12. An image forming method, comprising exposing the heat-developable photosensitive material of claim 1 to light and heat-developing the exposed heat-developable photosensitive material to form an image.

13. An image forming method, comprising exposing the heat-developable photosensitive material of claim 2 to light and heat-developing the exposed heat-developable photosensitive material to form an image.

14. An image forming method, comprising exposing the heat-developable photosensitive material of claim 3 to light and heat-developing the exposed heat-developable photosensitive material to form an image.

* * * * *